US005900856A

United States Patent [19]

Iino et al.

[11] Patent Number: 5,900,856

[45] **Date of Patent: * May 4, 1999**

[54] MATRIX DISPLAY APPARATUS, MATRIX DISPLAY CONTROL APPARATUS, AND MATRIX DISPLAY DRIVE APPARATUS

[75] Inventors: Shoichi Iino; Akihiko Ito; Yoichi Imamura, all of Suwa, Japan

[73] Assignee: Seiko Epson Corporation, Tokyo, Japan

[ * ] Notice: This patent is subject to a terminal disclaimer.

[21] Appl. No.: 08/485,875

[22] Filed: Jun. 7, 1995

Related U.S. Application Data

[63] Continuation-in-part of application No. PCT/JP93/00279, Mar. 4, 1993, application No. 08/148,083, Nov. 4, 1993, and application No. 08/088,142, Jul. 7, 1993.

[30] Foreign Application Priority Data

| | | | |
|---|---|---|---|
| Mar. 5, 1992 | [JP] | Japan | 4-48743 |
| Apr. 6, 1992 | [JP] | Japan | 4-84007 |
| May 8, 1992 | [JP] | Japan | 4-143482 |
| Jul. 7, 1992 | [JP] | Japan | 4-179997 |
| Jun. 24, 1993 | [JP] | Japan | 5-152533 |

[51] Int. Cl.[6] ..... G09G 3/36

[52] U.S. Cl. ..... 345/100

[58] Field of Search ..... 345/98–100

[56] References Cited

U.S. PATENT DOCUMENTS

| | | |
|---|---|---|
| 3,603,725 | 9/1971 | Cutler . |
| 3,973,252 | 8/1976 | Mitomo . |
| 4,100,579 | 7/1978 | Ernstoff . |
| 4,633,441 | 12/1986 | Ishimoto . |
| 4,672,683 | 6/1987 | Matsueda . |
| 4,683,497 | 7/1987 | Mehrgardt . |
| 4,693,563 | 9/1987 | Harada . |
| 4,812,837 | 3/1989 | Shiraishi . |
| 4,873,516 | 10/1989 | Castleberry . |
| 4,894,646 | 1/1990 | Ryman . |
| 5,172,107 | 12/1992 | Kanno . |
| 5,262,881 | 11/1993 | Kuwata . |
| 5,280,280 | 1/1994 | Hotto . |
| 5,420,604 | 5/1995 | Scheffer . |
| 5,475,397 | 12/1995 | Saidi . |

FOREIGN PATENT DOCUMENTS

| | | |
|---|---|---|
| 0 206 178 | 12/1986 | European Pat. Off. . |
| 0 349 415 | 1/1990 | European Pat. Off. . |

(List continued on next page.)

OTHER PUBLICATIONS

Ruckmongathan, T.N.; "Some New Addressing Techniques For RMS Responding Matrix LCDs", Doctoral Thesis, Feb. 1988.

2449 Displays vol. 14 (1993) No. 2, Jordan Hill, Oxford, GB, "Active Addressing™ of STN displays for high–performance video applications" by T.J. Scheffer, B. Clifton, D. Prince and A.R. Conner, pp. 74–85.

(List continued on next page.)

*Primary Examiner*—Jeffery Brier
*Attorney, Agent, or Firm*—Eric B. Janofsky

[57] ABSTRACT

A matrix display apparatus is provided for displaying an image in accordance with display data. The display matrix comprises a plurality of scanning electrodes and a plurality of signal electrodes arranged in a matrix. A first driving circuit applies a plurality of selection voltages to the scanning electrodes. The scanning electrodes are divided into groups of h scanning electrodes. A selection voltage is applied to each of the plurality of scanning electrodes selected from the plurality of selection voltages in accordance with the selection pattern data. The second driving circuit provides a plurality of signal voltages to the plurality of signal electrodes. The second driver circuit comprises a memory for storing the display data for at least one group of h scanning electrodes and a selecting circuit for selecting a signal voltage applied to each of the plurality of signal electrodes.

26 Claims, 34 Drawing Sheets

FOREIGN PATENT DOCUMENTS

| | | |
|---|---|---|
| 0 388 976 | 9/1990 | European Pat. Off. . |
| 0 479 450 | 4/1992 | European Pat. Off. . |
| 0 507 061 | 10/1992 | European Pat. Off. . |
| 0 569 974 | 11/1993 | European Pat. Off. |
| 4031905 | 4/1991 | Germany . |
| 54/22856 | 8/1979 | Japan . |
| 57/15393 | 3/1982 | Japan . |
| 267694 | 10/1989 | Japan . |
| 3-185490 | 8/1991 | Japan . |
| 645473 | 9/1984 | Switzerland . |
| 2 106 689 | 4/1983 | United Kingdom . |
| 2 179 185 | 2/1987 | United Kingdom . |
| 2 249 855 | 5/1992 | United Kingdom . |
| 93/18501 | 9/1993 | WIPO . |
| 93/20550 | 10/1993 | WIPO . |
| 95/01628 | 1/1995 | WIPO . |

OTHER PUBLICATIONS

2320 Proceedings of the S.I.D. vol. 24 (1983) No. 3, Los Angeles, CA USA "New Addressing Techniques for Multiplexed Liquid Crystal Displays" by T.N. Ruckmongathan and N.V. Madhusudana, pp. 259–262.

1992 SID International Symposium, May 1992, "Active Addressing Method For High–Contrast Video–Rate S TN Displays," by T.J. Scheffer, B. Clifton, pp. 228–231.

Ruckmongathan, T.N. "A Generalized Addressing Technique For RMS Responding Matrix LCDs" 1988 IDR Conference pp. 80–85.

Proceedings Japan Display '92, Hiroshima, Japan; B. Clifton, D. Prince, In Focus Systems, Inc., Tualatin, OR, USA "Hardware Architectures for Video–Rate, Active Addressed STN Displays" pp. 503–506.

1994 SID International Symposium, 7.2: *An Addressing Technique with R educed Hardware Complexity* by T.N. Ruckmongathan pp. 65–68.

1994 SID International Symposium, 7.1: A 9.4–in. *Color VGA F–STN Display with Fast Response Time and High Contrast Ratio by Using MLS Method*, by H. Muraji, H. Koh, T. Kuwata, Y. Nakagawa pp. 61–64.

1994 SID International Symposium, 7.3:*A Study of the Active Drive Method for STN–LCDs* by Y. Fukui, M. Yumine, T. Matsumoto, pp. 69–72.

Japan Display 92, *Pulse Height Modulation* (*PHM*) *Gray Shading Mehtods for Passive Matrix LCDs*, A.R. Connor, T.J. Scheffer, pp. 69–72.

*Old Thinking, New Methods and Television*, Wireless, Jan. 1969.

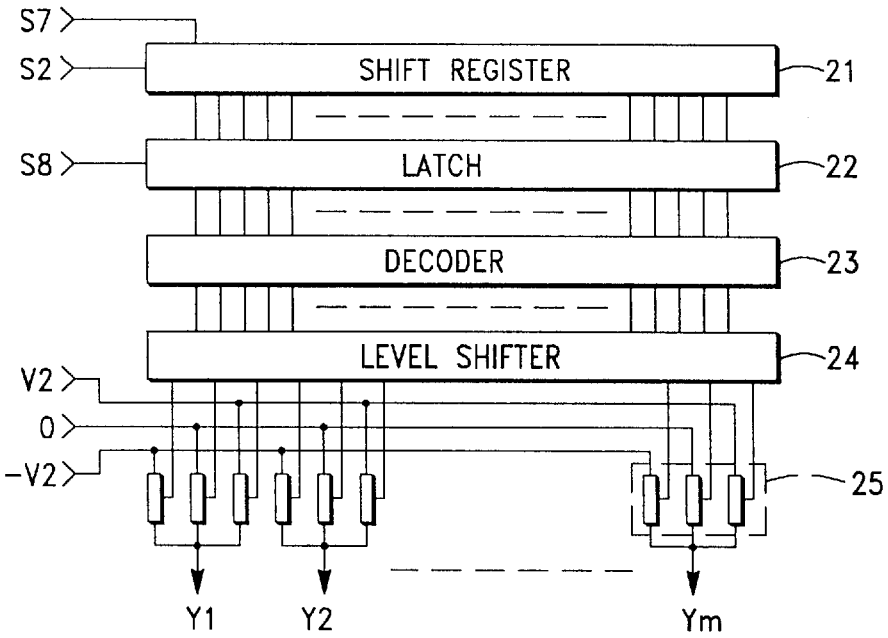
FIG.-6
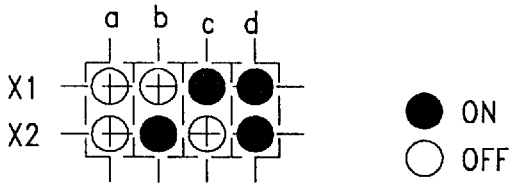
FIG.-9
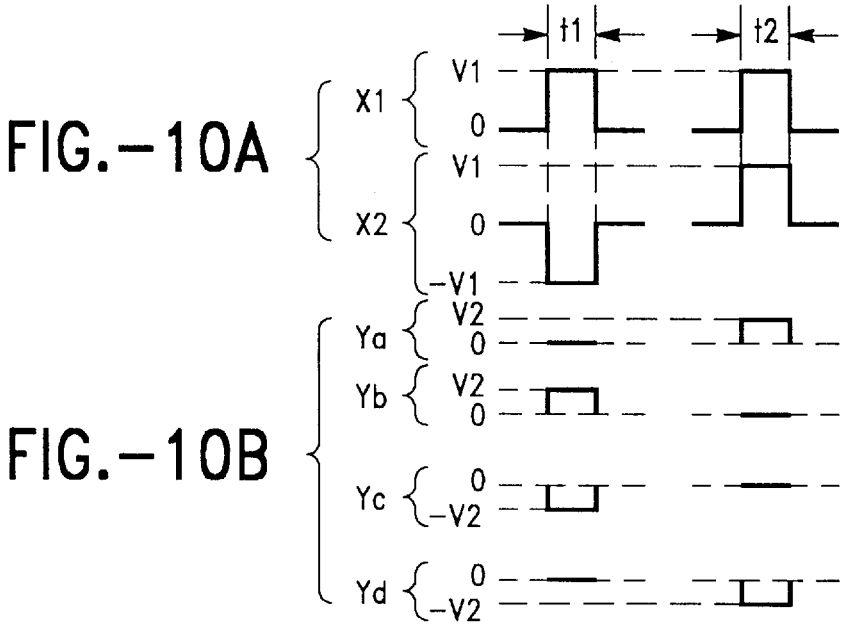
FIG.-10A
FIG.-10B

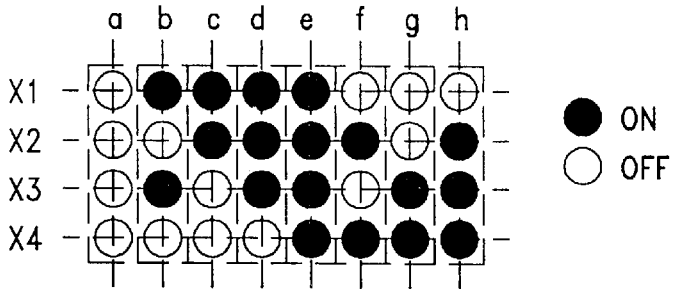
FIG.-12
FIG.-13A
FIG.-13B
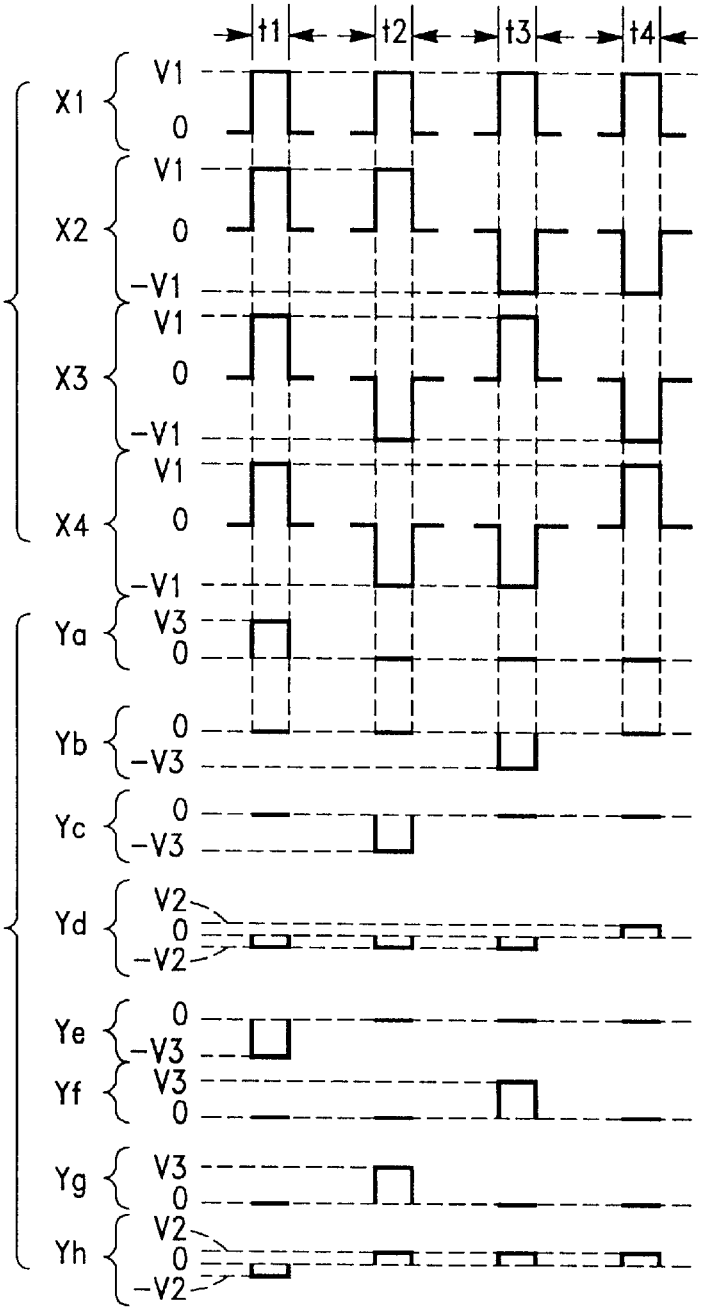

Δt
X1
X2
X3

X1
X2
X3

X1
X2
X3

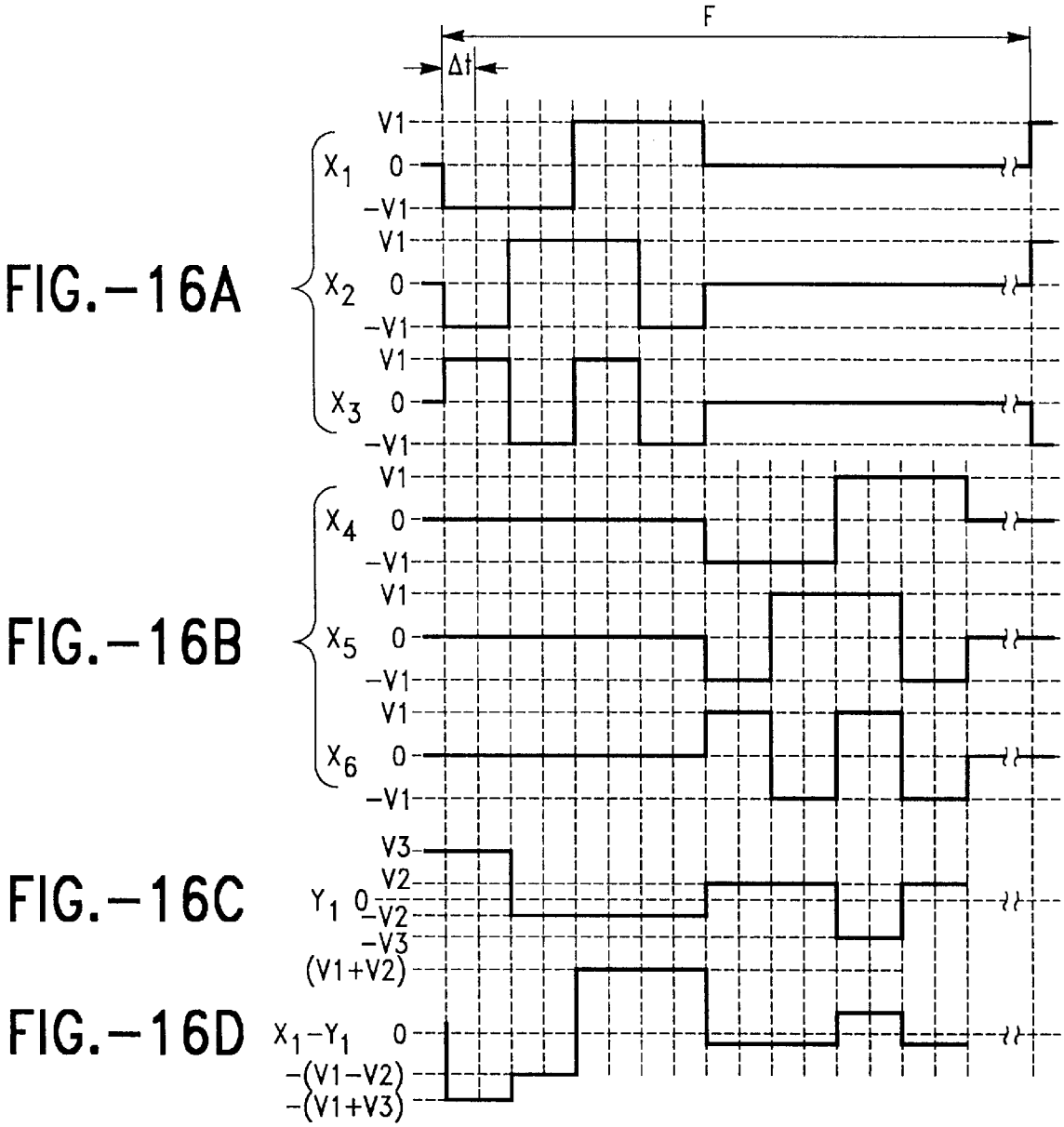
F
Δt
V1
0
−V1
X1
X2
X3
X4
X5
X6
V3
V2
−V2
−V3
Y1
(V1+V2)
X1−Y1
−(V1−V2)
−(V1+V3)
FIG.−16A
FIG.−16B
FIG.−16C
FIG.−16D

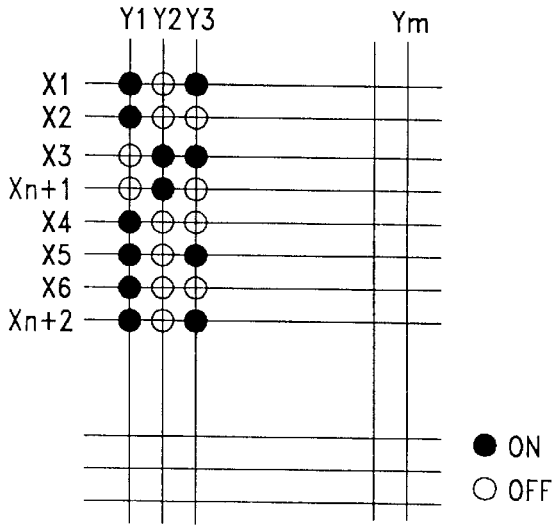
FIG.-20
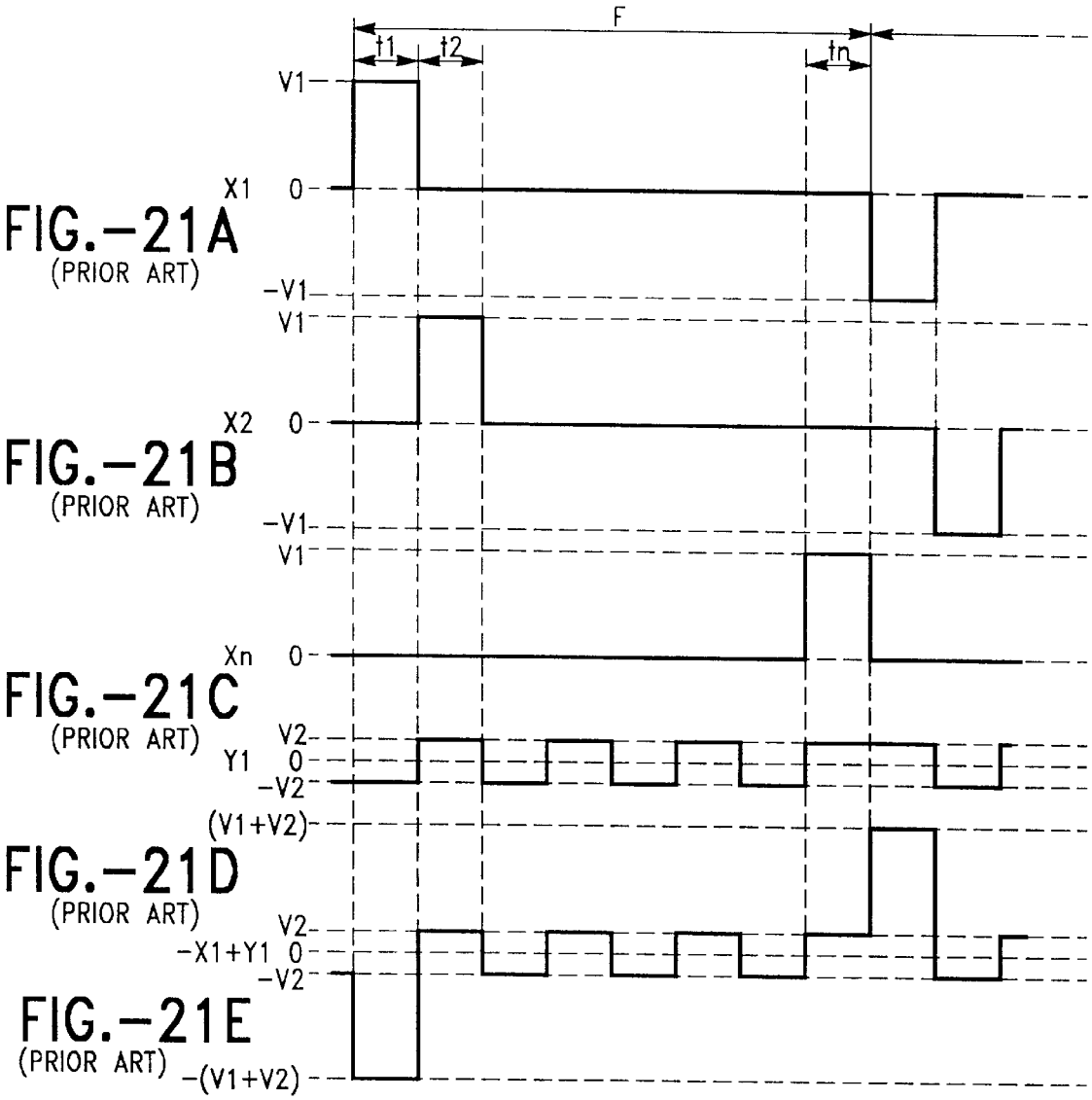
FIG.-21A (PRIOR ART)
FIG.-21B (PRIOR ART)
FIG.-21C (PRIOR ART)
FIG.-21D (PRIOR ART)
FIG.-21E (PRIOR ART)

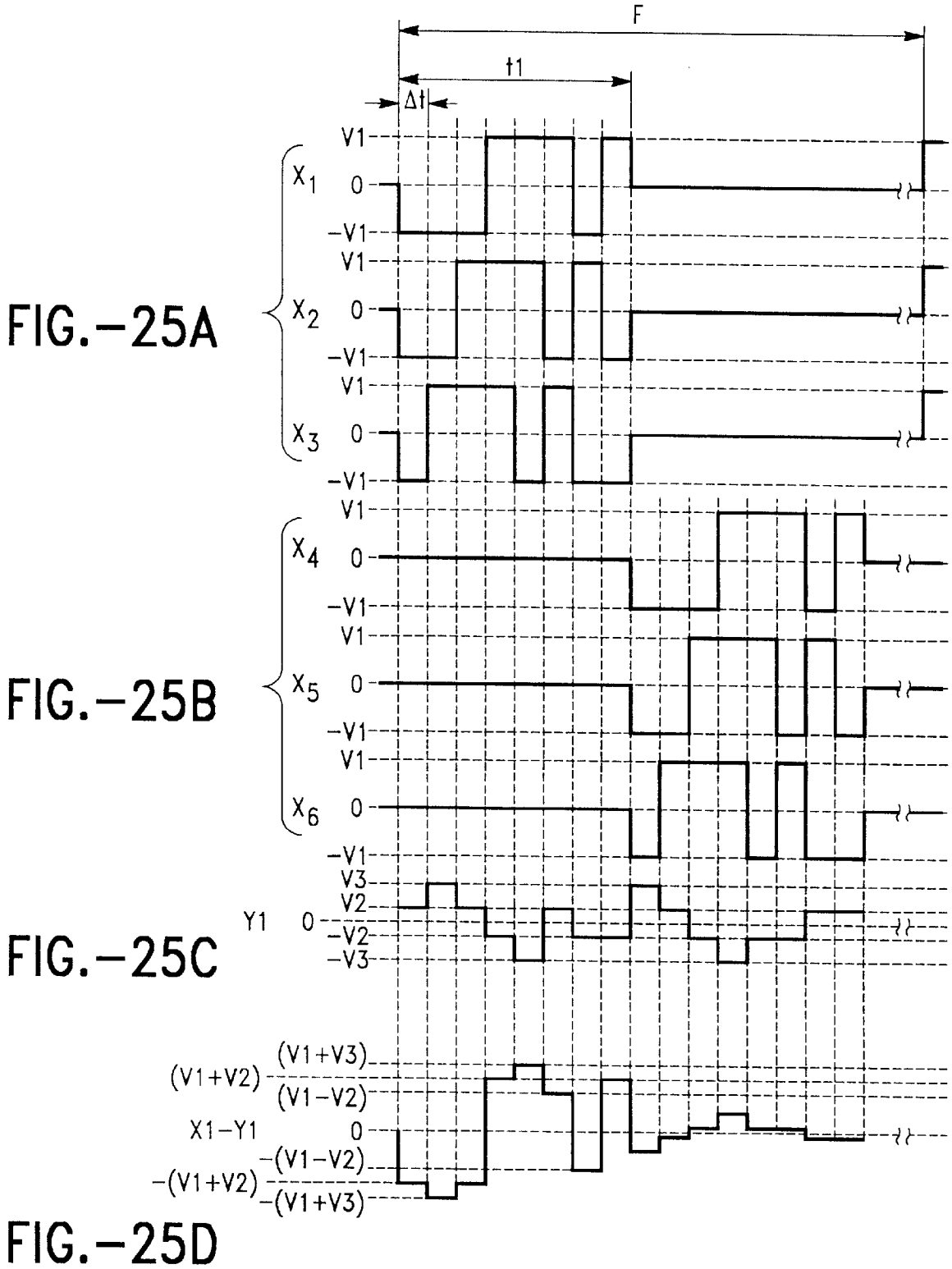
FIG.−25A
FIG.−25B
FIG.−25C
FIG.−25D

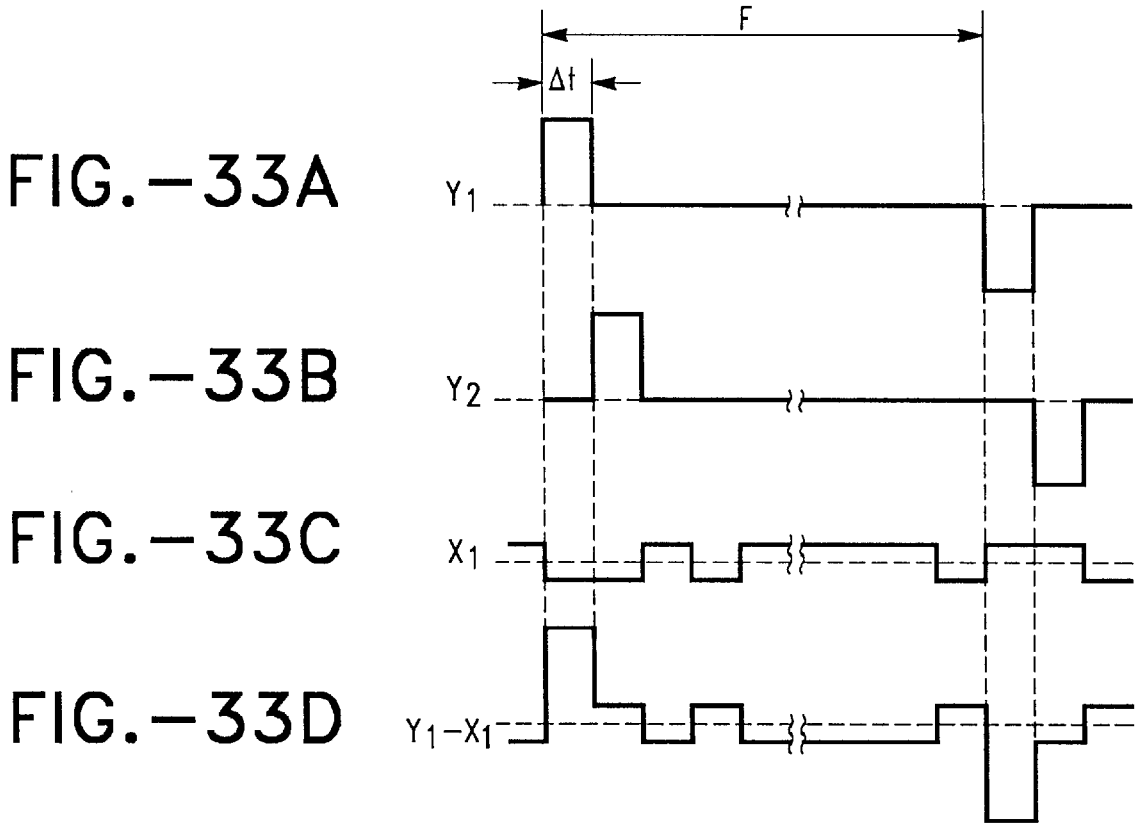
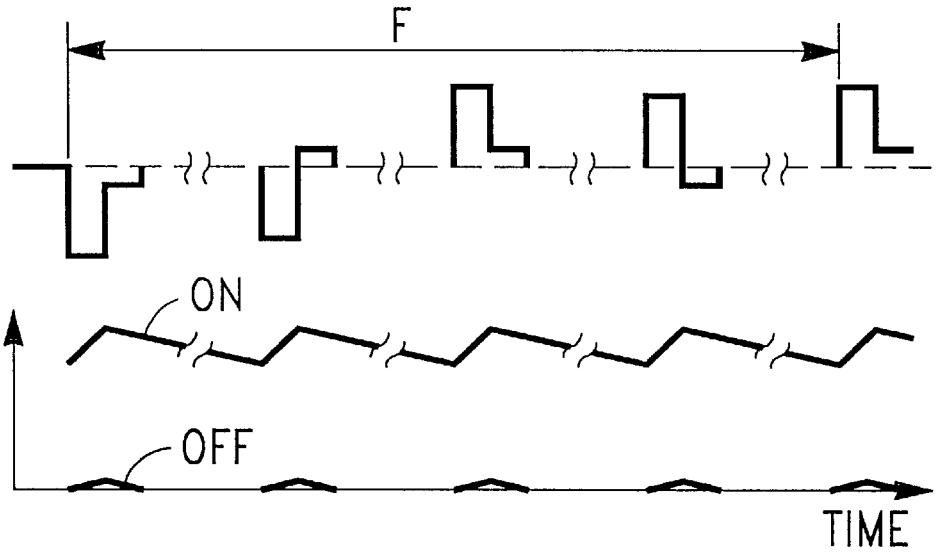
FIG.—36

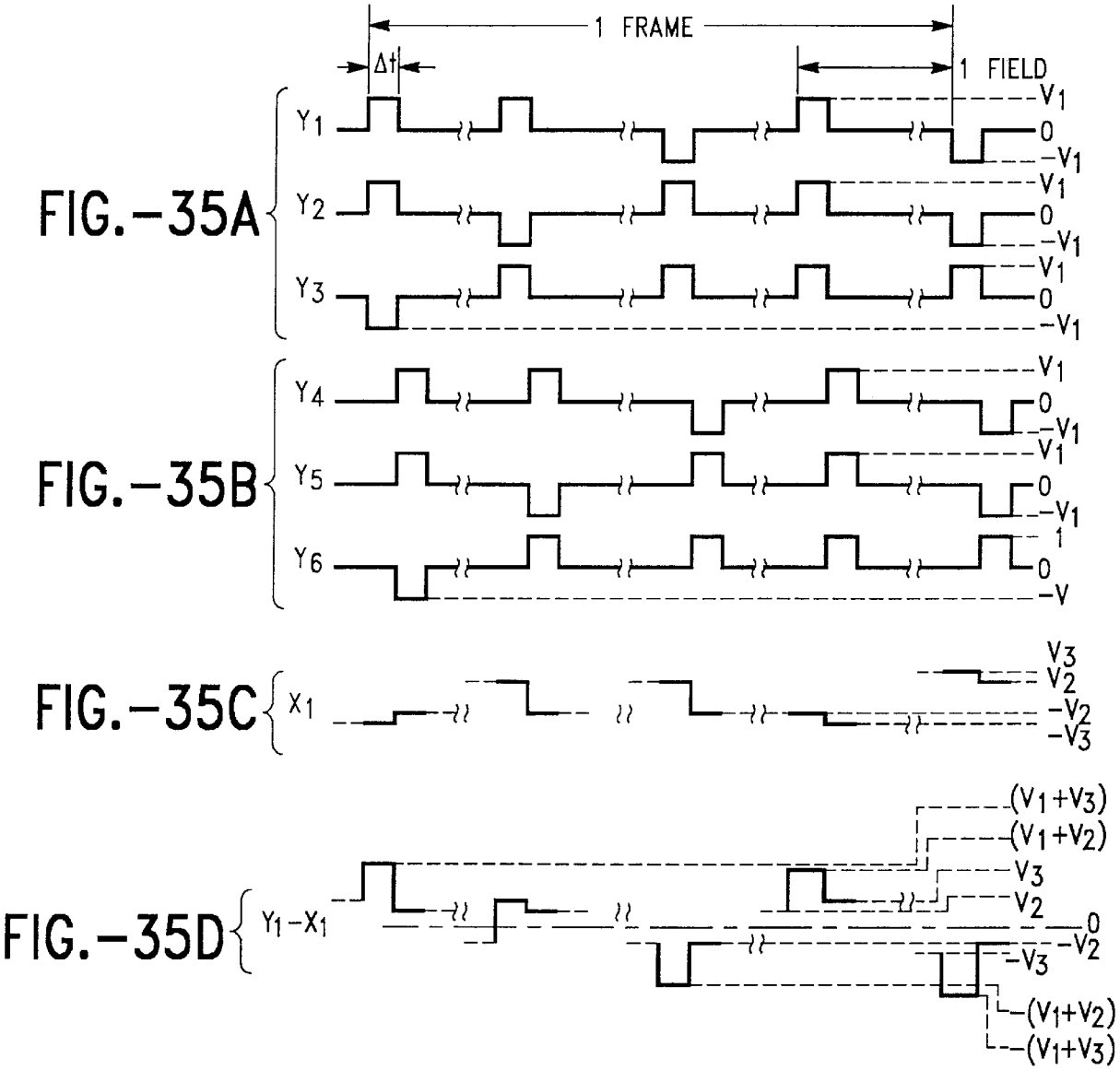
FIG.−35A
FIG.−35B
FIG.−35C
FIG.−35D

MATRIX DISPLAY APPARATUS, MATRIX DISPLAY CONTROL APPARATUS, AND MATRIX DISPLAY DRIVE APPARATUS

CROSS-REFERENCE TO RELATED APPLICATIONS

This application is a continuation-in-part of International Application No. PCT/JP93/00279, filed on Mar. 4, 1993, a continuation-in-part of U.S. patent application Ser. No. 08/148,083, filed Nov. 4, 1993, and a continuation-in-part of U.S. patent application Ser. No. 08/088,142, filed Jul. 7, 1993, the contents of each of which are incorporated herein by reference.

FIELD OF THE INVENTION

The present invention generally relates to a driving apparatus and a driving method for a liquid crystal display having a plurality of row electrodes and column electrodes. More particularly, the present invention relates to a liquid crystal display or other matrix-type display apparatus suited to using a multiple line selection drive method, and relates specifically to an improvement of primarily the matrix-type display element module, controller, and signal electrode driver circuit.

BACKGROUND OF THE INVENTION

In a simple matrix-type liquid crystal display commonly used for flat panel display devices, the display data from a microprocessor unit (MPU) is typically transferred to the LCD module (the liquid crystal display panel (LCD panel)), the scan electrode drive circuit (Y driver), and the signal electrode drive circuit (X driver) using one of two basic methods: using a matrix-type liquid crystal display element module controller (simply "module controller" below), or using an X driver embedded in RAM.

The module controller method is described first. As with a CRT display apparatus, the module controller connected to the system bus reads the display data from video RAM (VRAM), and sends the data to the LCD module at a high frequency to refresh the display.

In the latter method, a dual port frame memory (built-in RAM) is provided in the X driver. This frame memory is directly accessed by the MPU via the data bus, control bus, or address bus irrespective of the LCD timing to generate the required control signal in the X driver by changing the display data in the frame memory. One scan line equivalent of display data is simultaneously read from the built-in frame memory to refresh the display.

With the module controller method above, VRAM data access and transfer coordinated with the LCD timing must be executed each time the display screen is changed, and it is therefore necessary for the VRAM, module controller, and LCD driver to constantly operate at a high frequency. In addition, the display refresh operation involves operation of the VRAM, module controller, and LCD driver. Operation of an LSI device at a high frequency clock results in through-current flowing to the plural CMOS devices used as circuit elements, increasing the total current consumption. Total current consumption also increases in direct proportion to the size of the LCD panel. In addition, while the VRAM is accessed by both the MPU and the module controller, a high speed clock must be used so that MPU access during the display refresh operation does not collide with module controller access, thus limiting the use of a low frequency operating module controller and limiting the processing ability of the MPU.

Operation at a low frequency clock is possible in the latter method above because there is no relationship between display data transfer and LCD timing. This method thus requires 10–100 times less power than the module controller method. When using a large liquid crystal panel, however, the number of X drivers must be increased.

The number of X driver output terminals is generally a multiple of ten (e.g., 160 pins) and not a power of two (e.g., $2^n$), however, because each RAM device built into the X drivers has an independent address area. When the internal memory of plural X drivers is addressed by the MPU, the MPU finds apparent gaps in the total memory area, and it is usually difficult to maintain a continuous sequence of addresses. As a result, the address coordination process of the MPU must be executed at high speed when the entire display area is changed at one time as during scrolling or panning operations, significantly increasing the processing load on the MPU.

It is, of course, possible to design the X driver ICs to have an exponent-of-two number of output pins, but this would seriously impair system interchangeability because compatibility with the number of electrodes in existing LCD panels would be lost. In addition, use of plural X drivers necessarily increases the number of chip selection buses, and sufficient space for this plural number of X drivers to be installed around the LCD panel must be provided. This reduces the display area ratio of the display panel, and inhibits the potential size reduction of the LCD module. The latter method above is therefore unsuited to large scale liquid crystal panels.

Matrix liquid crystal displays such as, twisted nematic (TN) and super twisted nematic (STN), are known in the art. Reference is made to FIGS. 21A–21E and FIG. 22 in which a conventional matrix liquid crystal display is provided. A liquid crystal panel generally indicated as 1 is composed of a liquid crystal layer 5, a first substrate 2 and a second substrate 3 for sandwiching the liquid crystal layer 5 therebetween. A group of column electrodes $Y_1$–$Y_m$ are oriented on substrate 2 in the vertical direction and a plurality of row electrodes $X_1$–$X_n$ are formed on substrate 3 in substantially the horizontal direction to form a matrix. Each intersection of column electrodes $Y_1$–$Y_m$ and row electrodes $X_1$–$X_n$ forms a display element or pixel 7. Display pixels 7 having the open circle indicate an ON state and those pixels having a blank indicate an OFF state.

A conventional multiplex driving based on the amplitude selective addressing scheme is known to one of ordinary skill in the art as one method of driving the liquid crystal cells mentioned above. In such a method, a selected voltage or non-selected voltage is sequentially applied to each of row electrodes $X_1$–$X_n$ individually. That is, a selection voltage is applied to only one row electrode at a time. In the conventional driving method, the time period required to apply the successive selected or non-selected voltage to all the row electrodes $X_1$–$X_n$ is as one frame period, indicated in FIGS. 21A–21E as time period F. Typically the frame period is approximate 1/60th of a second or 16.66 milliseconds.

Simultaneously to the successive application of the selected voltage or the non-selected voltage to each of the row electrodes $X_1$–$X_n$, a data signal representing an ON or OFF voltage is applied to column electrodes $Y_1$–$Y_m$. Accordingly to turn on a pixel 7, the area in which the row electrode intersects the column electrode, to the ON state, an ON voltage is applied to a desired column electrode when the row electrode is selected.

Referring specifically to FIGS. 21A–21E, a conventional multiplex drive method of a simple matrix type liquid crystal and more specifically the amplitude selective addressing scheme is shown therein. FIGS. 21A–21C show the row selection voltage waveforms that is applied in sequence to row electrodes $X_1$, $X_2$ . . . $X_n$, respectively. More particularly, in time period $t_1$, a voltage pulse having a magnitude of $V_1$ is applied to row electrode $X_1$, and a voltage of zero is applied to electrodes $X_2$–$X_n$; in time period $t_2$, a voltage pulse having a magnitude of $V_1$ is applied to row electrode $X_2$ and a voltage of zero is applied to electrodes $X_1$ and $X_3$–$X_n$; and in time period $t_n$, $V_1$ is applied to row electrode $X_n$ and a voltage of zero is to electrodes $X_1$–$X_{n-1}$. In other words, a voltage pulse having a magnitude of $V_1$ is applied to only one row electrode $X_i$ in time $t_i$. Typically, $t_i$ is approximately 69 $\mu$ seconds and $V_1$ is approximately 25 volts. As will be apparent to one who has read this description, all of the row electrodes are sequentially selected in time periods $t_1$–$t_n$ or one frame period F.

FIG. 21D shows the waveform applied to column electrode $Y_1$, and FIG. 21E shows the synthesized voltage waveform applied to the pixel $\mathbf{7}_{1,1}$ formed at the intersection of the column electrode $Y_1$ and the row electrode $X_1$. As shown therein, during time period $t_1$, a voltage pulse having a magnitude of $V_1$ is applied to row $X_1$ and a voltage pulse of $-V_2$ is applied to column electrode $Y_1$. Typically, $V_2$ is approximately 1.6 volts. The resultant voltage at pixel $\mathbf{7}_{1,1}$ is $-(V_1-V_2)$. This synthesized voltage is sufficient to turn pixel $\mathbf{7}_{1,1}$ to its ON state.

One known problem with this method is that in order to select and drive the one line of the row electrodes, a relatively high voltage is required to provide good display characteristics, such as, contrast and low distortion. These conventional displays, requiring such a high voltage, also consume relatively more energy. When such displays are used in portable devices, they are supplied with electrical energy by, for example, batteries. As a result of the higher energy consumption, the portable devices have relatively shorter times of operation before the batteries require replacement and/or recharging.

Various attempts have been made to overcome this problem. For example, it has been suggested in "A Generalized Addressing Technique for RMS Responding Matrix LCDs," 1988 *International Display Research Conference*, pp. 80–85. to simultaneously applying a row selection voltage to more than one row electrode.

As shown in FIGS. 23A–23D, a conventional method for driving a liquid crystal display by simultaneously selecting a group of more than one row electrode is shown. As shown therein, the n row electrodes are divided in j groups of row electrodes, each group comprising, for example, two row electrodes. In this example, row electrodes $X_1$, $X_2$; $X_3$, $X_4$; and $X_{n-1}$, $X_n$, each form a group of row electrodes.

Referring again to FIG. 23A, that figure illustrates row selection voltage waveforms applied simultaneously to both row electrodes $X_1$ and $X_2$ in time periods $t_1$ and $t_2$ and a voltage of zero is applied to row electrodes $X_1$ and $X_2$ in the remaining time periods of frame period F. Similarly, FIG. 23B indicates the row selection voltage waveforms applied to row electrodes $X_3$ and $X_4$, during time periods $t_3$ and $t_4$ and a voltage of zero is applied to row electrodes $X_3$ and $X_4$ in the other time periods of frame period F. FIG. 23C illustrates the voltage waveform applied to column electrode $Y_1$, and FIG. 23D indicates the synthesized voltage waveform applied to the pixel $\mathbf{7}_{1,1}$. Generally, $t_1$, $t_2$, . . . $t_n$=69 $\mu$ seconds, $V_1$ is approximately 17.6 volts and $V_2$ is approximately 2.3 volts.

As shown in the example of FIGS. 23A–23D, every two row electrodes are selected in sequence. In the first selection sequence, two row electrodes, $X_1$ and $X_2$, are selected and row selection voltage waveforms such as that shown in FIG. 23A are applied to each row electrode. At the same time, the designated column voltage, which is described below, is applied to each column electrode, $Y_1$ to $Y_m$. Next, row electrodes $X_3$ and $X_4$ are simultaneously selected with substantially the same type of waveform voltages as that described above. At the same time, the column voltages $Y_1$ to $Y_m$ are applied to each column electrode. One frame period represents the selection of all row electrodes, $X_1$ to $X_n$. In other words, a complete image is displayed during one frame.

As will be explained hereinbelow, when h row electrodes are simultaneously selected, the voltage waveforms that apply the row electrodes described above use $2^h$ row-select patterns. In the example illustrated in FIGS. 23A–23D, the number of row electrodes simultaneously selected is two, thus the number of row select patterns is $2^2$ or 4.

Moreover, the column voltages applied to each column electrode $Y_1$ to $Y_m$ provide the same number of pulse patterns as that of the row select pulse patterns. That is, there are $2^h$ pulse patterns. These pulse patterns are determined by comparing the states of pixels on the simultaneously selected row electrodes i.e., whether the pixels are ON or OFF, with the polarities of the voltage pulses applied to row electrode.

In this example, as shown in the previously described FIGS. 23A–23D when row electrodes $X_1$ and $X_2$ are selected and row voltages such as those in FIG. 23A and FIG. 24A are applied thereto and when the pixels on row electrodes $X_1$ and $X_2$ are ON and OFF, respectively, the voltage waveform applied the column electrode is voltage waveform $Y_a$ shown in FIG. 24B. When the pixels are OFF and ON, respectively, the column voltage waveform $Y_b$ is applied to the column electrode. In another example, when the pixels are both ON, a voltage waveform $Y_c$ is applied to the column electrode. Finally, when both pixels are OFF, the a column voltage waveform $Y_d$ is applied to the column electrode.

The above-mentioned column voltage waveforms $Y_a$–$Y_d$ are determined as follows. At first, each pixel simultaneously selected is defined to have a first value of 1 when the voltage applied by the row electrode to the corresponding selected pixel is positive or a first value of −1 when the row electrode is negative. Each of the selected pixels is defined to have a second value of −1 when the display state is ON or a second value of 1 when display state is OFF. The first value is compared to the second value bit-by-bit, the difference between the number of matches, i.e., when the first value equals the second value, and the number of mismatches, i.e., when the first value does not equal the second value, is calculated. When the difference between the number of matches and mismatches for the simultaneously selected rows is two, $V_2$ is applied; when 0, $V_0$ is applied; and when −2, $-V_2$ is applied.

For example, when the pulse waveforms shown in FIG. 23A are applied to row electrodes $X_1$ and $X_2$, a column voltage having the waveform of $Y_a$ is applied. This column voltage is determined as follows. The pixels formed at the intersections of column electrode $Y_1$ and rows electrodes $X_1$ and $X_2$ are in the ON and OFF states, respectively. For the purposes of this discussion, these pixels will be referred to as the first and second pixels, respectively. In other words, the first pixel has a second value of −1 and the second pixel has a second value of 1. During the period $t_a$, the first pixel has a first value of −1 and the second pixel has a first value of −1, since the row voltages $X_1$ and $X_2$ are both $-V_1$. Referring to the first pixel, since the first value is −1 and the second value is −1, there is a match. With regard to the second pixel, the first value is −1 and the second value is 1, thereby forming a mismatch. The difference between the number of mismatches and matches is 1—1 or zero. Therefore, a voltage of 0 (zero) is applied to the column electrode in time $t_a$. Next, concerning the pulse waveforms of the time interval $t_b$, the applied voltage of row electrode $X_1$ is positive and the applied voltage of row electrode pulse $X_2$ is negative. Using a similar analysis as described above, the number of matches is zero and the number of mismatches is 2. Thus, $-V_2$ volts will be applied to the second half of time interval $t_1$.

As should now be apparent, the first values in time interval $t_c$ in FIG. 23A are −1 and1 because the applied voltage of row electrode $X_1$ is negative and the applied voltage of row electrode $X_2$ is positive. When these are compared with the second values of the first and second pixels of −1 and 1, the number of matches is two and the number of mismatches is zero. The difference between the number of matches and the number of mismatches is 2. Thus, the column voltage of $V_2$ volts will be applied in time interval $t_c$.

In time interval $t_d$, the applied voltage of row electrodes $X_1$ and $X_2$ are both positive. Thus, the first values are 1 and 1. When compared to the pixel states of −1 and 1, the number of matches is 1 and the number of mismatches is 1, thus the difference between the number of matches and the number of mismatches is zero. Accordingly, zero volts will be applied to $Y_a$ for the time interval $t_d$.

A summary of this analysis for time periods $t_a$, $t_b$, $t_c$ and $t_d$, is shown in Table A below:

TABLE A

| | $t_a$ | $t_b$ | $t_c$ | $t_d$ |
|---|---|---|---|---|
| pixel | | | | |
| 1-ON | | | | |
| first value | −1 | 1 | −1 | 1 |
| second value | −1 | −1 | −1 | −1 |
| match | yes | no | yes | no |
| mismatch | no | yes | no | yes |
| 2-OFF | | | | |
| first value | −1 | −1 | 1 | 1 |
| second value | 1 | 1 | 1 | 1 |
| match | no | no | yes | yes |
| mismatch | yes | yes | no | no |
| no. of matches | 1 | 0 | 2 | 1 |
| no. of mismatches | 1 | 2 | 0 | 1 |
| difference | 0 | −2 | 2 | 0 |
| column voltage | 0 | $-V_2$ | $V_2$ | 0 |

As is readily apparent, the column voltage $Y_a$ corresponds to the column voltage pattern and is applied to the column to place the first pixel in its ON state and the second pixel in its OFF state.

As for the other column voltage waveforms, $Y_b$ to $Y_d$, the voltages are selected under the same criteria as described above and are summarized in Tables B, C and D hereinbelow:

TABLE B

| | $t_a$ | $t_b$ | $t_c$ | $t_d$ |
|---|---|---|---|---|
| pixel | | | | |
| 1-OFF | | | | |
| first value | −1 | 1 | −1 | 1 |
| second value | 1 | 1 | 1 | 1 |
| match | no | yes | no | yes |
| mismatch | yes | no | yes | no |
| 2-ON | | | | |
| first value | −1 | −1 | 1 | 1 |
| second value | −1 | −1 | −1 | −1 |
| match | yes | yes | no | no |
| mismatch | no | no | yes | yes |
| no. of matches | 1 | 2 | 0 | 1 |
| no. of mismatches | 1 | 0 | 2 | 1 |
| difference | 0 | −2 | 2 | 0 |
| column voltage | 0 | $-V_2$ | $V_2$ | 0 |

Column Voltage Applied = $Y_b$

TABLE C

| | $t_a$ | $t_b$ | $t_c$ | $t_d$ |
|---|---|---|---|---|
| pixel | | | | |
| 1-ON | | | | |
| first value | −1 | 1 | −1 | 1 |
| second value | −1 | −1 | −1 | −1 |
| match | yes | no | yes | no |
| mismatch | no | yes | no | yes |
| 2-OFF | | | | |
| first value | −1 | −1 | 1 | 1 |
| second value | −1 | −1 | −1 | −1 |
| match | yes | yes | no | no |
| mismatch | no | no | yes | yes |
| no. of matches | 2 | 1 | 1 | 0 |
| no. of mismatches | 0 | 1 | 1 | 2 |
| difference | 2 | 0 | 0 | −2 |
| column voltage | $V_2$ | 0 | 0 | $-V_2$ |

Column Voltage Applied = $Y_c$

TABLE D

| | $t_a$ | $t_b$ | $t_c$ | $t_d$ |
|---|---|---|---|---|
| pixel | | | | |
| 1-ON | | | | |
| first value | −1 | 1 | −1 | 1 |
| second value | 1 | 1 | 1 | 1 |
| match | no | yes | no | yes |
| mismatch | yes | no | yes | no |
| 2-OFF | | | | |
| first value | −1 | −1 | 1 | 1 |
| second value | 1 | 1 | 1 | 1 |
| match | no | no | yes | yes |
| mismatch | yes | yes | no | no |
| no. of matches | 0 | 1 | 1 | 2 |
| no. of mismatches | 2 | 1 | 1 | 0 |
| difference | −2 | 0 | 0 | 2 |
| column voltage | $-V_2$ | 0 | 0 | $V_2$ |

Column Voltage Applied = $Y_d$

In the examples above, the first value is 1 when the row-select voltage has a positive polarity or the first value when the row-select voltage has a negative polarity. Additionally, the second value is −1 when the display state of the pixel is ON, or 1 when the display state is OFF. The column voltage waveforms were selected by means of the difference between the number of matches and the number of mismatches. As will be appreciated by one of ordinary skill in the art, the sign conventions may be inverted. Moreover, it also is possible to set the column voltage waveforms with only the number of matches or the number of mismatches, without having to calculate the difference between the number of matches and the number of mismatches as explained below.

FIGS. 25A–25E illustrate another example of the prior art in which a plurality of row electrodes are divided into groups of row electrodes. The groups of row electrodes are selected in sequence and the row electrodes within each group are simultaneously selected. In this example, each group comprises three row electrodes that are simultaneously selected in order to generate a display pattern, as shown in FIG. 26.

In other words, initially three row electrodes, $X_1$, $X_2$ and $X_3$, are selected and row selection voltages such as those shown in FIG. 25A are applied to these row electrodes, $X_1$, $X_2$ and $X_3$, respectively. At the same time, the designated column voltages, to be discussed later, are applied to each column electrode $Y_1$ to $Y_m$. Next, row electrodes $X_4$, $X_5$ and $X_6$, shown in FIG. 26, are selected and row selection voltages such as that in FIG. 25B are applied to these electrodes in the same manner as described above. At the same time, column voltages are applied to each column electrode, $Y_1$ to $Y_m$. As with the previous example, one frame period F is defined as the selection of all of the row electrodes, $X_1$ to $X_n$. One image is completely displayed in one frame period, and plural images can be display by repeating this cycle continuously.

When each row voltage waveform described above has h as the number of row electrodes that are simultaneously selected, as in previous example, the number of $2^h$ row-select pattern are used. In this example, the number of $2^3$ or 8 patterns are used.

Moreover, as in the previous example, the column voltages applied to each column electrode, $Y_1$ to $Y_m$, are the same as the number of row-select patterns. Also, the voltage level of each pulse is such that the voltage that corresponds to the numbers of the ON state and the OFF state of the selected row electrodes is applied. In other words, the column voltage level is determined by comparing the row-select pattern and display pattern. Thus, for example, when the row voltage waveforms applied to row electrodes $X_1$, $X_2$ and $X_3$, which are selected simultaneously in this example, have a positive pulse, they are ON, and when they have a negative pulse, they are OFF. The ON and the OFF of the display data are compared at each pulse and the column voltage waveforms are set according to the number of mismatches.

In other words, in the example of FIGS. 25A–25D, when the number of mismatches is zero, $-V_3$ volts are applied; when it is 1, $-V_2$ volts are applied; when it is 2, $V_2$ volts are applied; and when it is 3, $V_3$ volts are applied. The voltage ratios for $V_2$ and $V_3$ above are preferably such that $V_2:V_3=1:3$ In specific terms, in the case of the voltage waveforms applied to row electrodes $X_1$, $X_2$ and $X_3$ in FIG. 25A, those waveforms are ON when the $V_1$ volts are applied and OFF when the $-V_1$ volts are applied. Referring to FIG. 26, the pixel is indicated as ON when there is a closed circle and OFF when there is a open circle. As shown in FIG. 26, the display states of the pixels that cross with column electrode $Y_1$ and row electrodes $X_1$, $X_2$ and $X_3$ are ON, ON and OFF, respectively. In contrast to this, the initial pulse pattern of the voltage applied to each row electrode, $X_1$, $X_2$ and $X_3$, is OFF, OFF and OFF, respectively. Comparing both in sequence, the number of mismatches is 2. Therefore, $V_2$ volts are applied to the initial pulse pattern of the voltage applied to each row electrode $Y_1$, as shown in FIG. 25C. Using a similar analysis, the second pulse pattern of the voltage that is applied to each row electrode, $X_1$, $X_2$ and $X_3$, is OFF, OFF and ON, respectively. When compared in sequence the voltage pattern with the ON, ON and OFF sequence of the aforesaid pixel display pattern, all are mismatching. Since the number of mismatches is 3, voltage $V_3$ is applied to the second pulse of column electrode $Y_1$. As will be understood by one of ordinary skill in the art, by applying the above described analysis to the third and fourth time intervals, column voltages $-V_2$ and $-V_2$ are applied therein. Thus, a column voltage of $-V_3$, $V_2$, $-V_2$ and $-V_2$ is applied to provide the pixel states as shown in FIG. 26.

In the next time period, the next three row electrodes $X_4$ to $X_6$, are selected by applying selection voltages thereto, as shown in FIG. 25B. In accordance with the analysis described above, column voltages have the voltage levels that corresponds to the number of mismatches between the ON and OFF display states of the pixels formed at the intersection of the row electrodes $X_4$ to $X_6$ and the column electrode, and the ON and OFF states of pulse patterns of the synthesized voltages. FIG. 25D illustrates the resultant voltage waveforms that are applied to the pixels at the intersection of the row electrode $X_1$ and column electrode $Y_1$. That is, the synthesized waveform is resultant of the voltage waveform applied to row electrode $X_1$ and the voltage waveform applied to column electrode $Y_1$.

As indicated above, the method that simultaneously selects a plurality of row electrodes in a group and the selection of each group in sequence, has the advantage of the reducing the drive voltage level.

Referring now to FIGS. 27A–27C, the relationship between the transmissivity of a pixel of a liquid crystal display and the applied voltage is shown therein. In a liquid crystal display driven in a conventional manner, after the selection voltage has been applied to a particular pixel, during the period until the next selection voltage is applied to that pixel, the brightness gradually decreases during the time t. This reduces the transmissivity T in the ON condition and, on the other hand, slightly increase the transmissivity T in the OFF condition. As shown in FIG. 21, such conventional displays have poor contrast between the ON condition and the OFF condition.

The following is a general discussion regarding the conventional method for simultaneously selecting multiple row electrodes.

A. Requirements (1) The N number of row electrodes to be displayed are divided up into N/h non-intersecting subgroups.

(2) Each subgroup has h number of address lines.

(3) At a particular time, the display data on each column electrode is composed of an h-bit words, e.g.:

$$d_{k\cdot h+1}, d_{k\cdot h+2} \ldots d_{k\cdot h+h};\ d_{k\cdot h+j}=0 \text{ or } 1$$

Where $0 \leqq k \leqq (N/h)-1$ (k: subgroup)

In other words, one column of display data is:

$d_1, d_2 \ldots d_h \ldots$ Subgroup 0

$d_{h+1}, d_{h+2} \ldots d_{h+h} \ldots$ Subgroup 1

$d_{N-h+1}, d_{N-h+2} \ldots d_{N-h+h} \ldots$ Subgroup N/h−1

(4) The row-select pattern has $2^h$ cycle and is represented by an h-bit words, e.g.:

$$a_{k\cdot h+1}, a_{k\cdot h+2} \ldots a_{k\cdot h+h};\ a_{k\cdot h+j}=0 \text{ or } 1$$

B. Guidelines (1) One subgroup is selected simultaneously for addressing.

(2) One h-bit word is selected as the row-select pattern.

(3) The row-select voltages are:
$-V_r$ for a logic 0,
$+V_r$ for a logic 1,
0 volts or ground for the nonselected period.

(4) The row-select patterns and the display data patterns in the selected subgroup are compared bit by bit such as with digital comparators, viz. exclusive OR logic gates.

(5) The number of mismatches i between these two patterns is determined by counting the number of exclusive-OR logic gates having a logical 1 output.

Steps 1–4 are summarized by the following equation:

$$i = \sum_{j=1}^{h} a_{k*h+j} \oplus d_{k*h+j} \; (0 \le i \le h)$$

(where $\oplus$ is an exclusive OR logic operation)

(6) The column voltage is chosen to be V(i) when the number of mismatches is i.

(7) The column voltages for each column in the matrix is determined independently by repeating the steps (4)–(6).

(8) Both the row voltage and column voltage are applied simultaneously to the matrix display for a time duration Δt, where Δt is minimum pulse width.

(9) A new row-select pattern is chosen and the column voltages are determined using steps (4)–(6). The new row and column voltages are applied to the display for an equal duration of time at the end of Δt.

(10) A frame or cycle is completed when all of the subgroups (=N/h) are selected with all the $2^h$ row-select patterns once.

$$1 \text{ cycle} = \Delta t \cdot 2^h \cdot N/h$$

C. Analysis

The row select patterns in a case in which there are i number of mismatches will now be considered. The number of h-bit row-select patterns which differ from and h-bit display data pattern by i bits is given by $$hCi = h!/\{i!(h-i)!\} = Ci$$

For example, when the case for h=3 and row electrode selection pattern=(0,0,0) is considered, the results would be as shown in the table below:

| Mismatching number | :Display Data pattern | :Ci |
|---|---|---|
| i = 0 | :(0,0,0) | :1 way |
| i = 1 | :(0,0,1) (0,1,0) (1,0,0) | :3 ways |
| i = 2 | :(1,1,0) (1,0,1) (0,1,1) | :3 ways |
| i = 3 | :(1,1,1,) | :1 way |

These are determined by the number of bits of a word, not the row electrode selection patterns.

If the amplitude $V_{pixel}$ of the instantaneous voltage that is applied to the pixel had a row voltage of $V_{row}$ and column voltage of $V_{column}$, the synthesized voltage would be as follows:

$$V_{pixel} = (V_{column} - V_{row}) \text{ or } (V_{row} - V_{column})$$

Where, if $V_{row} = \pm V_r$ and $V_{column} = V(i)$, then $V_{pixel} = \pm V_r - V(i)$ or $-V_r - V(i)$.

If $V_{row} = \pm V_r$ and $V_{column} = \pm V(i)$, then $V_{pixel} = V_r - V(i), V_r + V(i)$, $-V_r - V(i)$ or $-V_r + V(i)$.

That is:

$$V_{pixel} = |V_r - V(i)| \text{ or } |V_r + V(i)|$$

As a consequence, the specific amplitude to be applied to the pixel is either $-(V_r + V(i))$ or $(V_r - V(i))$ in the selection row and is V(i) in the non-selection row.

In general, in order to achieve a high selection ratio, it is desirable that the voltage across a pixel should be as high as possible for an ON pixel and as low as possible for an OFF pixel.

As a result, when a pixel is in the ON state, the voltage $|V_r + V(i)|$ is favorable for the ON pixel, and the voltage $|V_r - V(i)|$ is unfavorable for the ON pixel. On the other hand, when a pixel is in the OFF state, the voltage $|V_r - V(i)|$ is favorable for the OFF pixel, and the voltage $|V_r + V(i)|$ is unfavorable for the OFF pixel.

Here, it is favorable for the ON pixel to increase the effective voltage and unfavorable for the ON pixel to decrease the effective voltage. The number of combinations that selects i units from among the h bits is:

$$Ci = hCi = \{h!\}/\{i!(h-i)!\}$$

The total number of mismatches provides the number of unfavorable voltages in the selected rows in a column. The total number of mismatches is i·Ci in Ci row select patterns considered are equally distributed over the h pixels in the selected rows. Hence the number of unfavorable voltages per pixel (Bi) when number of mismatches is i can be obtained as given following;

$$Bi = i \cdot Ci/h \text{(units/pixel)}$$

The number of times a pixel gets a favorable voltage during the Ci time intervals considered is:

$$Ai = \{(h-i)/h\}.Ci$$

In addition:

$$\{(h-i)/h\} \cdot Ci + (i/h) \cdot Ci = (h/h)Ci = Ci$$

Accordingly, the following is obtained:

$$Ai = Ci - Bi = \{(h-1)!\}/\{i! \cdot (h-i-1)!\}$$

Where: h≦i+1

To summarize the above:

$$V_{on}(\text{rms}) = \{(S1 + S2 + S3)/S4\}^{1/2}$$
$$V_{off}(\text{rms}) = \{(S5 + S6 + S3)/S4\}^{1/2}$$

$$S_1 = \sum_{i=0}^{h} Ai(V_r + V_{(i)})^2 \quad \text{(favorable)}$$

$$S_2 = \sum_{i=0}^{h} Bi(V_r + V_{(i)})^2 \quad \text{(unfavorable)}$$

$$S_3 = \{(N/h) - 1\} \sum_{i=0}^{h} (Ai + Bi)V_{(i)}^2$$

$$S_4 = 2^h \cdot (N/h)$$

$$S_5 = \sum_{i=0}^{h} Ai(V_r - V_{(i)})^2 \quad \text{(favorable)}$$

-continued $$S_6 = \sum_{i=0}^{h} Bi(V_r + V_{(i)})^2 \qquad \text{(unfavorable)}$$

In addition:

$V_r/V_o = N^{1/2}/h$ . . . row selection voltage $V_{(i)}/V_0 = (h-2i)/h = \{1-(2i/h)\}$ . . . column voltage, and $R = (V_{on}/V_{off})_{max} = \{(N^{1/2}+1)/(N^{1/2}-1)\}^{1/2}$ As noted above and as shown in FIGS. 27A–27C, however, a liquid crystal display driven according to such a method has poor contrast between its ON and OFF states.

Moreover, as shown in FIG. 25, in such conventional driving methods, the pulse width applied to the row electrodes and the column electrodes narrows as the number of simultaneously selected row electrodes increases, and this increases the amount of crosstalk due to the distortion of the waveforms. This results in, for example, poor image quality. This problem becomes even more serious, for example, in a case in which gray shade display, which is caused by the pulse width modulation (PWM), takes place.

OBJECTS OF THE INVENTION

Therefore, an object of the present invention is to provide a matrix display apparatus, a matrix display control apparatus, and a matrix display drive apparatus suited to a low power consumption, large capacity display by improving the display data transfer method.

It is an object of the present invention to provide an apparatus that obviates the aforementioned problems of the conventional liquid crystal devices.

It is a further object of the present invention to provide a liquid crystal display for displaying an image having high image quality.

It is another object of the present invention to provide a liquid crystal display with good contrast characteristics.

It is still another object of the present invention to provide a display with a reduced number of column voltage levels.

These and other objects, features and advantages of the present invention will become more apparent upon a consideration of the following detailed description of the preferred embodiments of the present invention in conjunction with the accompanying drawings.

Although the detailed description and annexed drawings describe a number of preferred embodiments of the present invention, it should be appreciated by those skilled in the art that many variations and modifications of the present invention fall within the spirit and scope of the present invention as defined by the appended claims.

SUMMARY OF THE INVENTION

The present invention provides a method combining a module controller-type display device with a signal electrode (X) driver having a built-in frame memory that intermittently operates the oscillation source of a high frequency clock for the module controller during display data transfer.

Specifically, a matrix display apparatus according to the invention comprises a matrix display device of display elements arranged in a matrix pattern, a first random access memory device for storing the display data, a second random access memory device for storing the display data of at least part of the display elements, and a signal electrode drive means for reading the display data from the second memory device to apply a drive voltage to the signal electrodes of the matrix display device. This matrix display apparatus is characterized by an intermittent high frequency oscillator that oscillates according to changes in the display data stored in the first RAM device, and a display data transfer means for reading the display data associated with the change from the first RAM device according to the high frequency clock output from the intermittent high frequency oscillator, and transferring the read display data together with the high frequency clock to the second RAM device.

The matrix display control apparatus for this display apparatus comprises a low frequency oscillator for constantly generating a low frequency clock, a timing signal generator for generating a specified timing signal based on the low frequency clock from the low frequency oscillator, a display data refresh detection means for generating an intermittent control signal based on changes in the display data stored in the first RAM device, an intermittent high frequency oscillator that oscillates according to the intermittent control signal, and a display data transfer means for reading the display data associated with the change from the first RAM device according to the high frequency clock output from the intermittent high frequency oscillator, and transferring the read display data together with the high frequency clock to the second RAM device.

A matrix display drive apparatus comprises a second random access memory device for storing the display data of at least part of the display elements, reads the display data from the second RAM device, and applies a drive voltage to the signal electrodes of the matrix display device. The apparatus used in a display apparatus using this matrix display control apparatus comprises a timing signal generator for generating a write control signal and a read control signal at an offset timing within one scanning period based on the cycle signal received each scanning period, and a read/write means executes a read operation according to the read control signal and then executes a write operation according to the write control signal with both operations addressing the same address in the second RAM device.

A matrix display drive apparatus of this type preferably comprises a clock detection means for detecting when the high frequency clock used for display data transfer stops, and a write prohibit control means for preventing generation of the write control signal based on this detection signal.

The read/write means of this matrix display drive apparatus comprises a temporary storage means for sequentially storing at least one scan line of the incoming display data using the high frequency clock, and a buffer for writing to the second RAM device the stored display data from the temporary storage means according to a signal longer than one cycle of the high frequency clock.

In a matrix display drive apparatus using a multiple line selection drive method, the read/write means comprises a signal voltage state assignment means for extracting the signal voltage to be applied to the signal electrode from the display data read from the second RAM device and the voltage state of the scanning electrode of the matrix display device.

This signal voltage state assignment means specifically comprises a means for reading plural scan lines of display data from the second RAM device on a time-share basis, a temporary storage means that alternately waits for the read display data, a scan state setting means for specifying the voltage state of the scan electrode of the matrix display device, an anti-coincidence detector for detecting anticoincidence between the plural scan line equivalent display data and the selected voltage state of the scan electrode, and a voltage selector for selecting the signal electrode voltage based on the anti-coincidence detection result.

In a differently configured matrix display drive apparatus using a multiple line selection drive method, the second RAM device comprises a memory array for storing plural scan lines of display data for one line address of the matrix display device, and the signal voltage state assignment means comprises a means for batch reading plural scan lines of display data, a scan state setting means for specifying the voltage state of the scan electrode of the matrix display device, and a voltage selector for selecting the drive voltage from the plural scan line display data read from the second RAM device and the selected voltage state of the scan electrode.

The present invention configured for a uniform distribution, multiple line selection drive method for a scan electrode drive apparatus using a multiple line selection drive method is characterized by a means for simultaneously selecting and cyclically scanning plural scan electrodes plural times within the period of the frame start signal.

A matrix display control apparatus thus comprised can reduce the total power consumption because of intermittent operation of the high frequency clock because the high frequency clock operates only when there is a change in the display data stored in the first RAM device, at which time the display data is transferred to the second RAM device. The processing load on the host MPU for the first RAM device can also be reduced because the transfer process to the second RAM device is executed not by the MPU but by an intermediary matrix display control apparatus. By cascade connecting the drive device of the signal electrodes, display data can be transferred according to the configuration of the matrix display device without being aware of the driver side memory configuration, and the address correlation process can be simplified. The display can also be refreshed faster because the display data for each scan line is stored in the second RAM device. By cascade connecting the signal electrode drive devices, the number of connections (e.g., the number of chip selection buses) between the matrix display control apparatus and drive devices can be minimized even in large capacity displays, and display devices with a large display area ratio can be achieved.

In addition, the second RAM device can be accessed with ease using time-share access timing during one scanning period. Greater tolerance is therefore achieved in the second RAM device access timing, improving data writing performance and making it possible to reduce the size of the transistors in the second RAM device. This also contributes to a reduction in driver chip size.

According to an additional aspect of the present invention, a multiplex driving method is provided for a liquid crystal display device having a liquid crystal layer disposed between a pair of substrates, a plurality of row electrodes arranged on one of the substrates and a plurality of column electrodes arranged on the other substrate. The method comprises the steps of sequentially selecting a group of the plurality of row electrodes in a selection period, simultaneously selecting the row electrodes comprising each group, and dividing and separating the selection period into a plurality of intervals within one frame period.

By adopting such a driving method, for example, after a selection voltage has been applied to a particular pixel in the initial frame, the voltage will be applied to that pixel several times during the period until the selection voltage is applied to that pixel in the next frame. This makes it possible to maintain brightness and prevent a reduction in contrast.

According to another aspect of the present invention, a first portion of a selection signal is sequentially applied to each of j groups of row electrodes in a first selection period of a frame, such that the first portion of the selection signal is simultaneously applied to i row electrodes in each of the j groups. A second portion of the selection signal is sequentially applied to the j groups of row electrodes in a second selection period of the frame, such that the second portion of the selection signal is simultaneously applied to the i row electrodes in each of the j groups.

According to a further aspect of the present invention, a display apparatus is provided comprising a display having a plurality of row electrodes and column electrodes, the row electrodes being arranged in groups. A drive circuit comprises a row electrode data generating circuit for generating row selection pulse data and a frame memory for providing display data. An arithmetic operation circuit calculates converted data in accordance with the row selection pulse data generated by the drive circuit and the display data provided by the frame memory. A column electrode driver is responsive to the converted data calculated by the arithmetic operation circuit for generating column data for the plurality of column electrodes. A row electrode driver is responsive to the row selection pulse data generated by said drive circuit for selecting in sequence each of the groups of row electrodes. The row electrodes comprising each of the groups are selected simultaneously, and scanning of one screen is performed a plurality of times in accordance with the row selection pulse data and the display data during one frame period. By having a drive circuit such as that described above, it is possible to execute the drive method described above easily and reliably.

In accordance with such a display device, the display device has a driving circuit which performs the steps of calculating the row-select pattern generated by the row electrode data generation circuit and the display data pattern on the plurality of row electrodes which are read in sequence from the frame memory. The row electrodes are then selected simultaneously with the row-select pattern. The driving circuit transfers the converted data, which is the result of the calculation, to the column electrode driver, and transfers the row data, which is generated by the row electrode data generation circuit, to the row electrode driver. Further, the driving circuit repeats the above-mentioned operation by the next row-select pattern data and display data pattern when scanning of one image is finished. The screen operation is repeated several times in one frame period. Thus, the display device according to the present invention has excellent contrast characteristics.

According to still yet a further aspect of the present invention, a method is provided for determining a number of voltage levels applied to each of m column electrodes in a liquid crystal display having a pair of opposing substrates, n row electrodes disposed on one of the substrates and the m column electrodes disposed on the other of the substrates, and a liquid crystal material disposed between the pair of substrates, n×m pixels being formed at the intersection of the n row electrodes and the m column electrodes. The n row electrodes are divided into j groups, each group having at least i row electrodes, i, j, n and m being positive integers greater than 1, i being less than n and j being less than n. A selection signal is applied sequentially to each of the j groups of row electrodes and simultaneously applied to each of the i row electrodes in a plurality of time periods for displaying an image in a frame period. The method comprising the step of, for each of the time periods, determining a first number of mismatches between the selection signal applied to the i row electrodes and display states of the pixels formed at the intersections of the i row electrodes and one of the m columns electrodes. A virtual selection signal is applied to a virtual row electrode and a second number of mismatches between the virtual selection signal applied to the virtual electrode and a display state of a virtual pixel formed at the intersection of the one column electrode and the virtual row electrode is determined. A third number of mismatches is defined by the sum of the first and second number of mismatches, and the virtual selection signal has a waveform and the virtual pixel has a display state such that the third number of mismatches is either an odd number or an even number. A number of matches between the selection signal applied to the i row electrodes and the display states of the pixels at the intersections of the i row electrodes and the one column electrode and between the virtual selection signal applied to the virtual row electrode and the display state of the virtual pixel formed at the intersection of the virtual electrode and the one column electrode is determined. The voltage level for each time period is a level corresponding to the difference between the third number of mismatches and the number of matches. The above-discussed process is repeated for each of the time periods.

BRIEF DESCRIPTION OF THE DRAWINGS

In the drawings, wherein like reference characters denote similar elements throughout the several views.

FIG. 6 is a block diagram of the column electrode driver of the column driving circuit of FIG. 4.

FIG. 9 illustrates the display patterns in accordance with the present invention.

FIGS. 10A–10B show the applied row selection and column electrode voltage waveforms which correspond to the display patterns of FIG. 9.

FIG. 12 illustrates the display patterns in accordance with the present invention.

FIG. 13A illustrates the applied row selection voltage waveforms that are applied to the row electrodes according to the embodiment of FIGS. 11A–11D.

FIG. 13B shows the applied column voltage waveforms that are applied to the column electrodes that correspond to the display patterns of FIG. 12.

FIGS. 16A–16D show another example of the applied voltage waveforms in accordance with the present invention.

FIG. 20 illustrates the display pattern of a liquid crystal display having virtual electrodes in accordance with the seventh embodiment.

FIGS. 21A–21E show the applied voltage waveforms of a conventional driving method of a liquid crystal display.

FIGS. 25A–25D show the applied voltage waveforms another conventional driving method of a liquid crystal display.

FIGS. 33A–33D are waveform diagrams of the scan electrode wave and signal electrode wave in a multiplex drive method using voltage averaging.

FIGS. 35A–35D are a waveform diagrams of the scan electrode wave and signal electrode wave in a uniform distribution, 3-line selection drive method.

FIG. 36 is a waveform diagram of the on/off characteristics of the liquid crystal pixels in the uniform distribution, 3-line selection drive method shown in FIG. 35.

DESCRIPTION OF THE PREFERRED EMBODIMENTS

Figure 4:
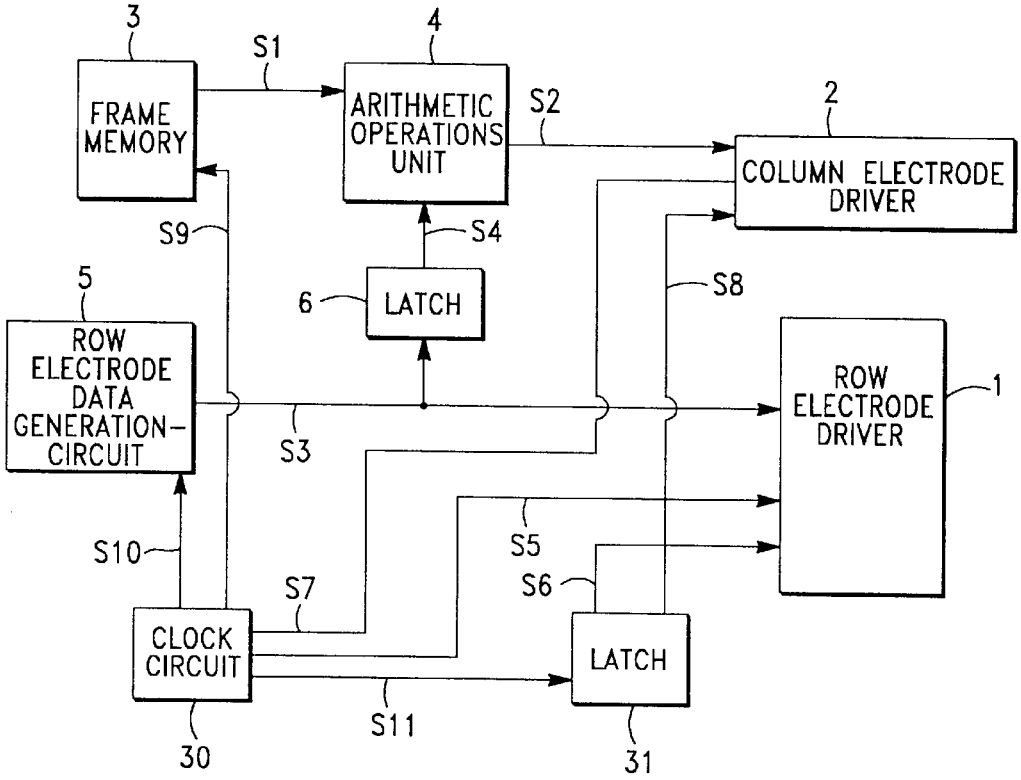
FIG. 4 is a block diagram of a driving circuit in accordance with the first embodiment of the present invention.
Figure 5:
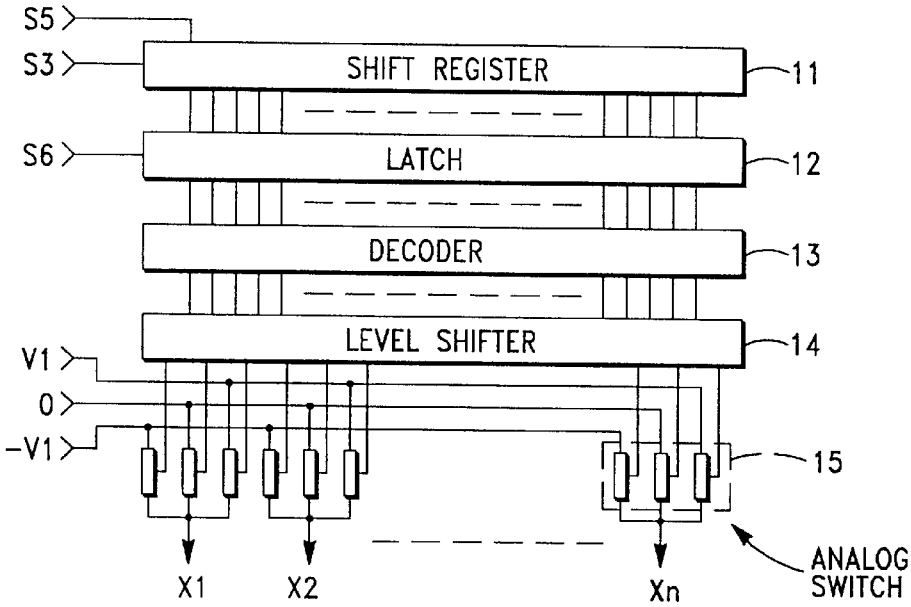
FIG. 5 is a block diagram of the row electrode driver of the row driving circuit of FIG. 4.
Figure 22:
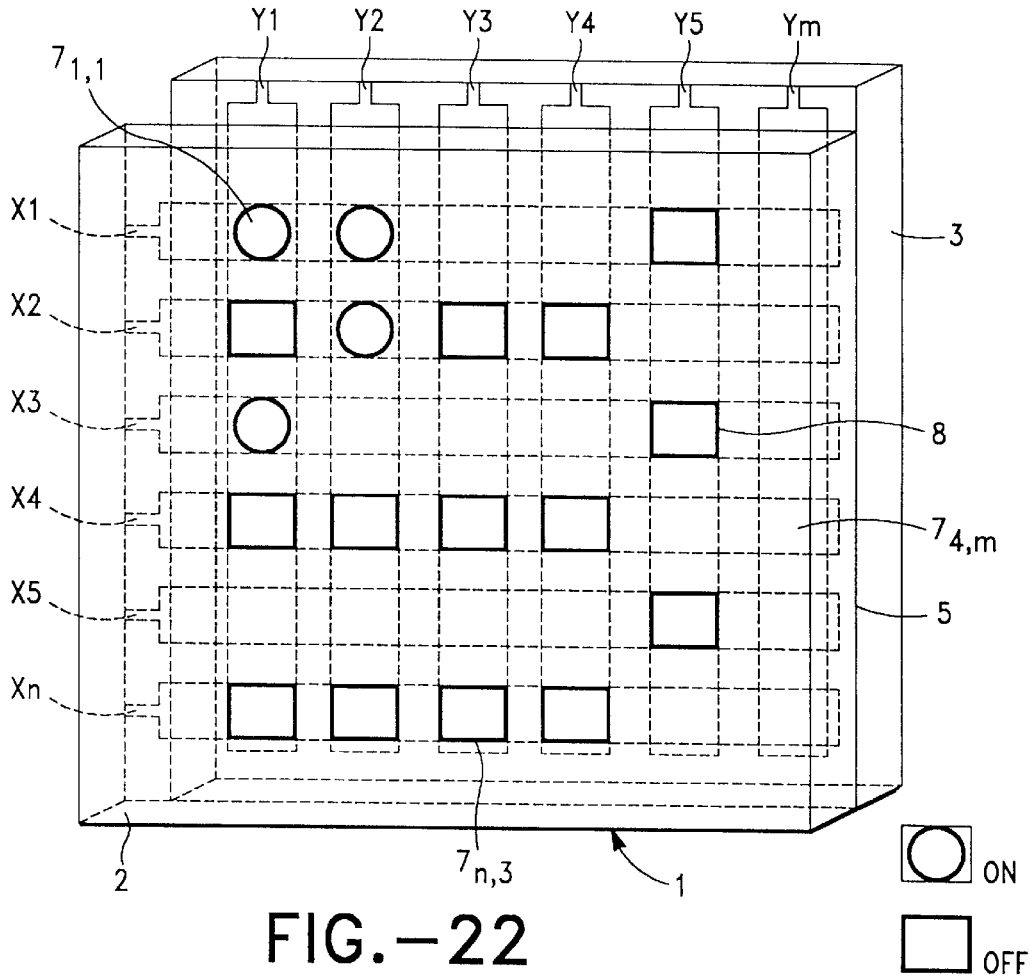
FIG. 22 illustrates a liquid crystal display panel.
Figure 26:
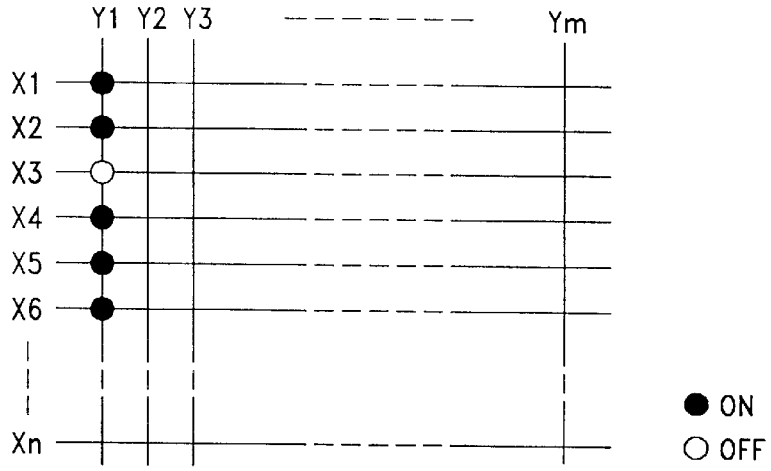
FIG. 26 illustrates an example of a display pattern.

Referring to FIGS. 4–6, a preferred example of a liquid crystal panel driving circuit according to the present invention is illustrated. More specifically, FIG. 4 illustrates a preferred drive circuit, FIG. 5 illustrates a preferred row electrode driver circuit and FIG. 6 illustrates a preferred column electrode driver circuit. Of course, while the circuits of FIGS. 4–6 are preferred, persons of ordinary skill in the art who have read this description will recognize that various modifications and changes may be made therein. The driving circuit is for driving a liquid crystal display panel 1, as shown in FIG. 22. In the preferred embodiment, the liquid crystal display panel comprises m column electrodes, $Y_1$–$Y_m$, and n row electrodes, $X_1$–$X_m$. The intersections of the m column electrodes and n row electrodes form n×m pixels. In the preferred embodiment the n row electrodes are arranged in j groups of row electrodes, and each of the j groups of row electrodes comprise i row electrodes. In accordance with the invention, each of the j groups of row electrodes are selected sequentially, and each of the i row electrodes within each group are simultaneously selected. A detailed explanation of the driving method is presented hereinbelow.

Turning to FIG. 4, reference numeral 1 denotes the row electrode driver and reference numeral number 2 represents the column electrode driver. Details of the row and column electrode driver circuits will be explained hereinbelow and are shown in FIGS. 5 and 6, respectively. Reference numeral 3 represents the frame memory, reference numeral 4 represents an arithmetic operations circuit; reference numeral 5 represents a row electrode data generation circuit; reference numeral 30 represents a clock circuit; reference numeral 6 represents a first latch and reference numeral 31 represents a second latch circuit.

FIG. 5 illustrates a block diagram of the row electrode driver 1. In this drawing, reference numeral 11 is a first shift register; reference numeral 12 is a third latch circuit; reference numeral 13 is a first decoder circuit; reference numeral 14 is a first level shifter; and reference numeral 15 are first analog switches.

FIG. 6 is a block diagram of the column electrode driver 2. In this drawing, reference numeral 21 is a second shift register; reference numeral 22 is a fourth latch circuit; reference 23 is a second decoder; reference numeral 24 is a second level shifter; and reference numeral 25 are second analog switches.

The operation of the liquid crystal display panel will now be described with respect to FIGS. 4–6. Initially, a clock circuit 30 provides appropriate timing signals to row electrode generator 5, signal S10, to row driver 1, signal S5, to column driver 2, signal S7, and to second latch circuit 31, signal S11.

Row electrode generator 5 generates a row-select pattern S3 for sequentially selecting a group of row electrodes and for simultaneously selecting the row electrodes within each group to row driver 1. As shown in FIG. 5, the row select pattern is transferred to the first shift register 11 in accordance with clock signal S3. After the data for each row electrode in one scanning period has been transferred to the first shift register 11, each data is latched in the third latch circuit 12 by latch signal S6 from the second latch circuit 31. The data is then decoded by decoder 13 and the appropriate voltage level is selected by the first level shifter 14 and the first analog switches 15. The voltages selected are from among $-V_1$, 0 and $V_1$. More specifically, when a positive level has been selected, $V_1$ volts is supplied to the selected row electrodes and when a negative level has been selected, $-V_1$ volts is supplied to the selected row electrodes. During the nonselected period, a voltage of zero is supplied to row electrodes. The selected voltages are applied to the row electrodes in accordance with the methods described below.

Image data generated by, for example, a CPU (not shown) is stored in frame memory 3. A display data signal S1, which corresponds to each of the row electrodes selected simultaneously, is read from memory 3 for providing each column voltage waveform. As shown in FIG. 4, the row-select pattern signal S3 is latched by the first latch circuit 6. The display data signal S1 and the latched row-select pattern data signal S4 are converted by arithmetic operations circuit 4. Data conversion by arithmetic operations circuit 4 is performed in accordance with, for example, embodiments one to seven described hereinbelow. The converted data S2 is then transferred to column electrode driver 2.

Figure 4A:
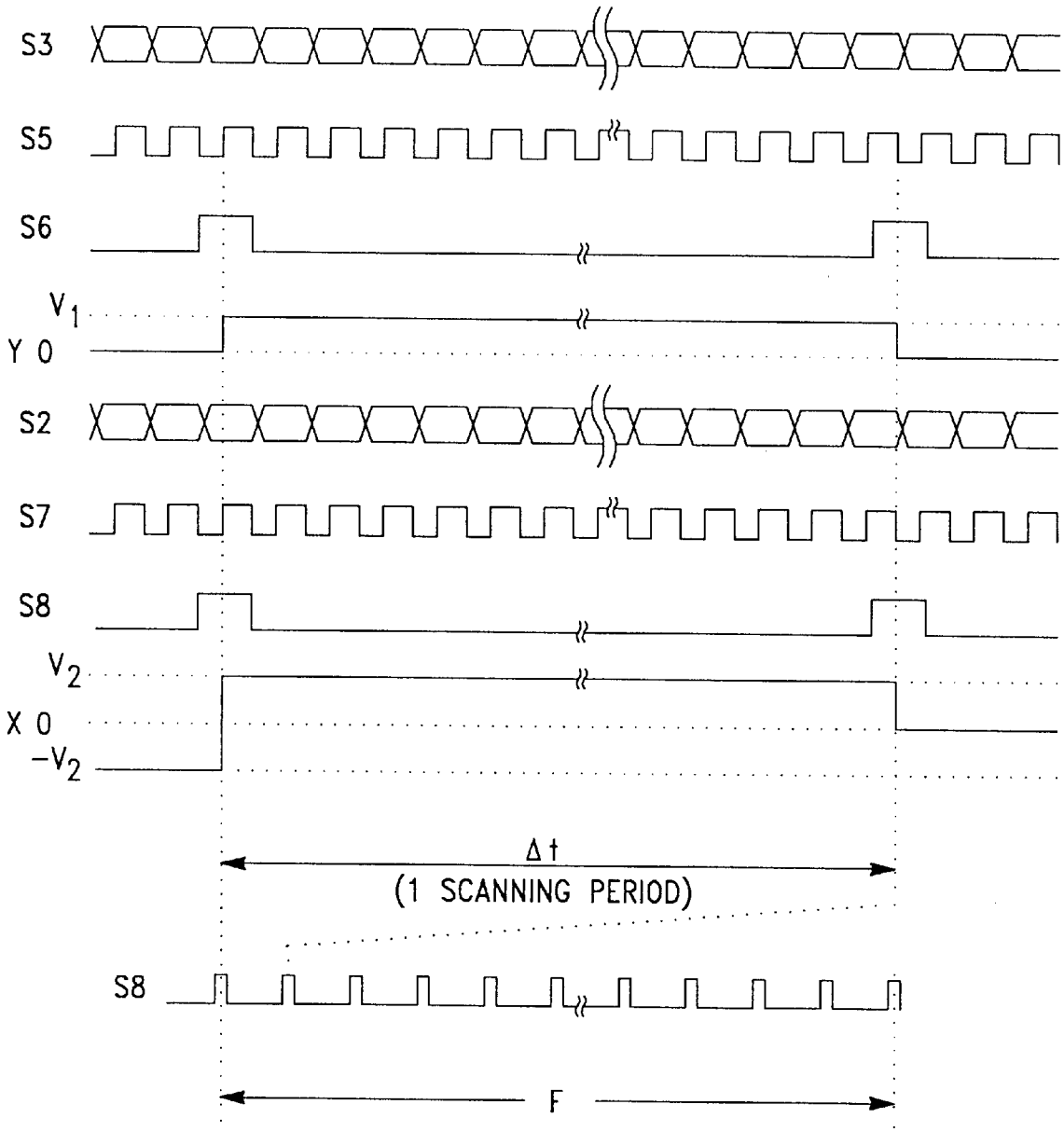
FIG. 4A is a timing diagram of the driving circuit of FIG. 4.
Figures 7A, 7B, 7C, 7D:
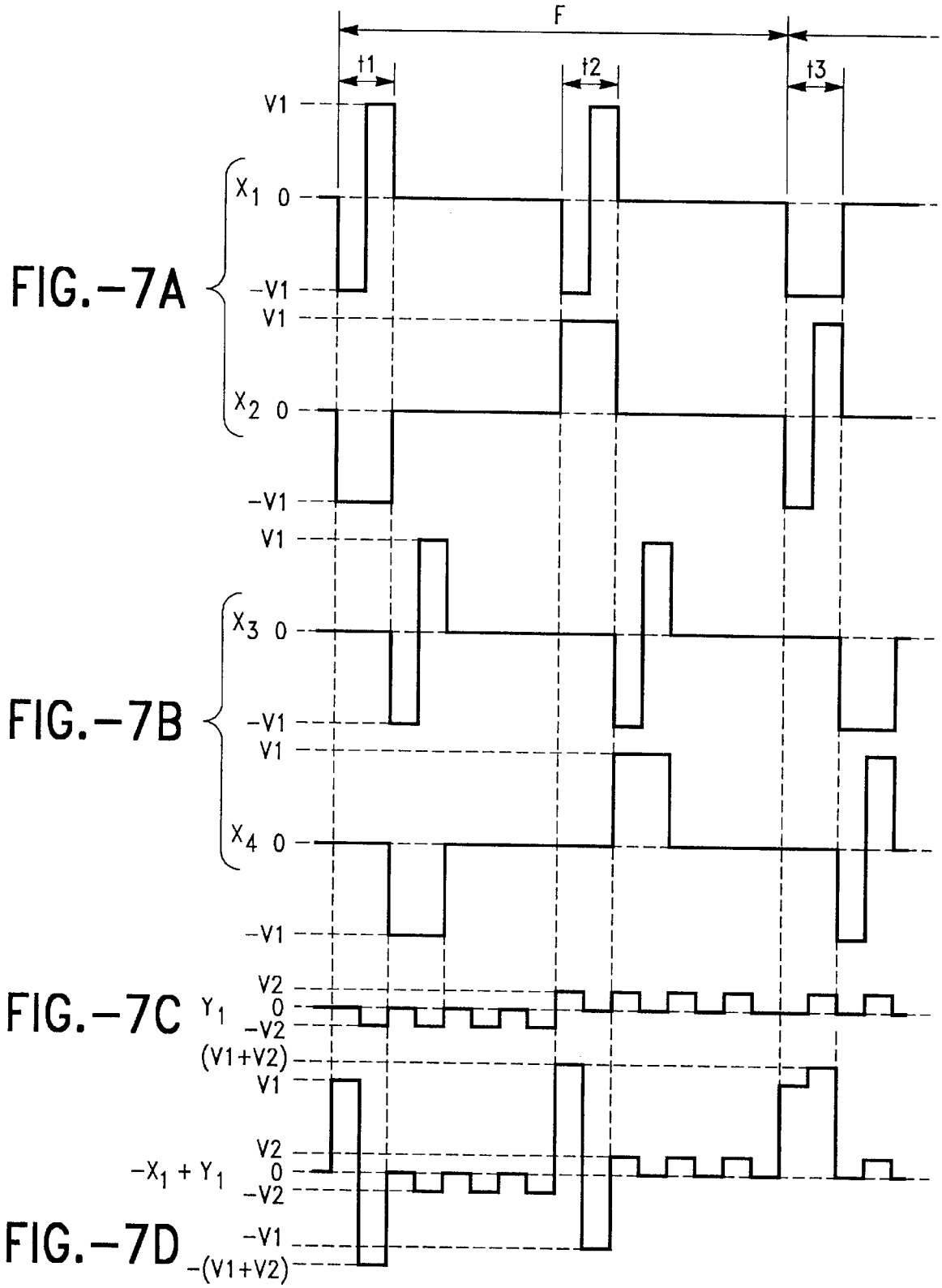
FIGS. 7A–7D show the applied voltage waveforms of a second embodiment of a driving method of the liquid crystal display according to the present invention.

As shown in FIG. 6, data signal S2 from arithmetic operations circuit 4 is transferred to the second shift register 21 in accordance with shift clock signal S7. After each row electrode data during one scanning period has been transferred, each data will be latched by fourth latch circuit 22 in accordance with latch signal S8. The data is then decoded by the second decoder circuit 23. An appropriate voltage level is selected by the second level shifter 24 and second analog switches 25. In other words one of three voltage levels is selected by analog switches 25, e.g. $V_2$ volts, $-V_2$ volts or zero volts. A timing diagram of the aforementioned signals is shown in FIG. 4A.

First Embodiment

A driving method for a liquid crystal display in accordance with a first embodiment of the present invention will now be described. As will be apparent to one of ordinary skill in the art, the driving method may be implemented in a driving circuit as discussed above.

Figures 1A, 1B, 1C, 1D:
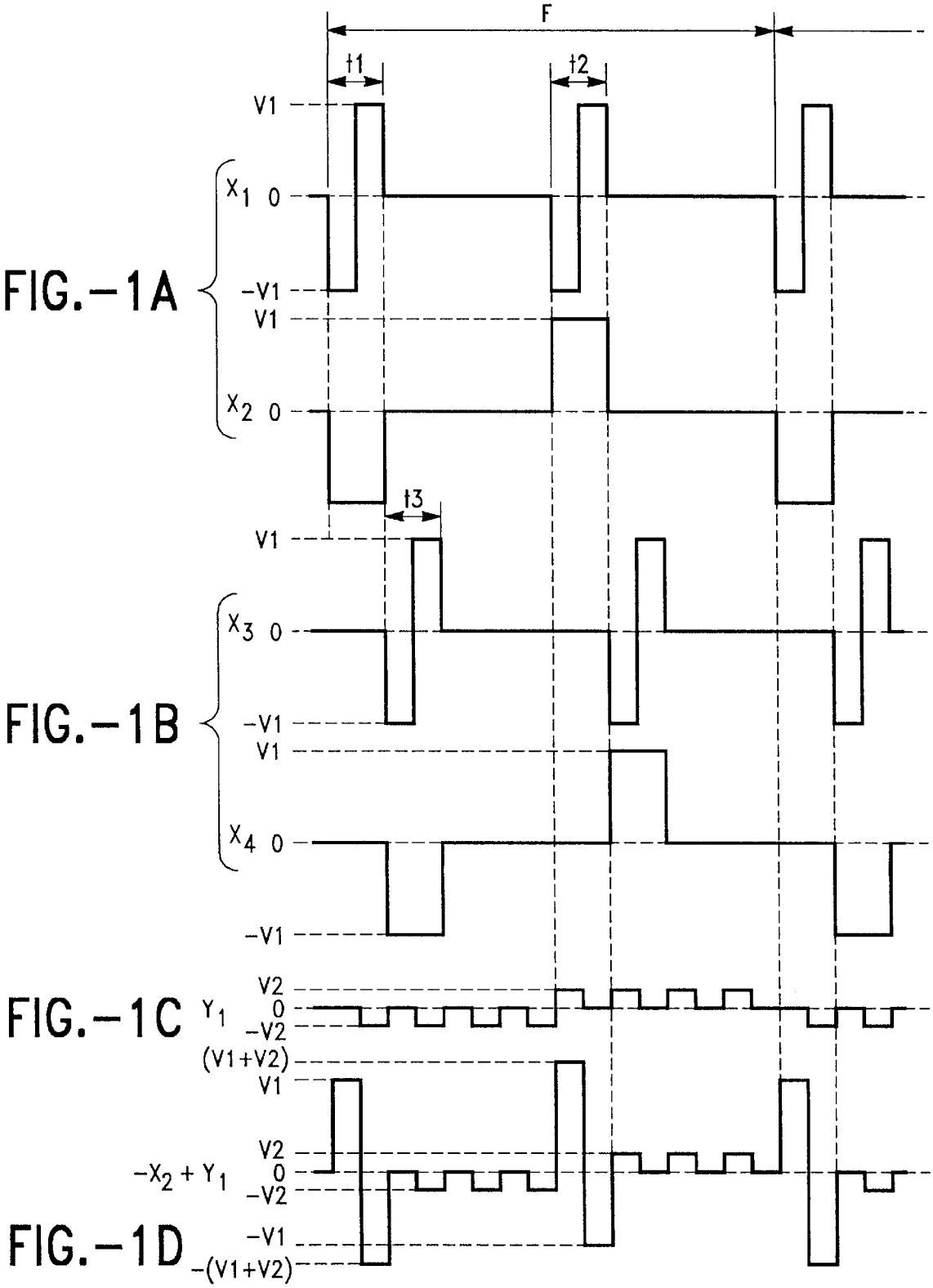
FIGS. 1A–1D show the applied voltage waveforms in accordance with the first embodiment of a driving method of the liquid crystal display according to the present invention.

Referring to FIGS. 1A–1D, waveforms for driving a liquid crystal display panel are shown therein. Specifically, FIG. 1A illustrates row selection voltage waveforms applied to row electrodes $X_1$ and $X_2$, FIG. 1B illustrates row selection voltage waveforms applied to row electrodes $X_3$ and $X_4$, FIG. 1C illustrates voltage waveforms applied to column electrode $Y_1$, and FIG. 1D shows the synthesized voltage waveforms applied to a pixel formed at an intersection of row electrode $X_1$ and column electrode $Y_1$.

Figure 2:
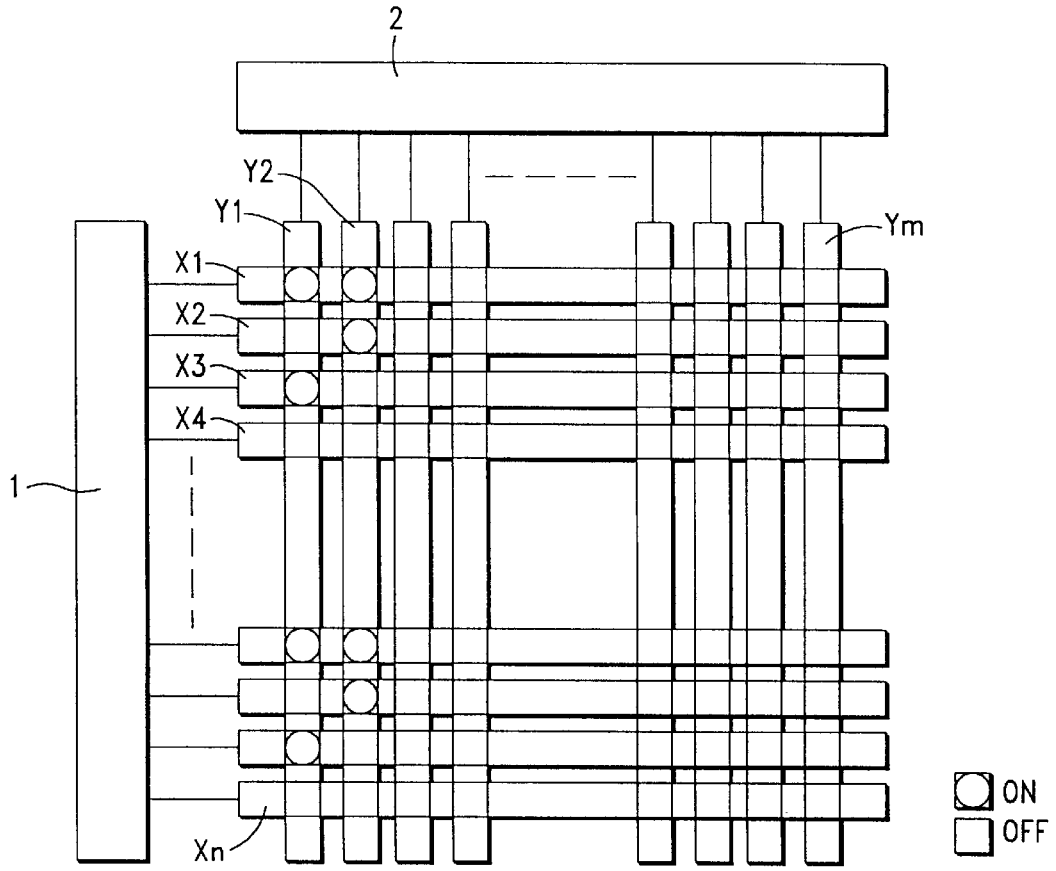
FIG. 2 shows a top view of a general configuration of the liquid crystal display.

FIG. 2 shows a top view of a general configuration of the liquid crystal display panel having a liquid crystal material arranged between a pair of substrates. As shown in that figure, pixels or picture elements are formed at the intersections of the column and row electrodes. In FIG. 2 those pixels having a circle are in the ON state and the other pixels are in the OFF state.

In accordance with the first embodiment, the row selection period comprises two intervals or portions. That is, the row electrodes are selected twice within one selection period or one frame period F. It is during the one frame period F that a complete image is displayed.

Figures 23A, 23B, 23C, 23D:
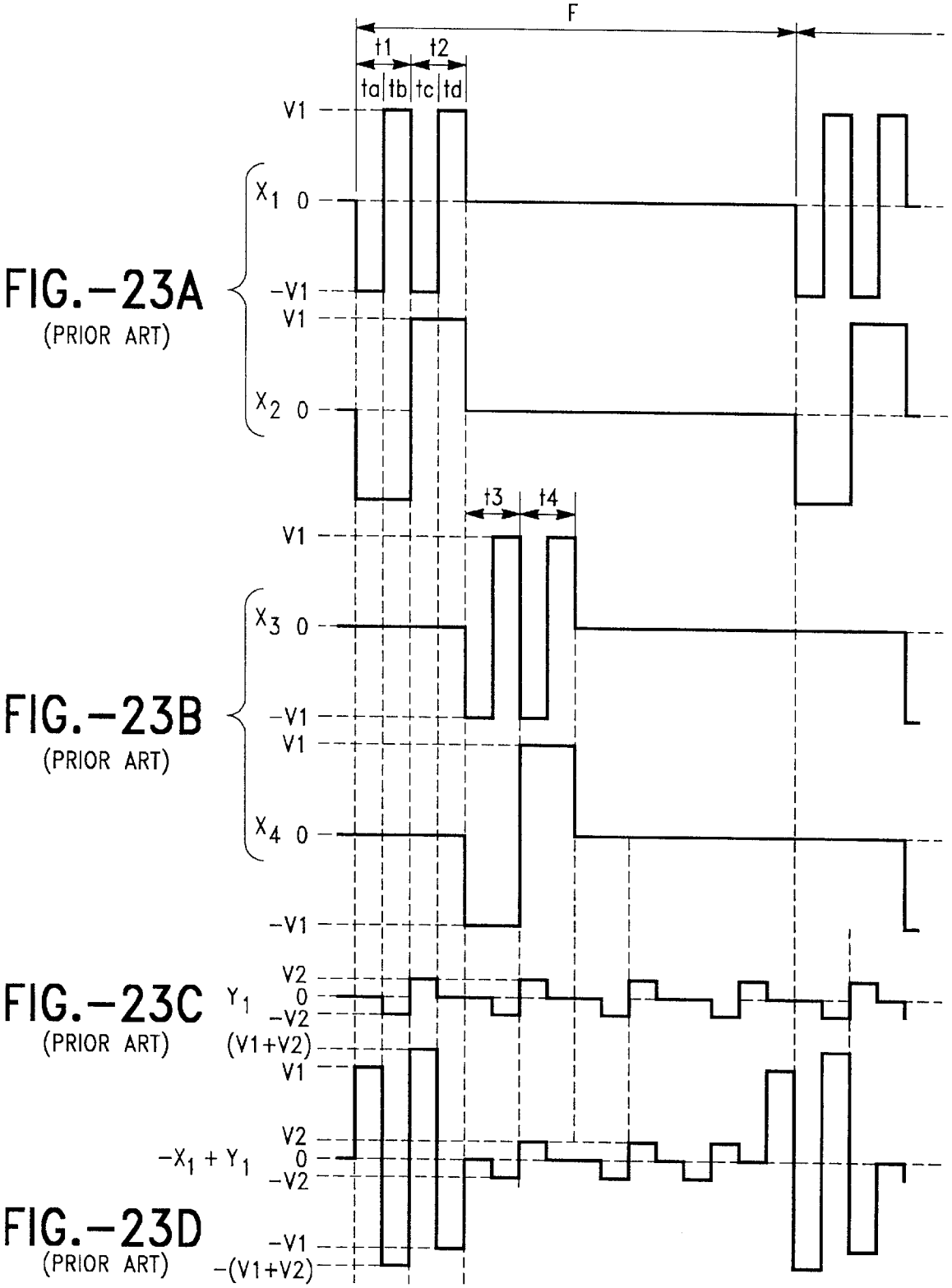
FIG.-23A (PRIOR ART)
FIG.-23B (PRIOR ART)
FIG.-23C (PRIOR ART)
FIG.-23D (PRIOR ART)
FIGS. 23A–23D show the applied voltage waveforms of a conventional driving method of a liquid crystal display.
Figure 24A:
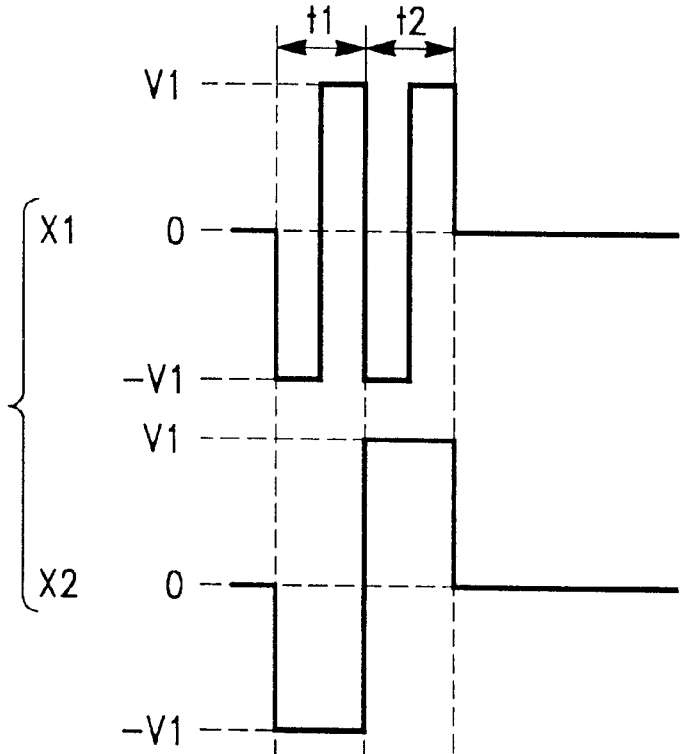
FIG.-24A (PRIOR ART)
FIGS. 24A–24B illustrate the row selection and column voltage waveforms that are applied to the row and column electrodes in accordance with the conventional driving method of FIGS. 23C–23D.
Figure 24B:
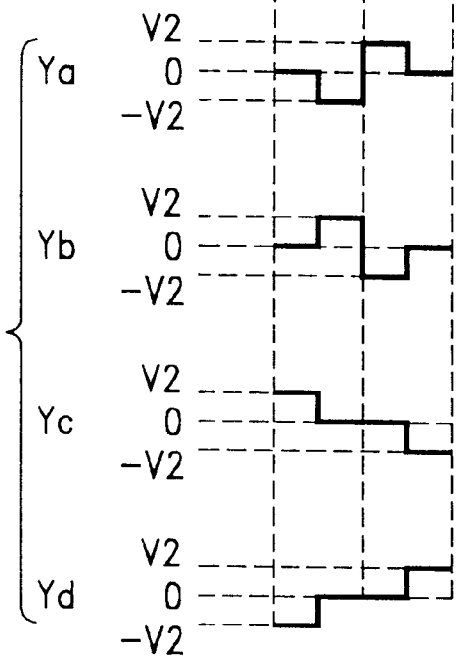
FIG.-24B (PRIOR ART)
Figure 28A:
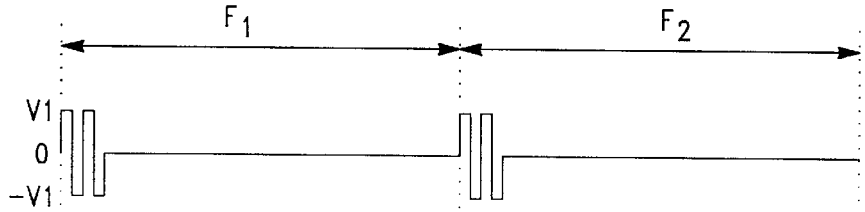
FIGS. 28A–28D are graphs comparing the transmissitivity of a liquid crystal panel driven in accordance with the present invention and driven in accordance with a conventional method.
Figure 28B:
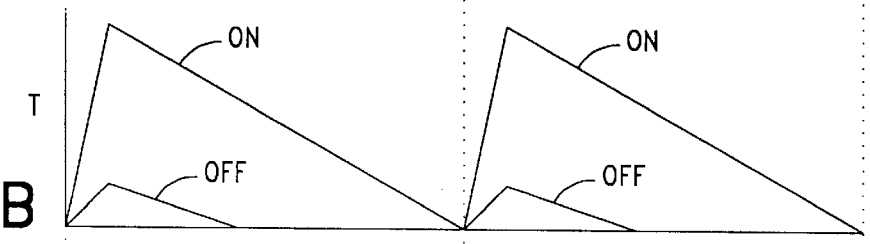
Figure 28C:
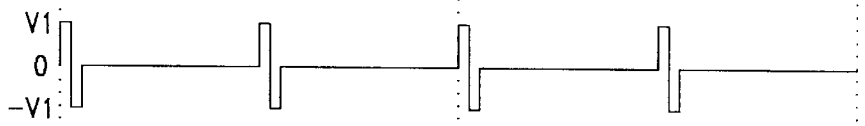
Figure 28D:
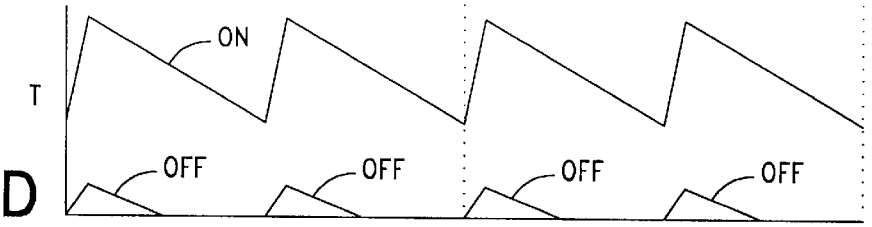

Referring to FIGS. 1A–1D, generally speaking the embodiment of FIGS. 1A–1D separates the row selection voltage waveforms of FIGS. 23A–23C, for example, into two portions. In the embodiment of FIGS. 1A–1D, the first portion is applied sequentially to each group of the row electrodes and then the second portion is applied sequentially to each group of the row electrodes during one frame period. This is in contrast to the conventional method, such as FIGS. 23A–23E, in which entire row selection signal is applied sequentially to each group of electrodes during one frame period.

More specifically, the first group of row electrode comprising row electrodes $X_1$ and $X_2$ are simultaneously selected in period $t_1$. Row selection voltage waveforms in that time interval similar to those in the conventional method illustrated in FIG. 23A applied in time interval $t_1$. At the same time, a column voltage waveform selected in accordance with the method described above is applied to each column electrode, $Y_1$ to $Y_m$. In the present embodiment, row electrodes $X_3$ and $X_4$ are then selected with the row selection voltage waveforms shown in FIG. 1B. At the same time column voltage is applied in the same manner to each column electrode, $Y_1$ to $Y_m$. This process is repeated until all of the row electrodes have been selected. This is in contrast to the conventional method of FIGS. 23A–23E in which voltage waveforms are still applied to row electrodes $X_1$ and $X_2$ during the same interval.

As shown in FIG. 1A, row electrodes $X_1$ and $X_2$ are selected once again in the time duration $t_2$. At the same time, column voltages are applied to each column electrode, $Y_1$ to $Y_m$. The remaining groups of row electrodes are selected with the second portion of the row selection voltage waveforms. All of the row electrodes are selected twice in one frame period F. That is, an image or one screen is displayed when each row electrode is selected twice. Subsequent images are displayed by repeating the aforementioned driving method in subsequent frame periods.

Figure 3:
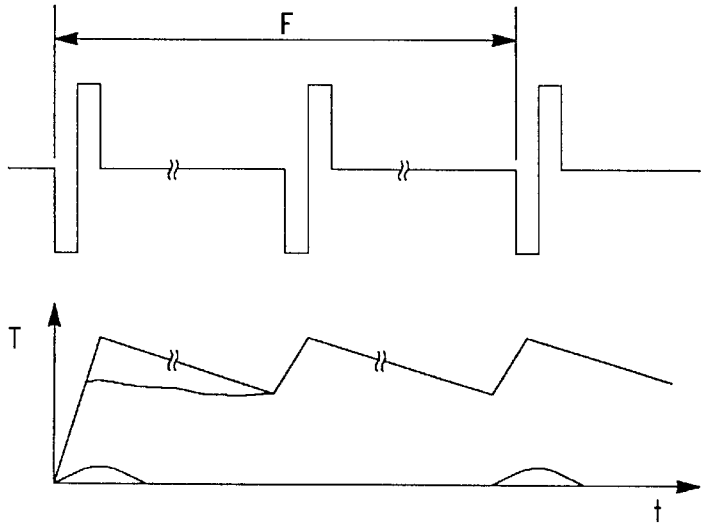
FIG. 3 is a graph illustrating the relationship between the applied voltage of a pixel and the transmissitivity thereof according to the first embodiment of FIGS. 1A–1D.

By driving the liquid crystal display panel in this manner, the optical response shown in FIG. 3 is obtained. Referring to FIGS. 28A–28D, the optical response of the first embodiment is compared with the optical response of the conventional driving method. It is readily apparent from FIGS. 28A–28D, that the optical response of the present invention has a brighter ON state and a darker OFF state than the conventional driving method. Therefore, a liquid crystal display panel driven in accordance with present invention has improved contrast and a reduction of flicker.

As will be appreciated by one of ordinary skill in the art, the row selection period may divided into more than two intervals in one frame period F. In addition, while in the embodiment described above, each group of row electrodes contained two row electrodes, it is contemplated that each group may contain more than two row electrodes. Moreover it is also contemplated that each of the groups of row electrodes may be selected in any arbitrary order.

Second Embodiment

FIGS. 7A–7D show a second embodiment of the present invention. In this embodiment, the row selection voltage waveforms applied in the first frame are substantially similar to those of the first embodiment. However, in the second frame, the row selection voltage waveforms applied to the first row electrode in each group in the first frame period is now applied to the second row electrode in each group in the second frame period. Similarly, the row selection voltage waveforms applied to the second row electrode in each group in the first frame is now applied to the first row electrode in each group. In other words, the row selection waveform is alternately applied to each row electrode of each group in alternate frame periods. As noted above, it is contemplated that each group of row electrodes may contain more than two electrodes.

As described above, if for each frame F, if such waveforms are applied, it is possible to prevent pictures on the display from generating non-uniformity caused by differences in the applied voltage waveforms as in conventional methods.

In addition, because in this embodiment the selection period is divided in two intervals within one frame F, just as with the aforesaid first embodiment, the contrast is improved and flickering is also reduced.

Further, in this embodiment, it is also possible to use a drive circuit that is the same as the drive circuit that is explained in the aforesaid embodiment, and to provide with display device having a high display quality as well. In the aforesaid embodiment, the row selection voltage waveforms were replaced after each frame. However, they also can be replaced after a plurality of frames.

The description of the aforesaid first embodiment and second embodiment provided an example in which two row electrodes were selected simultaneously. However, as in the embodiments to be described below, it also is possible to drive by selecting three or more row electrodes simultaneously. In such a case, as in the second embodiment, it is possible to replace in sequence at each one frame or at a plurality of frames the row selection voltage waveforms that are applied to the row electrodes that are selected simultaneously. For example, if each group contained three row electrodes, the row selection waveforms would be selectively applied to the three row electrodes in three frame periods.

Third Embodiment

FIGS. 8A–8D illustrate a third embodiment of the present invention. As shown therein, the row selection voltage waveforms applied in the first frame are substantially similar to those of the first embodiment. However, in the second frame, the row selection voltage waveforms are inversions of the row selection voltage waveforms applied in the first frame. That is, the row selection voltage waveforms in the second frame period have the opposite polarities to those of the first frame period. In the preferred embodiment, the polarity of the waveforms are inverted for each frame period.

Figures 8A, 8B, 8C, 8D:
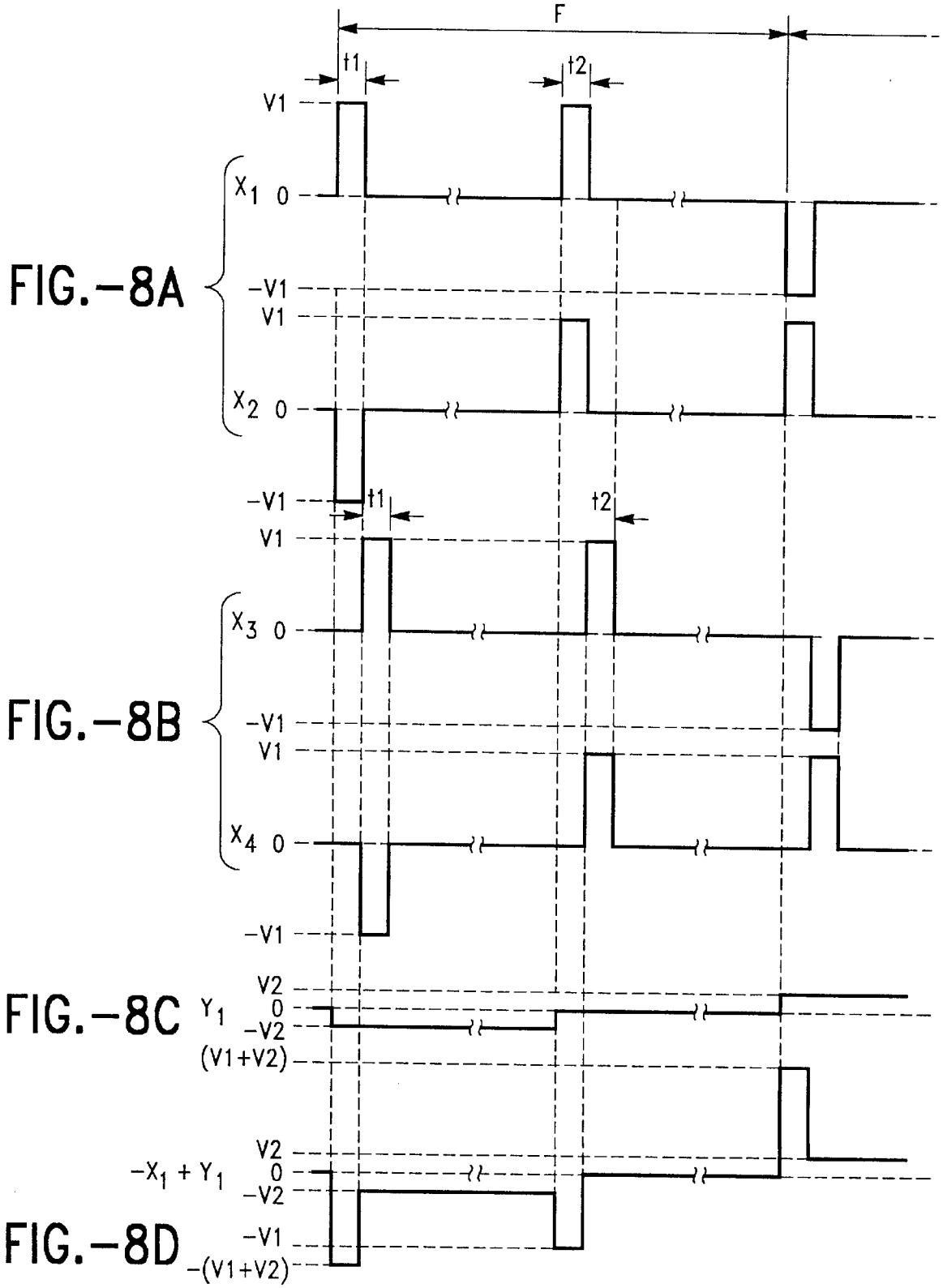
FIGS. 8A–8D show the applied voltage waveforms of a third embodiment of a driving method of the liquid crystal display according to the present invention.

More specifically FIG. 8A depicts the row selection voltage waveforms applied to row electrodes $X_1$ and $X_2$, FIG. 8B depicts the row selection voltage waveforms applied to row electrodes $X_3$ and $X_4$, FIG. 8C illustrates the voltage waveforms applied to column electrode $Y_1$, and FIG. 8D illustrates the synthesized voltage waveforms applied to the pixels that are formed at the intersection of row electrode $X_1$ and column electrode $Y_1$.

Similar to the aforesaid first embodiment, two row electrodes are selected simultaneously. The row voltage with the voltage waveforms shown in FIG. 8A are applied to the row electrodes $X_1$ and $X_2$ for simultaneously selection. A display such as that shown in FIG. 2 is provided by dividing the selection period in two intervals or portions within one frame period.

The sequence of the row electrode selection is the same as that in the aforesaid first embodiment. First, row electrodes $X_1$ and $X_2$ are selected and the row selection voltage waveform is applied to these electrodes for a time duration $t_1$. At the same time, the designated column voltage, which corresponds to the display data, is applied to all of the column electrodes $Y_1$ to $Y_m$. Next, row electrodes $X_3$ and $X_4$ are selected and the same row voltage waveforms as the aforesaid row electrodes $X_1$ and $X_2$ are applied there for the time duration $t_{11}$. At the same time, the designated column voltage, which corresponds to the display data pattern, is applied to all of the column electrodes $Y_1$ to $Y_m$. This is repeated until all of the row electrodes $X_1$ to $X_n$ have been selected.

Next, row electrodes $X_1$ and $X_2$ are selected once again and row selection voltage is applied to them for the time duration $t_2$. At the same time, the designated column voltage, which corresponds to the display data, is applied to all of the column electrodes $Y_1$ to $Y_m$. Next, row electrodes $X_3$ and $X_4$ are selected and the same row voltage waveforms as the aforesaid row electrodes, $X_1$ and $X_2$, are applied thereto for the time duration $t_{12}$. At the same time, the designated column voltage, which corresponds to the display data, is applied to all of the column electrodes $Y_1$ to $Y_m$. This sequence is repeated until all of the row electrodes $X_1$ to $X_n$ have been selected.

In this embodiment, the polarity of the row selection voltage waveforms applied to each row electrode is inverted or reversed at each frame. This is referred to as an alternating current drive scheme. In such a case, it is possible to reverse the positive and negative polarities at alternate frames. In addition, it also is possible to apply the alternating current drive method mentioned above to the previously described embodiments and to the embodiments to be described below.

As should now be apparent, the column voltages are selected in accordance with the method as described above.

FIG. 9 illustrates four types of display patterns of the pixels on, for example, row electrodes $X_1$ and $X_2$. As noted above, row electrodes $X_1$ and $X_2$ are selected simultaneously. As shown in FIG. 9, those pixels having solid circles are in the ON state and those pixels having open circles are in the OFF state. The display pattern on line a indicates that the pixels on row electrodes $X_1$ and $X_2$ are both in the OFF state, the display pattern on line b indicates that the pixel on row electrode $X_1$ is in the OFF state and that the pixel on row electrode $X_2$ is in the ON state, the display pattern on line c indicates that the pixel on row electrode $X_1$ is in the ON state and that the pixel on row electrode $X_2$ is in the OFF state, and the display pattern on line d indicates that the pixels both row electrodes $X_1$ and $X_2$ are in the ON state.

FIGS. 10A–10B show the relationship between the row selection voltage waveforms applied to the row electrodes that are selected simultaneously and the signal waveforms applied to each column electrode. In FIG. 10A, $X_1$ and $X_2$ represent the row selection voltage waveforms applied to row electrodes $X_1$ and $X_2$ and $Y_a$ to $Y_d$ represent the column voltage waveforms applied to column electrodes $Y_1$ to $Y_m$ in correspondence to display patterns on lines a to d of FIG. 9.

In other words, when the pixels on both row electrodes $X_1$ and $X_2$ are both in the OFF state, as in display pattern a in FIG. 9, the $Y_a$ column voltage waveforms in FIG. 10B is applied. In the same manner, column voltage waveforms $Y_b$, $Y_c$ and $Y_d$ will be applied to display patterns b, c and d, respectively.

As previously described in the second example of the conventional method, the column voltage waveform is similarly determined. In the case of the column voltage waveforms described above, if assuming that when the row selection voltage pulse applied to row electrodes $X_1$ and $X_2$ is positive, the pixel is assigned a first value of 1. Alternatively, if the voltage pulse is negative, the pixel is assigned a first value of −1. The pixel is assigned a second value of −1 if it is in the ON state and a second value of 1 if it is in the OFF state. As in the example of the conventional method, the number of mismatches and matches are determined. When the difference between the number of matches and the number of mismatches is 2, $V_2$ volts is applied, when the difference is zero, zero volts is applied, and when the difference is −2, $-V_2$ volts is be applied.

For example, as in display pattern a in FIG. 9, since both pixels formed in row electrodes $X_1$ and $X_2$ are in the OFF state, those pixels each have a second value of 1. When compared to the voltage pulse in time interval $t_1$, those pixels have first values of −1 and 1 respectively. As will now be apparent, the difference between the number of mismatches and matches is zero. Accordingly, column voltage of zero is applied to the column. Similarly, in time period $t_2$ the number of mismatches is zero and the number of matches is two. Accordingly, a voltage of $V_2$ is applied in period $t_2$.

As for the other column voltage waveforms, $Y_b$ to $Y_d$ are applied to obtain the display patterns as shown in lines b, c, and d, respectively, of FIG. 9. Since the method to obtain these waveforms are similar to that of $Y_a$, a further discussion is deemed unnecessary.

Indeed, when 240 row electrodes were fabricated and the driving took place at drive voltages set to $V_1$=16.8 volts and $V_2$=2.1 volts, the same optical response as in the previously described FIG. 3 is obtained. In the ON state, this embodiment has more brightness and in the OFF state the display is darker than in the conventional arrangements.

Moreover, in the drive method of this embodiment, it also was possible to use a drive circuit that is similar as that of the first embodiment, which is shown in the previously described FIG. 4, a row electrode driver that is similar to that of the first embodiment, which is shown in FIG. 5, and a column electrode driver that is similar to that of the first embodiment, which is shown in FIG. 6. In such a case, as in the previously described embodiment, the calculation of the difference between the number of matches and number of mismatches may take place in the arithmetic operation circuit 4.

A converted data signal is transferred to the column electrode driver by arithmetic operation circuit 4, to generate the column voltage waveforms applied to each column electrode.

By using a drive circuit such as that described above, it is possible to execute the previously described drive method simply and reliably. In addition, it also is possible to provide a display device that has excellent display performance.

Fourth Embodiment

Figures 11A, 11B, 11C, 11D:
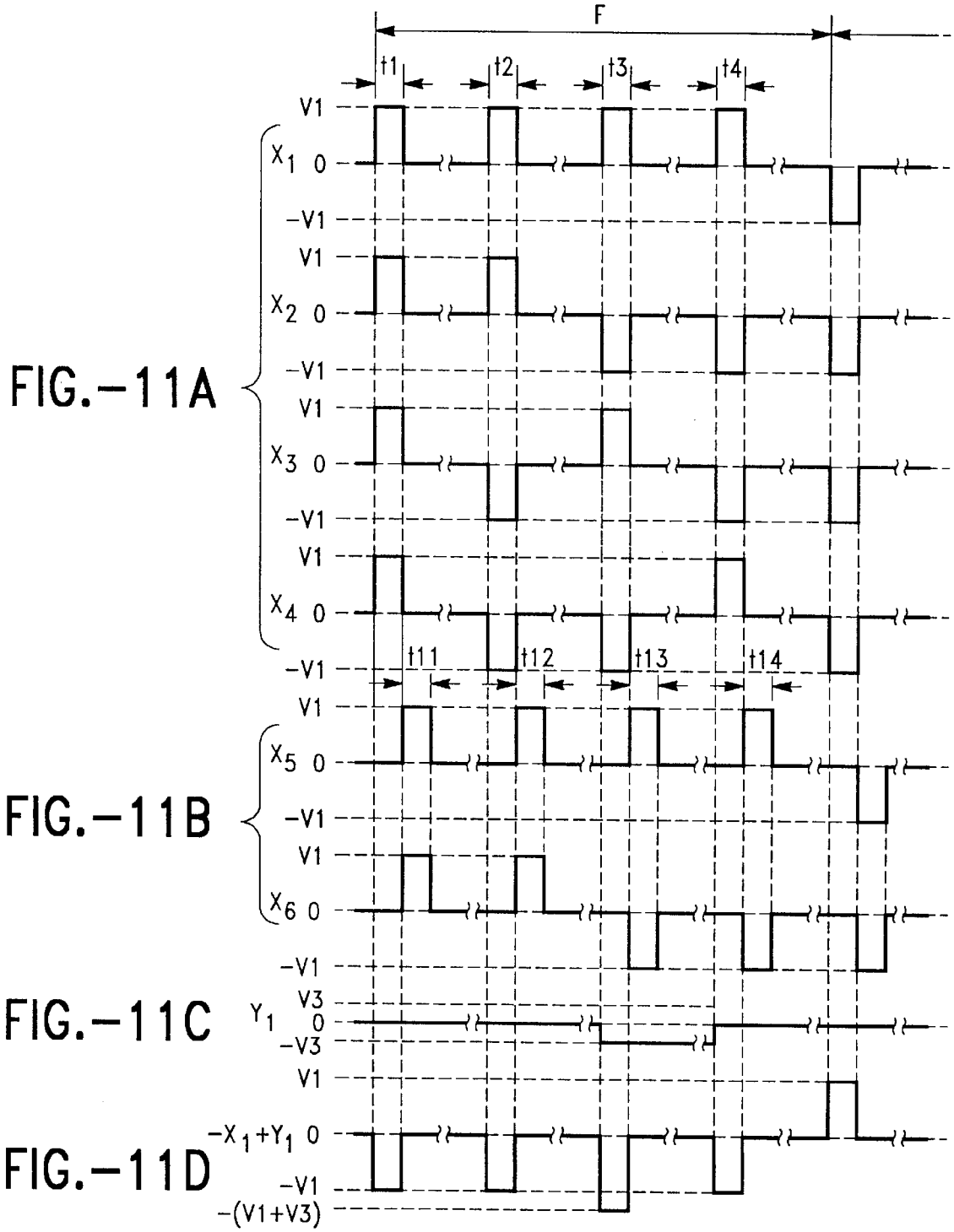
FIGS. 11A–11D show the applied voltage waveforms of a fourth embodiment of a driving method of the liquid crystal display according to the present invention.
Figures 14A, 14B, 14C, 14D:
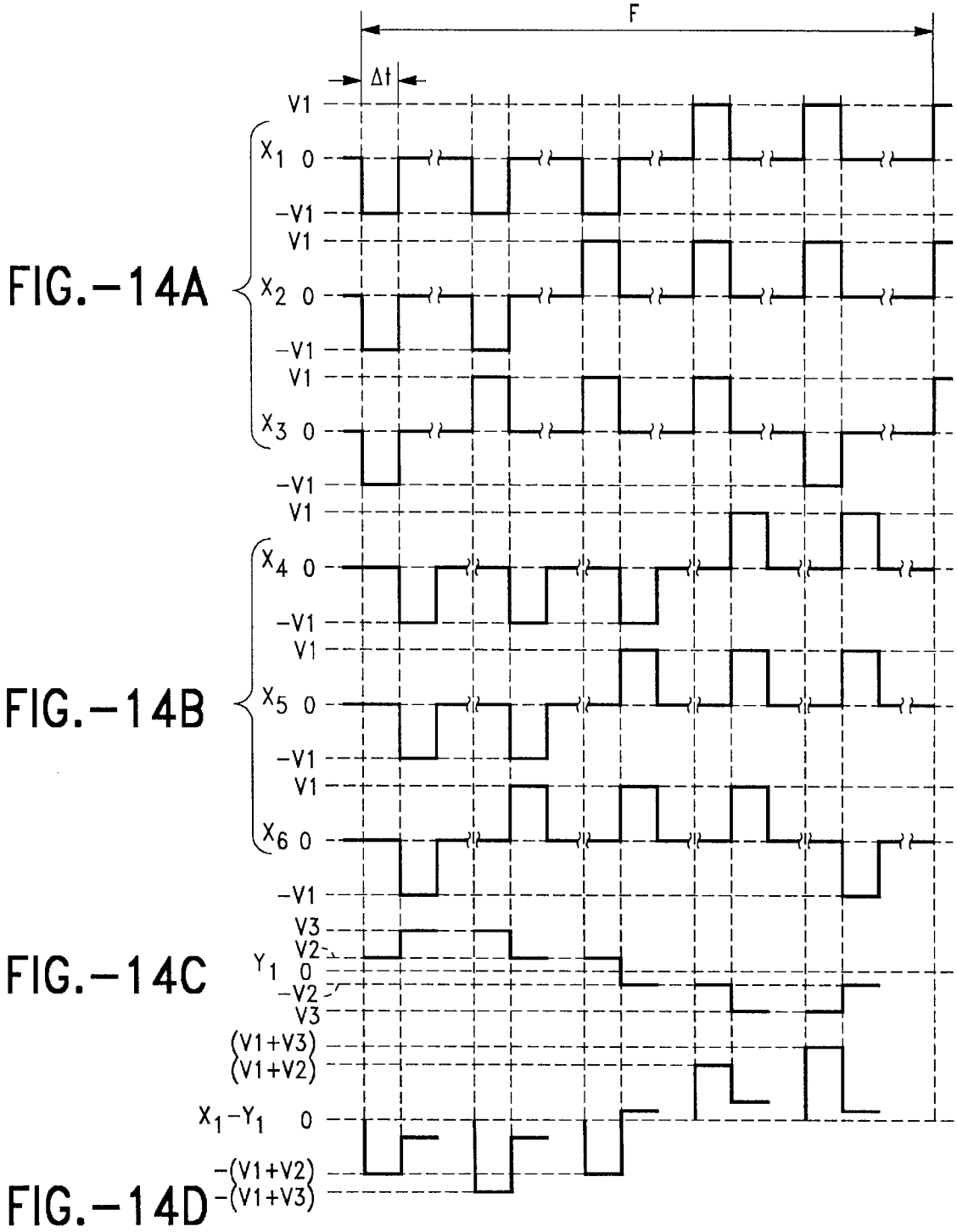
FIGS. 14A–14D show the applied voltage waveforms of a fifth embodiment of a driving method of the liquid crystal display of the present invention.

FIGS. 11A–11D show voltage waveforms applied to the row and column electrodes of a liquid crystal display panel that represent a fourth embodiment of the drive method of the liquid crystal display panel of the present invention. In FIGS. 11A–11D, each group of row electrodes comprises four row electrodes and the row selection signal is applied in the four row electrodes in each group simultaneously. Additionally, the row selection waveform comprises four portions or time intervals within one frame period. In other words, each row electrode is selected four times during one frame period. More specifically, FIG. 11A illustrates the row selection signal applied to row electrodes $X_1$–$X_4$, FIG. 11B illustrates the row selection signal applied to the next group of row electrodes. Solely as a matter of clarity, only row electrodes $X_5$ and $X_6$ are shown, FIG. 11C shows the voltage waveforms that are applied to column electrode $Y_1$, and FIG. 11D shows the synthesized voltage waveforms applied to the pixel formed at the intersection of row electrode $X_1$ and column electrode $Y_1$.

In the fourth embodiment, row electrodes $X_1$ to $X_4$ are simultaneously selected for the time duration $t_1$. At the same time, a designated column voltage that corresponds to the display data is applied to column electrodes $Y_1$ to $Y_m$. Next, row electrodes $X_5$ to $X_8$ are selected by the application of the same row voltage as that for the previously described row electrodes $X_1$ to $X_4$ in the time duration $t_{11}$. At the same time, the designated column voltage that corresponds to the display data is applied to each column electrode, $Y_1$ to $Y_m$. This is repeated until all of the row electrodes, $X_1$ to $X_n$, have been selected.

Next, row electrodes $X_1$ to $X_4$ are selected once again and row selection voltages are applied to them during the time duration $t_2$. At the same time, the designated column voltage that corresponds to the display data will be applied to each column electrode, $Y_1$ to $Y_m$. After this, row electrodes $X_5$ to $X_8$ are selected and the same row voltage as the previously described row electrodes $X_1$ and $X_2$ is applied to them during the time duration $t_{12}$. At the same time, the designated column voltage that corresponds to the display data is applied to each column electrode, $Y_1$ to $Y_m$. This is repeated until all of the row electrodes, $X_1$ to $X_n$, have been selected. By repeating the same operation as the above operation four times in one frame F, one image or one screen will be displayed.

In this embodiment, the polarity of the row selection waveforms are reversed in the second frame period. Moreover, in this embodiment, the column voltage is determined as discussed above.

FIG. 12 depicts a display pattern according to the present invention, for example FIG. 12 illustrates the pixels formed at the intersections of rows electrodes $X_1$–$X_4$ and column electrodes $Y_a$–$Y_h$. Similar to the previous examples, those pixels having closed circles are in the ON state and those pixels having open circles are in the OFF state.

FIG. 13A illustrates the row selection voltage waveforms applied to each of the row electrodes, $X_1$ to $X_4$, FIG. 13B shows the column voltage waveforms applied to column electrodes $Y_a$ to $Y_m$ in accordance with the display patterns a to h in FIG. 12.

That is to say, when the pixels on simultaneously selected row electrodes X1 to X4 are all OFF, such as, for example, display pattern on line a of FIG. 12, the Ya column voltage waveform in FIG. 13B is applied. Similarly, column voltage waveform Yb is applied to display the pattern on line b, voltage waveform Yc is applied to display the pattern on line c, voltage waveform Ydis applied to display the pattern on line d, voltage waveform Ye is applied to display the pattern on line e, voltage waveform Yf is applied to the case of display pattern f, column voltage waveform Yg is applied to display the pattern on line g, and column voltage waveform Yh is applied to display the pattern on line h.

As is apparent to one of ordinary skill in the art, the column voltage waveforms are determined in accordance with the previously described method. Accordingly, the detail of which will be omitted.

As described above, in this embodiment as well, four row electrodes are selected in sequence and driving is carried out by dividing the selection period into four separated intervals within the one frame F.

When fabricating 240 row electrodes and by driving with the drive voltage as $V_1$=12 volts, $V_2$=1.5 volts, and $V_3$=3 volts, the optical response is the same as that shown in previously described FIG. 3. In the ON condition, the pixels are brighter than those of the conventional devices. These allow an improvement in contrast and a reduction in flicker. As will be understood by one of ordinary skill in the art, the driving method of the fourth embodiment may be implement by the circuit diagram of FIGS. 4–6. More specifically, it is contemplated that the calculation of the difference between the number of matches and number of mismatches described above is carried out by arithmetic operation circuit 4. In this arrangement, the second analog switches 25 of the column electrode driver 2 selects the waveform voltage for the column electrodes, Y1 to Ym, from among five voltage levels, $V_3$, $V_2$, 0, $-V_2$ and $-V_3$.

In the third embodiment and the fourth embodiment, driving was accomplished by dividing the selection period either in two or four intervals and separating them two times or four times within one frame F. However, the number of times the selection period is divided may be changed to improve the displayed image. In addition, the number of row electrodes comprising each group may be varied to improve the displayed image.

Fifth Embodiment

FIGS. 14A–14D depict a fifth embodiment of the present invention. In the fifth embodiment, the row selection voltage waveforms are based on the row selection voltage waveforms depicted in FIG. 25A. However, in the fifth embodiment, the selection period is divided into eight portions. For a matter of convenience, only the first five portions are illustrated. More particularly, the row electrode voltage waveforms are divided and separated in 8 intervals having equal time periods.

At the same time, the column voltage waveforms of the designated voltage level, correspond to the difference between the number of mismatches and matches, as discussed above.

A liquid crystal display panel driven according to this method, has pixels which are brighter in the ON state and darker in the OFF state. As a result there is an improvement in contrast and reduction in flicker as compared to conventional arrangements.

It is also contemplated, that the driving method may implemented by the circuits of FIGS. 4–6 described above. As noted above, the number of intervals and the number of row selected simultaneously may be varied to improve the display of the image.

Sixth Embodiment

As stated above, the number of bit-word patterns when selecting and driving a plurality (h number) of row electrodes in sequence is $2^h$. For example, as in the aforesaid example, when h=3, $2^3$=8 patterns. With ON is assigned the value 1 and OFF is assigned the value 0, the voltage ON and OFF pattern shown in FIG. 15A that applies this waveform to row electrodes, X1, X2 and X3, may be expressed as shown in Table E below.

TABLE E

| | | | | | | | | |
|---|---|---|---|---|---|---|---|---|
| X1 | 0 | 0 | 0 | 0 | 1 | 1 | 1 | 1 |
| X2 | 0 | 0 | 1 | 1 | 0 | 0 | 1 | 1 |
| X3 | 0 | 1 | 0 | 1 | 0 | 1 | 0 | 1 |

Figures 15A, 15B, 15C:
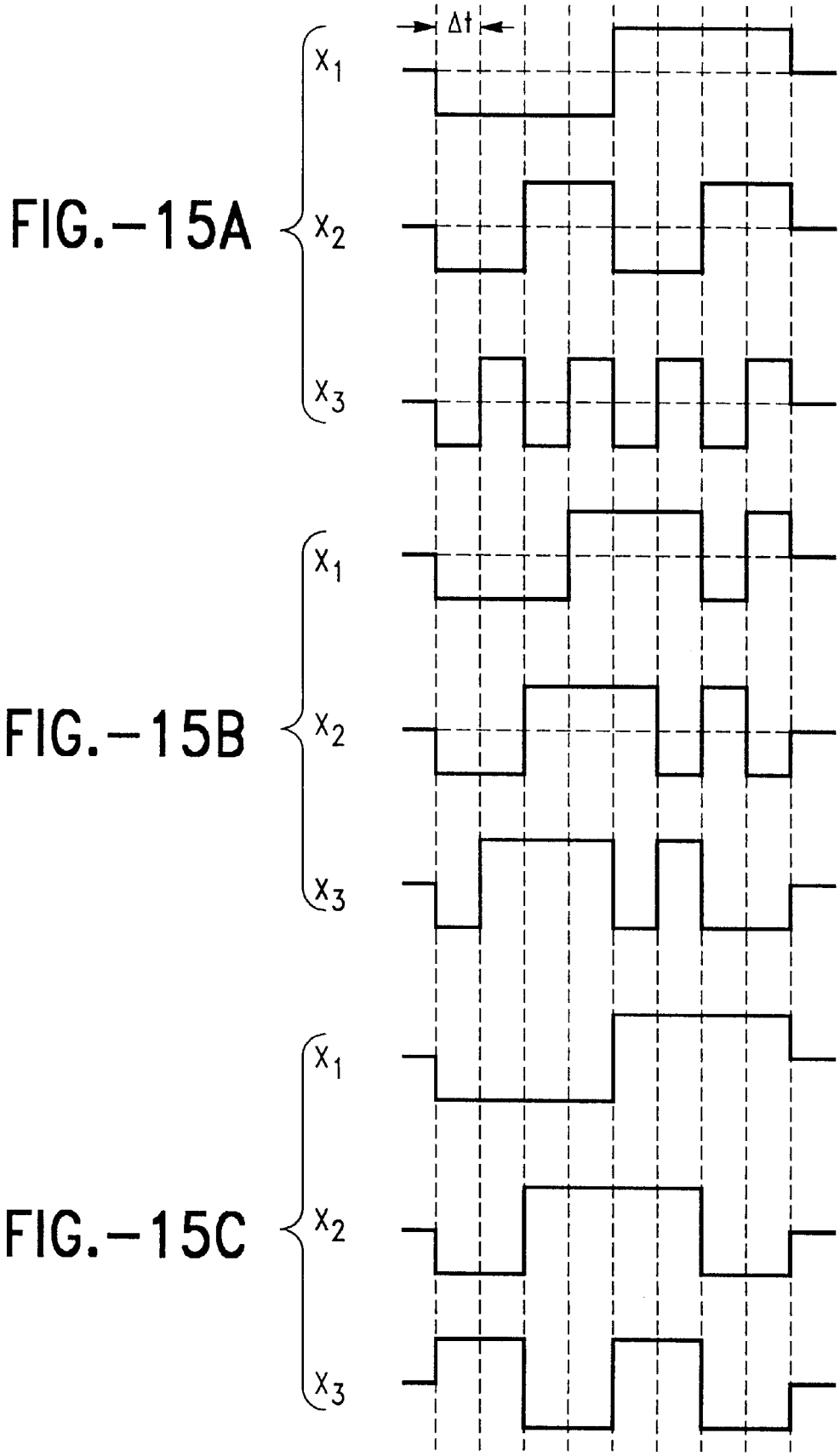
FIGS. 15A–15C are other examples of the applied electrodes voltage waveforms in accordance with the present invention.
Figures 17A, 17B, 17C, 17D:
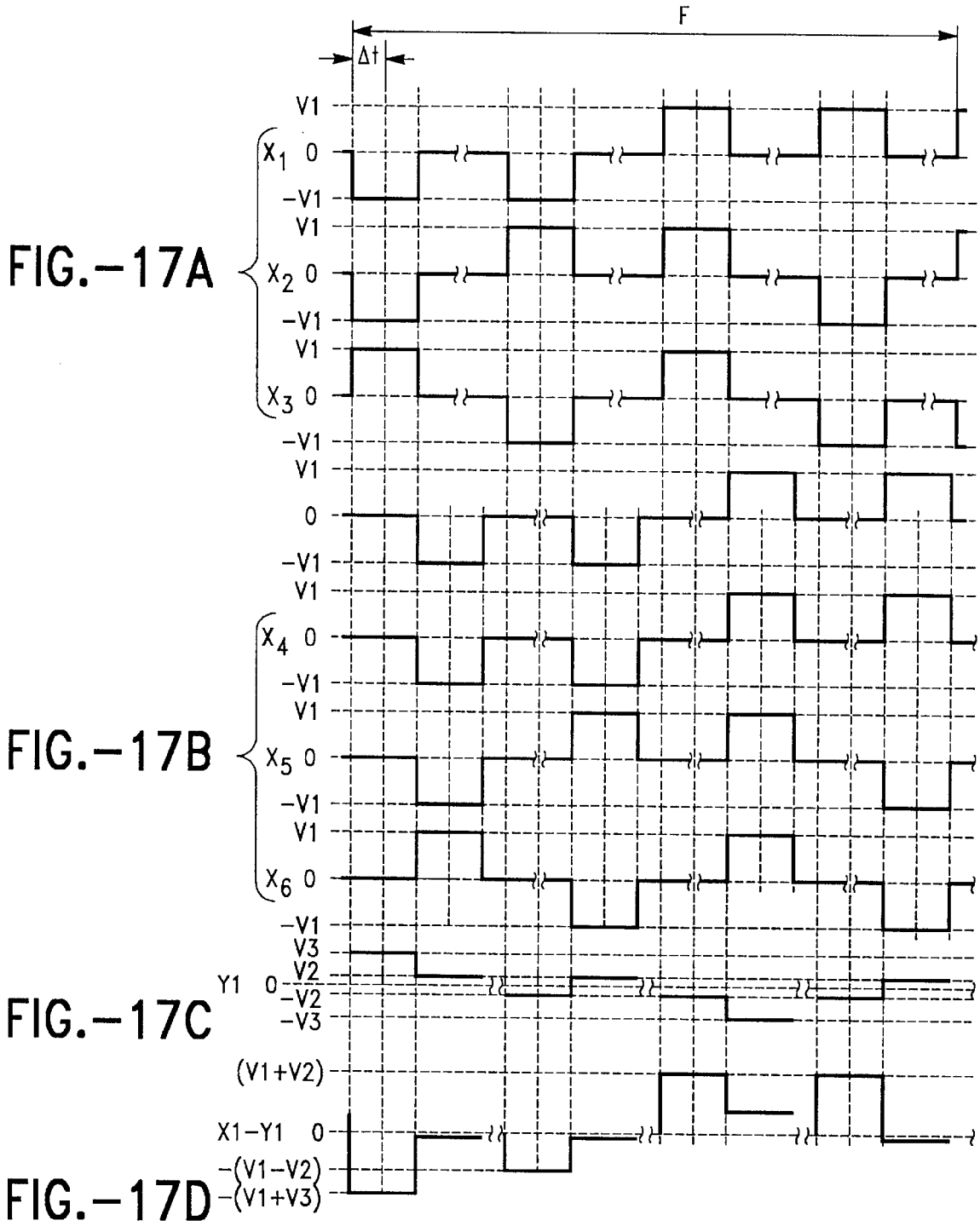
FIGS. 17A–17D show the applied voltage waveforms of another embodiment of the FIG. 9 method of the liquid crystal elements according to the present invention.

It is noted that waveforms applied in accordance with FIG. 15A have many different frequency components. More specifically, the frequencies of the waveforms on row electrode X1 are 4·Δt and 4·Δt, the frequencies of the waveforms on row electrode X2 are 2·Δt, 2·Δt, 2·Δt and 2·Δt, and the frequencies of the waveforms on row electrode X3 are Δt, Δt, Δt, Δt, Δt, Δt, Δt, and Δt. Such differences in frequency appear to cause distortion of the displayed image.

For this reason, the voltage waveforms are changed to eliminate the deviation of the frequency components. However, using the type of waveform in FIG. 15B, not only those shown in FIG. 15A above, when the number of row electrodes that are simultaneously selected increases, the number of above described bit-word patterns will increase exponentially. Additionally, each pulse width is narrower, and there is a potential for rounding or distorting the waveforms. Further, when implementing gray shade display, for example, such as by pulse width modulation techniques, the narrower the pulse width there is more likelihood of generating crosstalk.

For this reason, in this embodiment, the voltage waveforms applied to the row electrodes are set under the following guidelines so that the pulse widths become wider.

For applied voltage waveforms to the row electrodes, these are determined taking the following into consideration:

(1) Each row electrode must be distinguishable.

(2) The frequency component added to each row electrode must not differ significantly.

(3) There must be alternating current characteristics within one frame or within a plurality of frames.

In other words, the applied voltage patterns are to be appropriately selected, taking the conditions mentioned above into consideration, from among the systems of orthogonal functions, such as natural binary, Walsh and Hadamard.

Among these, item number (1) is a necessary-sufficient condition. In particular, in order to satisfy item number (1), it is preferred that the applied voltage waveforms of each row electrode will each have different frequency components. The applied voltage waveforms, which include different frequency components, are:

X1: 4·Δt, 4·Δt

X2: 2·Δt, 4·Δt, 2·Δt

X3: 2·Δt, 2·Δt, 2·Δt, 2·Δt

The voltage waveforms of FIGS. 15A·15C are determined as discussed below utilizing the Walsh function of the Hadamard matrix. As is known to one of ordinary skill in the art, the Walsh function is orthogonal. The Walsh functions are:

$$H_2 = \begin{vmatrix} + & + \\ + & - \end{vmatrix} \tag{1}$$

$$H_{2n} = \begin{vmatrix} H_n & H_n \\ H_n & -H_n \end{vmatrix} \tag{2}$$

In the case of n=1, the formula (1) is included in formula (2), thus $H_{2n}$ or $H_2$ can be obtained as follows:

$$H_4 = \begin{vmatrix} + & + & + & + \\ + & - & + & - \\ + & + & - & - \\ + & - & - & + \end{vmatrix} \tag{3}$$

Further, in the case of n=2, the formula (2) is included in formula (3), thus $H_{2n}$ or $H_8$ can be obtained as follows:

$$H_8 = \begin{vmatrix} + & + & + & + & + & + & + & + \\ + & - & + & - & + & - & + & - \\ + & + & - & - & + & + & - & - \\ + & - & - & + & + & - & - & + \\ + & + & + & + & - & - & - & - \\ + & - & + & - & - & + & - & + \\ + & + & - & - & - & - & + & + \\ + & - & - & + & - & + & + & - \end{vmatrix} \tag{4}$$

It is noted that in the Walsh function the orthogonal feature is maintained even under the following transformations:

1. exchanging one row with another,
2. exchanging one column with another,
3. inverting all the polarities of one row, and
4. inverting all the polarities of one column.

Additionally, the Walsh function is a square matrix, e.g. the number of row is equal to the number of columns. However if only a few rows are selected, the orthogonal feature is not lost. For example if 3 rows are selected from $H_8$, the matrix remains orthogonal.

In this example, + corresponds to 1 and − corresponds to 0. Either expression is permissible since the Hadamard matrix is binary.

In accordance with the above guidelines, the voltage waveforms depicted in FIGS. 15A–15C can be obtained by manipulation of the Hadamard matrix The voltage waveforms for FIG. 15A are obtained by first preferably selecting the second, third and fifth rows of the $H_8$ matrix to form the matrix A as follows:

$$A = \begin{vmatrix} + & - & + & - & + & - & + & - \\ + & + & - & - & + & + & - & - \\ + & + & + & + & - & - & - & - \end{vmatrix}$$

It is noted that row 1 of the $H_8$ matrix was preferably omitted because it is essentially a DC signal, rows 4, 6, 7 and 8 were preferably omitted because each of those waveforms contained a larger number of different frequency component.

The first row of matrix A is replaced with the third row to form matrix A' as follows:

$$A' = \begin{vmatrix} + & + & + & + & - & - & - & - \\ + & + & - & - & + & + & - & - \\ + & - & + & - & + & - & + & - \end{vmatrix}$$

Finally matrix A' is inverted to obtained the row selection waveforms of FIG. 15A $$A'^{-1} = \begin{vmatrix} - & - & - & - & + & + & + & + \\ - & - & + & + & - & - & + & + \\ - & + & - & + & - & + & - & + \end{vmatrix}$$

The waveforms depicted in FIG. 15B are obtained by various column transformations of matrix $A'^{-1}$ More particularly, the third column is transferred to the seventh column, the fourth column is transferred to the third column, the fifth column is transferred to the eighth column, the seventh column is transferred to the fifth column and the eighth is transferred to the fourth column as shown below:

$$\begin{array}{l} \text{Column} \\ \\ A'^{-1} = \\ \\ \end{array} \begin{vmatrix} 1 & 2 & 3 & 4 & 5 & 6 & 7 & 8 \\ - & - & - & - & + & + & + & + \\ - & - & + & + & - & - & + & + \\ - & + & - & + & - & + & - & + \end{vmatrix}$$

$$\begin{array}{l} \text{Column} \\ \\ B = \\ \\ \end{array} \begin{vmatrix} 1 & 2 & 3 & 4 & 5 & 6 & 7 & 8 \\ - & - & - & + & + & + & - & + \\ - & - & + & + & + & - & + & - \\ - & + & + & + & - & + & - & - \end{vmatrix}$$

The voltage waveforms shown in FIG. 15C are obtained by selecting the third, fifth and seventh rows of matrix $H_8$ forming matrix C:

$$\begin{array}{l} \text{Column} \\ \\ C = \\ \\ \end{array} \begin{vmatrix} 1 & 2 & 3 & 4 & 5 & 6 & 7 & 8 \\ + & + & - & - & + & + & - & - \\ + & + & + & + & - & - & - & - \\ + & + & - & - & - & - & + & + \end{vmatrix}$$

Next, the first row is replaced with the third row, the second row is replaced with the first row and the third row is replaced with the second row forming matrix C'

$$\begin{array}{l} \text{Column} \\ \\ C' = \\ \\ \end{array} \begin{vmatrix} 1 & 2 & 3 & 4 & 5 & 6 & 7 & 8 \\ + & + & + & + & - & - & - & - \\ + & + & - & - & - & - & + & + \\ + & + & - & - & + & + & - & - \end{vmatrix}$$

Finally, the first and the second rows are inverted forming matrix C" or the row selection waveform shown in FIG. 15C $$\begin{array}{l} \text{Column} \\ \\ C'' = \\ \\ \end{array} \begin{vmatrix} 1 & 2 & 3 & 4 & 5 & 6 & 7 & 8 \\ - & - & - & - & + & + & + & + \\ - & - & + & + & + & + & - & - \\ + & + & - & - & + & + & - & - \end{vmatrix}$$

In these waveforms the polarity of adjacent columns is the same, so if such adjacent columns belong to one group, the matrix is the same as obtained by selecting the third, the fourth and the second columns of matrix $H_4$. In other words, the matrix is obtained without row and column transformation. Moreover, the row select waveforms may be obtained by other binary, Hadamard, Walsh, Rademacher and other orthogonal functions. FIGS. 16A–16D show the applied row selection voltage waveforms in accordance with the waveforms of FIG. 15C above.

In contrast to the shortest pulse width in FIG. 15A and 15B above and in contrast to the conventional example in FIG. 25 above, which is Δt, the shortest pulse width of FIG. 15C and FIGS. 16A–16D above is 2·Δt, which allows a pulse width to double. By providing the pulse width large in this manner, it is possible to lessen the effect of the waveform rounding, and thus reduce crosstalk. The reduction in crosstalk allows for the selection of a larger number of row electrodes simultaneously.

The waveforms of the embodiment described above are only one example. They can be changed as appropriate to further improve the displayed image. In addition, factors such as the row electrode selection sequence and the arrangement sequence of the pulse patterns that are applied to each row electrode can be changed as desired.

FIGS. 17A–17D show an example in which the row selection waveforms in FIG. 16 above are divided into four selection portion within one frame F period and are applied similarly as in the fifth embodiment above.

A liquid crystal display panel driven according to this method, has pixels which are brighter in the ON state and darker in the OFF state. As a result there is an improvement in contrast and reduction in flicker as compared to conventional arrangements. Additionally, crosstalk is reduced.

Seventh Embodiment

In the embodiment described above, four levels, $V_3$, $V_2$, $-V_2$ and $-V_3$, were used as the column electrode voltage levels. However, the number of levels can be reduced under the following method. By reducing the voltage levels, a driving circuit can be fabricated which is simpler and more reliable.

Initially, a description will be given based on the general methods of reducing the number of previously mentioned voltage levels.

In this embodiment, subgroup h comprises a virtual line e. Line e is a virtual electrode and its sole purpose is for determining the voltage levels applied to the column electrodes. There is no requirement that the virtual electrode is to be fabricated on the liquid crystal display panel. However the virtual electrode may be fabricated in a non-display area of the display panel.

The number of voltage levels may be reduced by controlling the number of matches and mismatches of the virtual row electrode data. As a result, the total number of matches and number of mismatches will be limited, and the number of drive voltage levels for column electrodes will be reduced.

With Mi representing the number of mismatches and Vc representing the appropriate constant, $V_{column}$, the applied voltage to the column electrode, is as follows:

$$\begin{aligned} V_{column} &= V_c \sum_{j=1}^{h} a_k * h + j \oplus d_k * h + j \\ &= V_c(2Mi - h) \quad V_c : \text{constant} \end{aligned}$$

or, more simply:

$V_{column}=V(i)(0 \leqq i \leqq h)$

In either case, $V_{column}$ is the h+1 level.

For example, the case in which subgroup h=4 and virtual row electrode e=1 will be considered. As in the previous embodiment, the number of levels when h=3 will be four levels, $-V_3$, $-V_2$, $V_2$ and $V_3$. If control takes place through the virtual row electrodes so that there are an even number of mismatches, the results are as shown in the table below. In other words, a virtual pixel formed by the intersection of the virtual row electrode and column electrode has a display state and row selection voltage waveform such that it is either a match or a mismatch.

| Original voltage level | Original number of mismatches | Virtual row electrode | Number of mismatches on revision | Voltage levels on revision |
|---|---|---|---|---|
| $-V_3$ | 0 | Match | 0 | $V_a$ |
| $-V_2$ | 1 | Mismatch | 2 | $V_b$ |
| $V_2$ | 2 | Match | 2 | $V_b$ |
| $V_3$ | 3 | Mismatch | 4 | $V_d$ |

As shown in this example, the virtual pixel is provided with a match when the original number of mismatches is even or zero and the virtual pixel is provided with a mismatch when the original number of mismatches is odd.

As shown above, it is possible to take the original four levels and reduce them to three levels. Of course the mismatches on the virtual electrode may be any combination of matches or mismatches. For example if the virtual pixel were an odd number, the number of mismatches on revision in the above table would change in sequence from the top to 1, 1, 3 and 3. Thus it is possible to reduce the number of voltage levels to two levels.

In another example, a subgroup has h=4 and the number of voltage levels is five, i.e., $-V_3$, $-V_2$, 0, $V_2$ and $V_3$. However, if control takes place through the virtual row electrodes so that there are an even number of mismatches, the results are shown in the table below.

| Original voltage level | Original number of mismatches | Virtual scanning electrode | Number of mismatches on revision | Voltage levels on revision |
|---|---|---|---|---|
| $-V_3$ | 0 | Match | 0 | $V_a$ |
| $-V_2$ | 1 | Mismatch | 2 | $V_b$ |
| 0 | 2 | Match | 2 | $V_b$ |
| $V_2$ | 3 | Mismatch | 4 | $V_d$ |
| $V_3$ | 4 | Match | 4 | $V_d$ |

As shown above, it is possible to take an original five levels and reduce them to three levels. In the above case, it is possible to set the voltage levels so that the number of mismatches is an odd number. As for the virtual row electrodes above, since normally they need not display, they do not necessarily have to be fabricated. However, if they are fabricated, they can be fabricated in an area where they will not effect the display.

Figure 18:
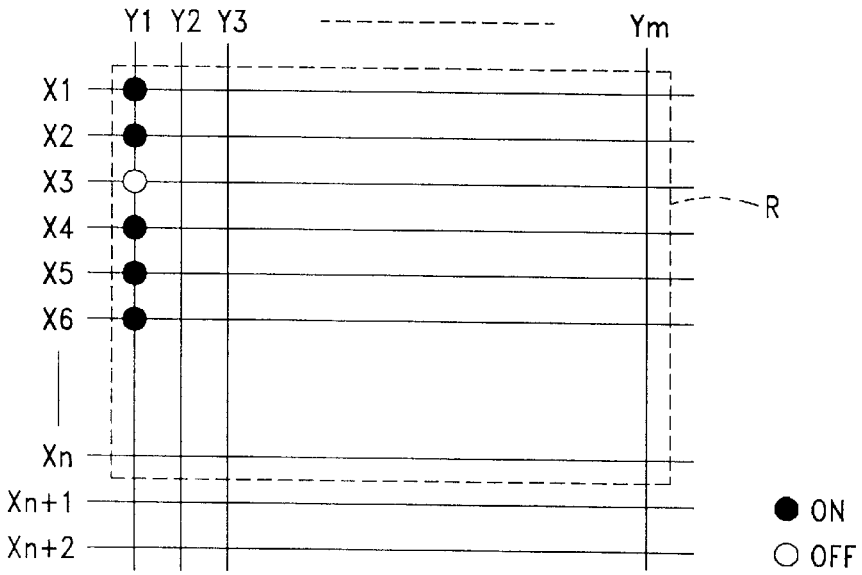
FIG. 18 illustrates a liquid crystal display having virtual electrodes.
Figure 27A:
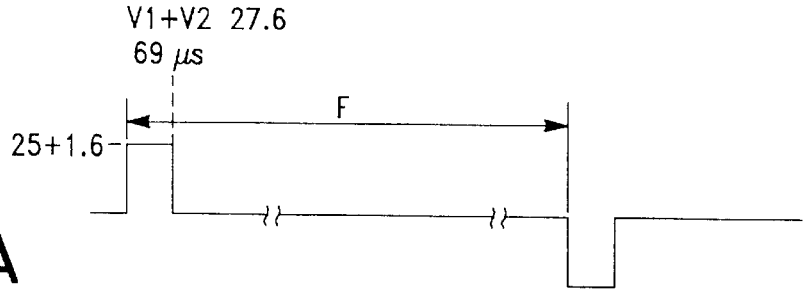
FIGS. 27A–27C are graphs that show the relationship between the applied voltage to a liquid crystal display and the transmissitivity thereof driven in accordance with a conventional driving method.
Figure 27B:
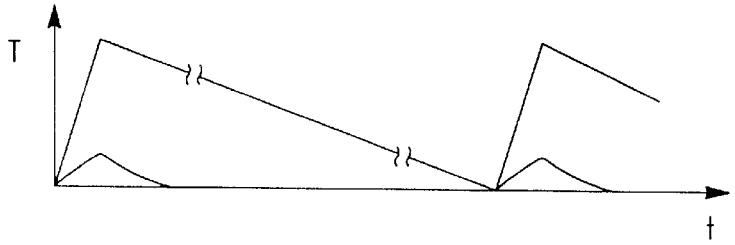
Figure 27C:
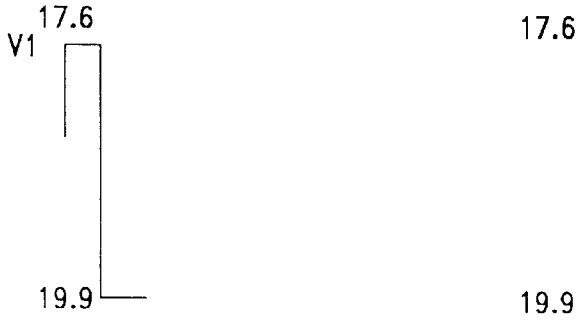
Figures 19A, 19B, 19C, 19D:
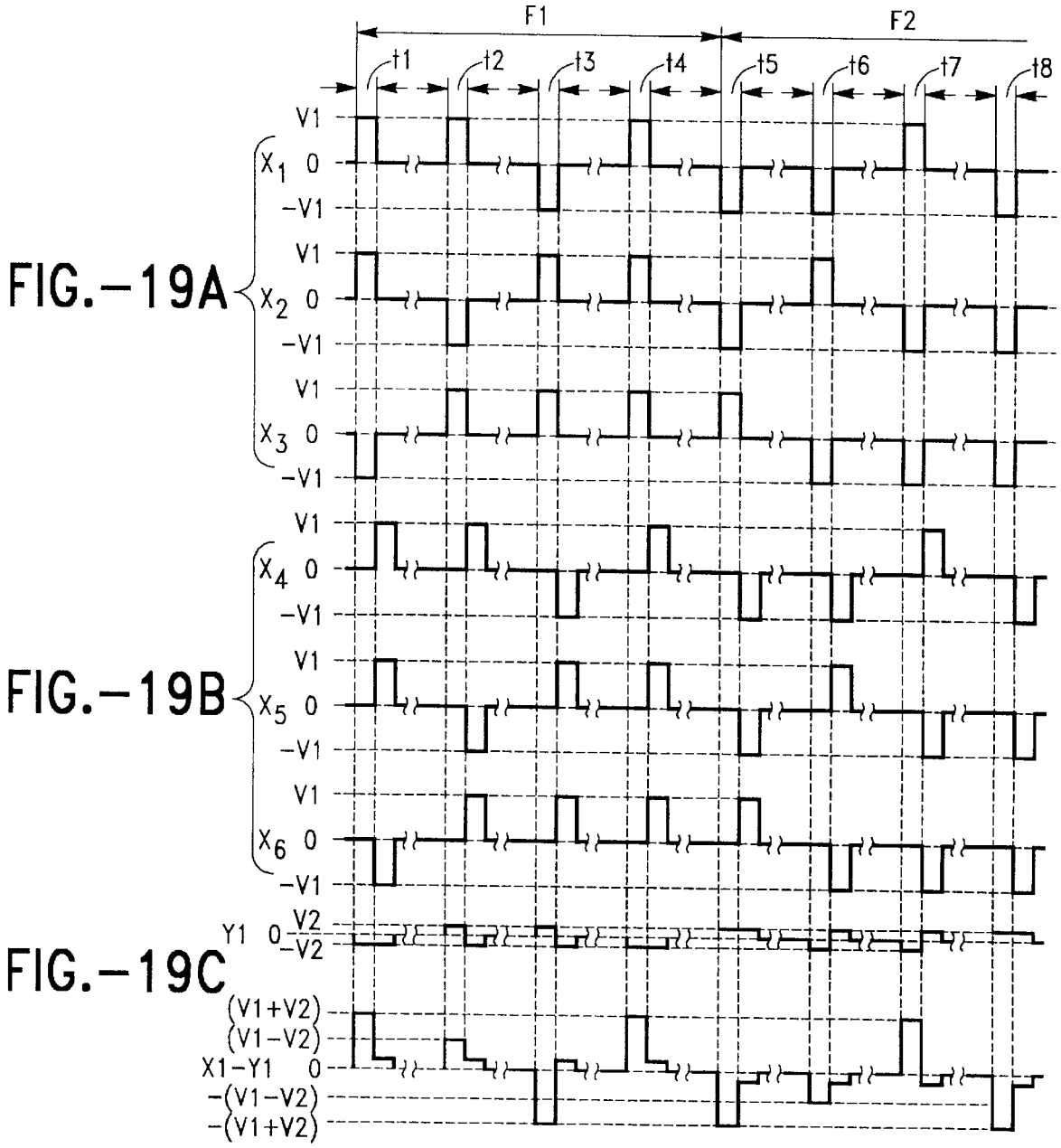
FIGS. 19A–19D show the applied voltage waveforms of a seventh embodiment of the driving method of the liquid crystal display of the present invention.

For example, as shown in FIG. 18, the virtual row electrodes $X_n$ . . . $X_n$+1 are fabricated on the outside of display region R or non-display area of a liquid crystal display device. If there are extra row electrodes on the outside of display region R, they may be as virtual row electrodes.

In addition, if e number of virtual row electrodes is increased, the number of voltage levels can be reduced even further. In such a case, if as above, e=1, all of the number of mismatches can be controlled so that they can be divided by 2. For example, in the case of e=2, the number of mismatches all can be controlled so that they can be divided by 3. However, they can all be divided by 3 and have 1 or 2 remaining.

Finally, the maximum number of reductions possible under the above method is 1/(e+1). When e=1, it is ½, except for zero volts.

FIGS. 19A–19D illustrate an example in which three row electrodes and one virtual row electrode are used in sequence to reduce the applied voltage level to the column electrodes. In this example there are four intervals in the frame period. The number of mismatches is determined with the virtual electrode. In this example, the virtual electrode is set to an odd number of mismatches, thus making the number of mismatches a one or a three. In response to this, the voltage level of the column voltage waveform is one of two levels, $V_2$ or $-V_2$.

More specifically, for example in FIG. 18, after the initially selected row electrodes, $X_1$, $X_2$ and $X_3$, as shown in FIG. 20, virtual row electrode Xn+1 is then selected. As noted above the virtual electrodes need not be fabricated. However, if the virtual electrode is fabricated, it is preferable to fabricate the virtual electrode in a non-display region of a liquid crystal display panel, as shown in FIG. 20. The calculation of the column voltages, i.e. determining the number of mismatches, is similar to the column voltage calculation described above. During the time duration t1, assuming ON to be positive voltage being applied to the above row electrodes and OFF to be negative voltage, and assuming that $V_1$, $V_1$ and $-V_1$ volts pulses are applied to each row electrode, $X_1$, $X_2$ and $X_3$, respectively, and assuming that $V_1$ is applied to the virtual row electrode $X_n$+1, and assuming the data that is displayed on the pixels at the crossing point between column electrode $Y_1$ and virtual row electrode Xn+1 at that time to be OFF, the number of mismatches is one. Accordingly, a $-V_2$ voltage pulse is be applied to the column electrode.

Next, looking at the $t_2$ period, assuming that $V_1$ is applied to virtual row electrode Xn+1, the number of mismatches is three, and voltage pulse $V_2$ is be applied to the column electrode. In addition, assuming that $V_1$ is applied to virtual row electrode Xn+1 in the $t_3$ period, the number of mismatches is three, and a voltage pulse $V_2$ is applied to the column electrode. Finally, assuming voltage pulse $V_1$ is applied to virtual row electrode $Xn_{+1}$ in the $t_4$ period, there is one mismatch, and a voltage pulse $-V_2$ is applied to the column electrode.

The voltage levels that are applied to the column electrodes can be reduced by assuming the polarity and the display data of the selection pulse to be applied to the virtual row electrodes in this manner, and by making the number of mismatches always odd numbers such as one and three. In the embodiment described above, the voltage levels can be reduced to two levels. However, as stated above, they also may be made into even numbers. By reversing each polarity of the applied voltage in the first frame period $F_1$ and the applied voltage in frame period $F_2$, alternating current drive scheme is realized.

By reducing the number of voltage levels that are applied to the column electrodes as described above, the circuit configure of things such as the liquid crystal drive can be simplified, allowing a drive circuit that is almost identical to that described in the previous embodiments to be used. In addition, as in the previously described embodiments, this allows a display device with excellent display performance to be obtained.

Eighth Embodiment

Figure 29:
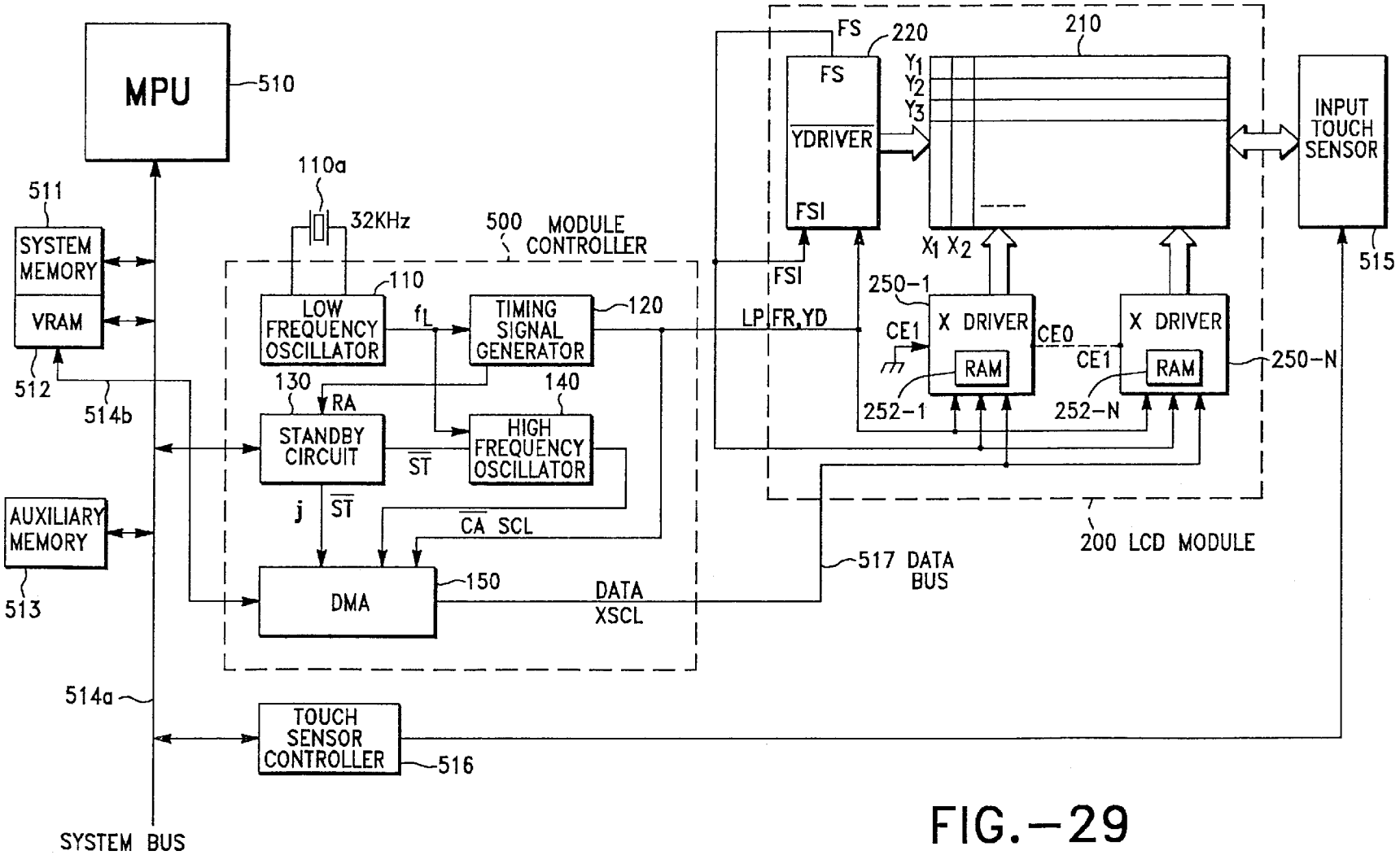
FIG. 29 is a block diagram of the overall configuration of a simple matrix-type liquid crystal display apparatus according to the preferred embodiment of the present invention.

The driving method described above may be implemented in accordance with the eighth embodiment described as follows:

As shown in FIG. 29, this simple matrix-type LCD comprises a programmed host MPU 510, system memory 511 used as the working memory of host MPU 510, video RAM (VRAM) 512 for storing the display data at the same address area as system memory 511, auxiliary memory 513 for storing images, data, and audio information, module controller 500 connected to system bus 514*a* and dedicated bus 514*b*, LCD module 200 display-controlled by module controller 500, input touch sensor 515, and touch sensor controller 516.

As in a conventional computer system, communications control devices and other peripheral devices such as other display devices can be connected to system bus 514*a* as required.

LCD module 200 further comprises a simple matrix-type liquid crystal display (LCD panel) 210, scan electrode drive circuit (Y driver IC) 220 for selecting plural scan electrodes $Y_1, Y_2 \ldots Y_n$ of LCD panel 210, and signal electrode drive circuits (X driver ICs) 250-1~250-N with N built-in frame memory (RAM) devices for supplying the display data to plural signal electrodes of LCD panel 210.

Module Controller

Module controller 500 comprises a low frequency oscillator 110, timing signal generator 120, standby circuit (display data refresh detection circuit) 130, high frequency oscillator 140, and a direct memory access (DMA) circuit 150. Low frequency oscillator 110 comprises a 32~512 kHz oscillator, and constantly generates a low frequency clock $f_L$. Based on low frequency clock $f_L$, timing signal generator 120 generates the scan start signal (frame start pulse) YD required for LCD module 200, the line latch signal (latch pulse) LP for series-parallel conversion of the transferred display data, and the liquid crystal current alternating signal FR. Standby circuit 130 generates the intermittent operation start control signal $\overline{ST}$ when the intermittent operation command is received directly from host MPU 510, or when the display data in VRAM 512 is updated as determined by monitoring system bus 14a for communications with host MPU 510. High frequency oscillator 140 generates the high frequency clock $f_H$ phase synchronized to the low frequency clock $f_L$ during the intermittent operation start control signal $\overline{ST}$ apply period. DMA circuit 150 reads the display data from VRAM 512 over dedicated bus 514*b* by direct memory access, converts the display data to the bit number or format of data bus 517, and transfers the display data over data bus 517 to frame memories 252-1~252-N of X drivers 250-1~250-N during the intermittent operation start control signal $\overline{ST}$ apply time using the high frequency clock $f_H$.

Figure 30:
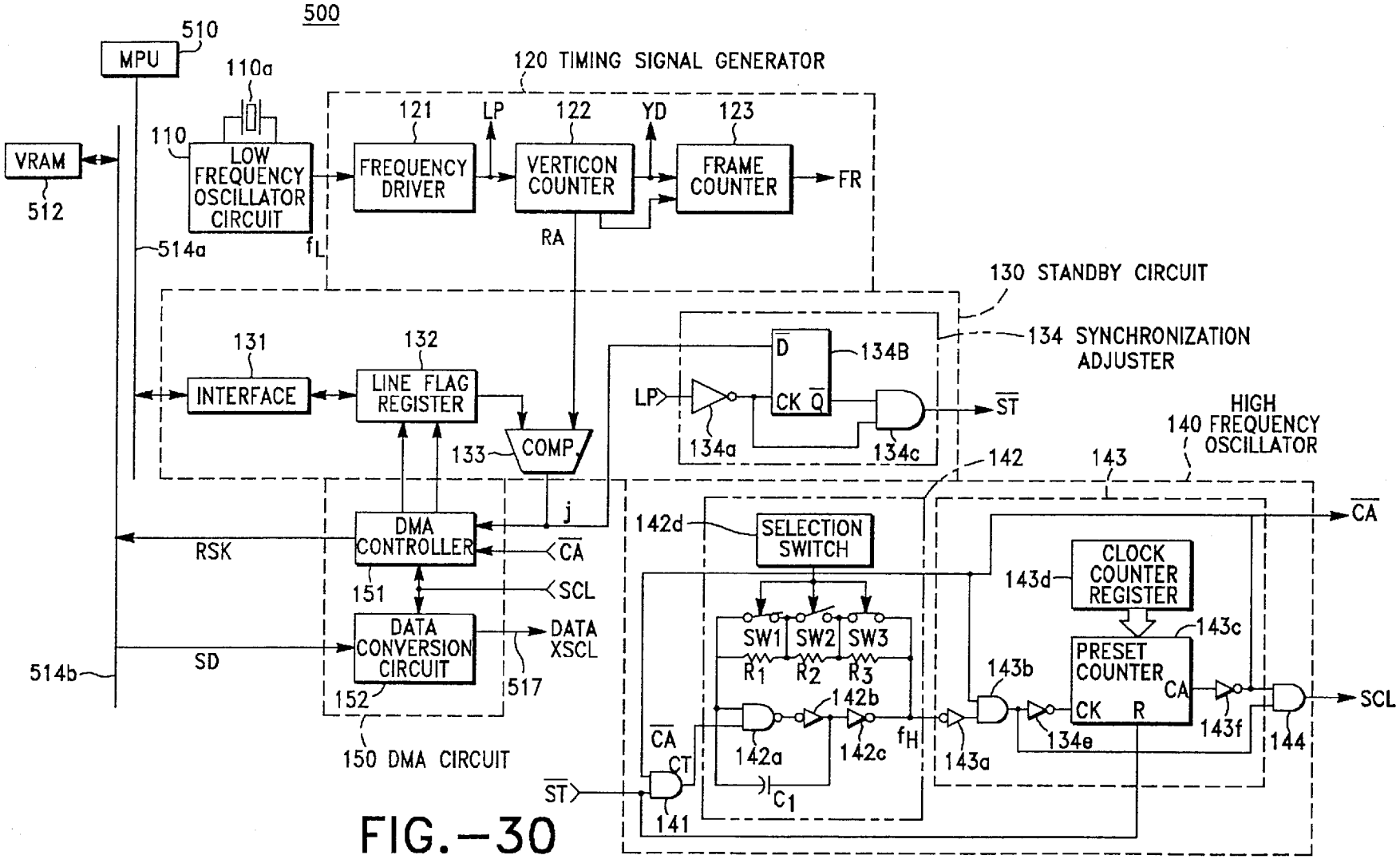
FIG. 30 is a detailed block diagram of the module controller in a simple matrix-type liquid crystal display apparatus according to the present embodiment.

As shown in FIG. 30, timing signal generator 120 comprises a frequency divider 121, vertical counter 122, and frame counter 123. Frequency divider 121 generates two line latch signals LP during one horizontal period based on the low frequency clock $f_L$. Vertical counter 122 counts the line latch signals LP to generate the line address signal RA specifying the number of the scan electrode (line address) and frame start pulse YD. Frame counter 123 generates the liquid crystal current alternating signal FR based on frame start pulse YD and a specified count from vertical counter 122.

Standby circuit 130 comprises a system bus interface circuit 131, line flag register 132, comparator 133, and synchronization adjuster 134. The line flag register 132 stores the transfer command flag, which is set by host MPU 510, when host MPU 510 changes the display data in the X driver frame memory of VRAM 512. Comparator 133 evaluates the coincidence/anti-coincidence of the line address signal RA and the address of the scan electrode for which the transfer command flag is set to generate the coincidence signal j. Synchronization adjuster 134 generates the intermittent operation start control signal $\overline{ST}$ from the coincidence signal j and the latch pulse LP. It is to be noted that two intermittent operation start control signals $\overline{ST}$ are generated during one horizontal period (1H) of the latch pulse LP because of the use of a 2-line selection/drive method.

Synchronization adjuster 134 comprises an inverter 134*a* for inverting the latch pulse LP, a D flip-flop 134*b* for generating a coincidence signal synchronized to the latch pulse LP drop, and AND gate 134*c* setting the pulse width of the synchronization coincidence signal as the intermittent operation start control signal $\overline{ST}$ limited to the latch pulse LP period. The read start address of VRAM 12 is set by host MPU 510.

High frequency oscillator 140 comprises AND gate 141, high variable frequency CR oscillator 142, intermittent operation time limiter 143, and AND gate 144. AND gate 141 generates the oscillation control signal CT from the intermittent operation start control signal $\overline{ST}$ and intermittent operation end control signal $\overline{CA}$, which is described below. High variable frequency CR oscillator 142 oscillates intermittently as controlled by the oscillation control signal CT. Intermittent operation time limiter 143 counts the high frequency clock $f_H$ obtained by high variable frequency CR oscillator 142 to generate the intermittent operation end control signal $\overline{CA}$ limiting the intermittent operation time. AND gate 144 generates the shift clock SCL for storing the display data in the shift register from the high frequency clock $f_H$ and intermittent operation end control signal $\overline{CA}$.

High variable frequency CR oscillator 142 comprises a CR oscillator formed by AND gate 142*a*, inverters 142*b* and 142*c*, feedback resistors $R_1$, $R_2$, and $R_3$, and feedback capacitor $C_1$, resistance selectors $SW_1$, $SW_2$, and $SW_3$, and switch selection register 142*d*. The time constant of switch selection register 142*d* is set by host MPU 10, which controls the combination of open and closed resistance selectors $SW_1$, $SW_2$, and $SW_3$ accordingly. Because the feedback resistance (time constant) applied to the CR oscillator is controlled by changing the combination of open and closed resistance selectors $SW_1$, $SW_2$, and $SW_3$ based on the content of switch selection register 142*d*, the value of the oscillation frequency $f_H$ of the CR oscillator can be changed.

Intermittent operation time limiter 143 comprises inverter 143*a*, AND gate 143*b*, preset counter 143*c*, variable clock count register 143*d*, and inverter 143*f*.

Inverter 143*a* inverts and buffers the high frequency clock $f_H$. AND gate 143*b* passes the high frequency clock $f_H$ only during the HIGH level period of the intermittent operation end control signal $\overline{CA}$. Preset counter 143*c* resets at the signal drop of the intermittent operation start control signal $\overline{ST}$ using as a clock the high frequency clock $f_H$ input from AND gate 143*b* through inverter 143*e*. Clock count register 143*d* stores the number of high speed clocks SCL (XSCL) required to transfer one scan line of display data. This number is set by host MPU 10. Inverter 143*f* inverts the carrier output CA of preset counter 143*c* to generate the intermittent operation end control signal $\overline{CA}$.

DMA circuit 150 comprises DMA controller 151 and data conversion circuit 152. DMA controller 151 outputs the read clock RSK to dedicated bus 514*b* using the shift clock SCL based on the coincidence signal j from standby circuit 130, and outputs the flag address signal and flag preset signal to line flag register 132. Data conversion circuit 152 fetches the display data from the overwrite address in VRAM 512 at the read clock RSK over dedicated bus 514*b* as read data SD, obtains display data DATA by converting the read data SD using the shift clock SCL to the bit number or format of data bus 517, and sends the display data DATA with shift clock XSCK, the frequency of which is equal to the frequency of shift clock SCL, over data bus 517 to X drivers 250-1~250-N.

The operation of module controller 500 is described with reference to FIG. 31. Low frequency oscillator 110 and timing signal generator 120 in the module controller 500 are normally operating, but it is not necessary for high frequency oscillator 140 to operate constantly because frame memories 252-1~252-N storing the input display data DATA are built in to X drivers 250-1~250-N. High frequency oscillator 140 therefore operates intermittently, operating only when the display data in VRAM 512 is updated.

Low frequency oscillator 110 constantly outputs the low frequency clock $f_L$, and frequency divider 121 of timing signal generator 120 frequency divides the low frequency clock $f_L$ at the specified ratio to generate the latch pulse LP. The latch pulse LP is emitted twice per one horizontal period (1H) at a maximum frequency of 32 kHz~80 kHz for a 640×480 pixel monochrome display. Vertical counter 122 counts the latch pulses LP to generate the line address signal RA and frame start pulse YD, and frame counter 123 counts frame start pulse YD to generate the liquid crystal current alternating signal FR. In this embodiment, the low frequency timing signals (latch pulse LP, frame start pulse YD, and liquid crystal current alternating signal FR) required by LCD module 200 are generated by timing signal generator 120. When host MPU 510 completely changes the display data of VRAM 512 during the refresh operation or partially changes the data when using a frame sampling gradation display, host MPU 510 sets the transfer command flag in the corresponding address of line flag register 132 via system bus 514*a* and system bus interface circuit 131. Because the line address signal RA from vertical counter 122 is updated each time the latch pulse LP is generated, comparator 133 emits coincidence signal j when line address signal RA coincides with the flag address of the set transfer command flag. The coincidence signal j is input to synchronization adjuster 134, and the intermittent operation start control signal $\overline{ST}$ rises for one horizontal period synchronized to the drop of the latch pulse LP as shown in FIG. 31. When the intermittent operation start control signal $\overline{ST}$ rises, the oscillation control signal CT output from AND gate 141 rises, causing one input to the AND gate 142*a* at the first stage of the CR oscillator to be high. The CR oscillator therefore begins outputting a high frequency oscillation clock $f_H$ according to the feedback constant defined by the combination of open and closed resistance selection switches $SW_1$~$SW_4$. The high frequency clock $f_H$ is supplied through inverter 143*a*, AND gate 143*b*, and inverter 143*e* to preset counter 143*c*, and is output as shift clock SCL from AND gate 144. This shift clock SCL is a high frequency clock used for DMA circuit 150 display data reading and transferring.

Figure 31:
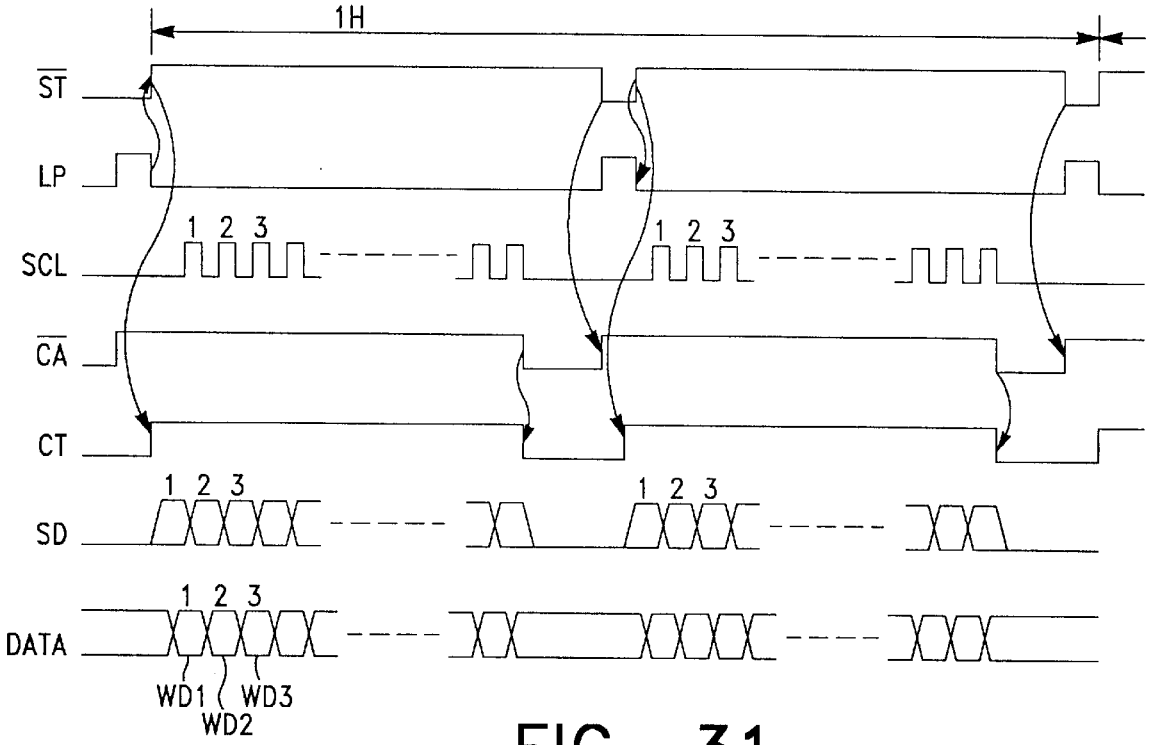
FIG. 31 is a timing chart used to describe the operation of the above module controller.

Preset counter 143*c* is reset at the drop of the intermittent operation start control signal $\overline{ST}$ and the carrier output CA drops to a low level, but when the count rises to the clock count specified by clock frequency register 143*d*, a high level carrier output CA is output, and the inverted signal of the high level carrier output CA, i.e., the intermittent operation end control signal $\overline{CA}$, drops as shown in FIG. 31. When the intermittent operation end control signal $\overline{CA}$ drops, the oscillation control signal CT also drops, and variable frequency CR oscillator 142 stops oscillating. As a result, variable frequency CR oscillator 142 oscillates intermittently, oscillating only during the period of which the start and end times are defined by the intermittent operation start control signal $\overline{ST}$ and intermittent operation end control signal $\overline{CA}$, and generates the number of high frequency clock $f_H$ signals required to transfer the display data for one scan line as specified by clock count register 143*d*. As a result, when there is no change in the display data, unnecessary oscillation by variable frequency CR oscillator 142 can be eliminated, thus contributing to reduced power consumption.

When coincidence signal j is output from comparator 133 of standby circuit 130, DMA controller 151 of DMA circuit 150 outputs the read clock RSK over dedicated bus 514*b* using the high speed clock SCL. The display data (new display data) of the overwrite address in VRAM 12 is thus read as shown in FIG. 31, and input to data conversion circuit 152 as read data SD. The read data SD is converted to the bit number or format of data bus 517, and the display data DATA and shift clock XSCK with a frequency equal to the clock SCK are transferred over data bus 517 to X drivers 250-1~250-N. DMA controller 151 also sends the corresponding flag address signal and flag preset signal to line flag register 132, clearing the transfer command flag of the flag address for the display data read into data conversion circuit 152. When the next line address signal RA is generated, the above operation is repeated by the next high speed clock SCK, and transfer of two lines of display data DATA is completed in one horizontal period. When one scan line of display data DATA is transferred, the inverted carrier signal $\overline{CA}$ is a low level signal, causing the transfer operation to pause. However, since the transfer data is stored in the frame memories 252-1~252-N of the X drivers 250-1~250-N, there is no affect on the display even if the shift clock XSCL is turned on and off each scan line.

By providing frame memories 252-1~252-N in the X drivers 250-1~250-N, and providing low frequency oscillator 110 and intermittently operating high frequency oscillator 140, it is possible to restrict transfer of the display data for each scan line to the frame memories 252-1~252-N, to only when the display data in VRAM 512 is changed. Because constant operation of the high frequency oscillator 140 is thus eliminated, total power consumption can be significantly reduced unless the display data is changed.

This intermittent operation is compatible with frame sampling gradation displays and displays with a small moving image area in the display, and offers good compatibility with existing display systems.

It is to be noted that high frequency oscillator 140 of module controller 100 features variable frequency CR oscillator 142, but it can also be constructed with a phase synchronized circuit (PLL) generating a high frequency clock synchronized to the latch pulse LP. In this case, the high frequency clock is obtained from the output of a voltage controlled oscillator in the phase synchronized circuit.

In addition, high frequency oscillator 140 can also be replaced by an external high frequency clock source rather than being built into module controller 100. Alternatively, module controller 100 can be integrated onto the same chip as host MPU 510 or VRAM 512, thereby reducing the number of connection buses.

Multiple Line, Selection Drive Method

The construction and operation of the X driver (signal electrode drive circuit) 250 is described next. Preceding this description, however, the principle of multiple line selection method described above, on which the invention is based is described again in order to simplify understanding of the X driver construction. This is necessary because the simple matrix-type liquid crystal display of the invention is based on an improvement of the method of simultaneously selecting plural scan electrodes, i.e., the multiple line selection method, rather than the conventional voltage averaging liquid crystal drive method.

Figure 32:
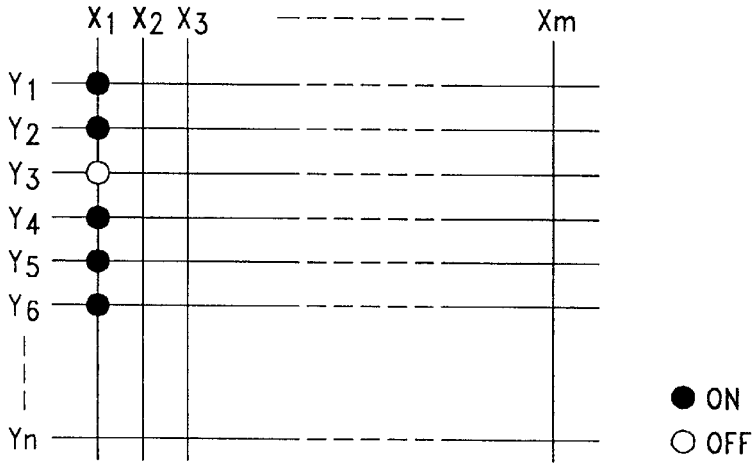
FIG. 32 is an illustration of sample pixel on/off states in a simple matrix-type liquid crystal display apparatus.

When driving a simple matrix-type liquid crystal display element as shown in FIG. 32 by the voltage averaging multiplex drive method, the scan electrodes $Y_1, Y_2, \ldots Y_n$ are usually sequentially selected one by one, and the scan voltage is applied. At the same time, the signal electrode wave is applied to the signal electrodes $X_1, X_2, \ldots X_m$ according to the on/off state of the various elements on the selected scan electrode to drive the liquid crystal elements.

An example of the applied voltage wave is shown in FIGS. 33A–33D. FIGS. 33A and 33B are the voltage waves applied to scan electrodes $Y_1$ and $Y_2$, respectively, FIG. 33C is the voltage wave applied to signal electrode $X_1$, and FIG. 33D is the combined voltage wave applied to the pixel at the intersection of scan electrode $Y_1$ and signal electrode $X_1$.

Figure 34:
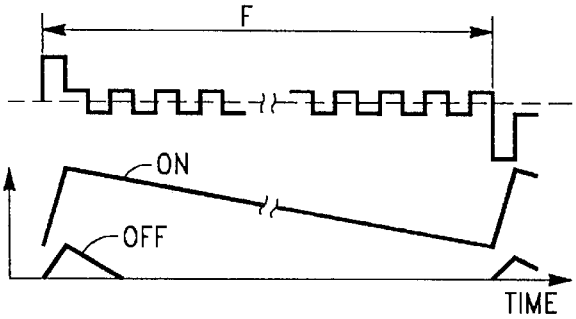
FIG. 34 is a waveform diagram of the on/off characteristics of the liquid crystal pixels in a multiplex drive method using voltage averaging.

In this drive method sequentially selecting the scan electrodes one line at a time, the drive voltage is relatively high. In addition, a relatively high voltage is applied even in the off state as shown in FIG. 34, and high attenuation of the voltage in the on state results in poor contrast. Noticeable flicker during frame gradation is another problem.

A so-called multiple line selection drive method whereby plural sequential scan electrodes are simultaneously selected and driven has therefore been proposed as a means of improving contrast and reducing flicker. (See *A Generalized Addressing Technique Forms Responding Matrix LCDs* (1988, International Display Research Conference, pp. 80~85).

FIGS. 35A–35D show an example of the applied voltage wave when driving the liquid crystal elements using the above multiple line selection method. In this example, three scan electrodes are simultaneously selected and driven. In a pixel display as shown in FIG. 32, the first three scan electrodes $Y_1$, $Y_2$, $Y_3$ are simultaneously selected, and a scan voltage as shown in FIG. 35A is applied to the scan electrodes $Y_1$, $Y_2$, $Y_3$.

The next three scan electrodes $Y_4$, $Y_5$, $Y_6$ are then selected, and a scan voltage pattern as shown, for example, in FIG. 35B is applied. This operation is sequentially executed for all scan electrodes $Y_1, Y_2, \ldots Y_n$. The potential is then reversed at the next frame, thus enabling alternate current driving of the liquid crystals.

In the conventional voltage averaging drive method, one scan electrode is selected once in each single frame period. In the multiple line selection method the selection time is evenly distributed on a time basis in one frame, retaining the normal orthogonality of the scan selection method while simultaneously selecting a specific number of scan electrodes as a block with a spatial distribution. "Normal" here means that all scan voltages have the same effective voltage (amplitude) in one frame period. "Orthogonal" means that the voltage amplitude applied to any given scan electrode added to the voltage amplitude applied to another scan electrode during one selection period equals zero (0) in one frame period. This normal orthogonality is the major premise for independent on/off control of each pixel in a simple matrix LCD. For example, referring to the example in FIGS. 35A–35D, if the level of $V_1$ is 1 and $-V_1$ is $-1$ when selected, the line-column equation $F_3$ for one frame can be abbreviated as $$F_3 = \begin{bmatrix} 1 & 1 & -1 & 1 \\ 1 & -1 & 1 & 1 \\ -1 & 1 & 1 & 1 \end{bmatrix} = (f_{ij}) \qquad \text{Eq. 1}$$

because the nonselected period is 0. For example, the orthogonality of the first line ($Y_1$) and second line ($Y_2$) is verified as $$\sum_{j=1}^{4} f_{1j} \times f_{2j} = 1 + (-1) + (-1) + 1 = 0 \qquad \text{Eq. 2}$$

A detailed description of orthogonality is simplified below because of the mathematical content. It is sufficient to note that when driving liquid crystals, the low frequency component is a cause of flicker. As a result, it is necessary to select the minimum number of lines and columns necessary to maintain orthogonality when simultaneously selecting h lines. In general, when simultaneously selecting h lines, the minimum number of columns required in the distributed selection (the "minimum required distributed selection number") in one frame, equivalent to the number of columns in the above column/line equation (1), is the value $2^n$ where n is a natural number and the equation $$2^{n-1}(h \leqq 2^n$$

is true. For example, the minimum required distributed selection number for simultaneous selection of three lines shown in FIG. 36 is 4. When $h=2^n$, the single selection period $\Delta t$ is equal to the single selection time (1H) in the voltage averaging method.

In the signal voltage waveform, one level of the (h+1) distributed voltage levels is determined according to the display data. In the voltage averaging method, the signal electrode (line) waveform corresponds directly to the single line selection waveform as shown in FIG. 33, and one of the two levels (corresponding to on/off levels) is output. When h lines are simultaneously selected as shown in FIGS. 35A–35D, it is necessary to output an equivalent on/off voltage level for the line selection wave in a set of h lines. This equivalent on/off voltage level is determined by the anti-coincidence C between the signal electrode data pattern ($S_{1d}$, $S_{2d}$ . . . $S_{hd}$) and the column pattern (scan electrode selection pattern) of the above row/column equation when the values of the on display data and off display data are "1" and "0", respectively.

$$C = \sum_{i=1}^{h} (f_{il} \oplus S_{il}) \qquad \text{Eq. 3}$$

Note, however, that where the value of $f_{i1}$ in Eq. 1 is "1," a value of "0" is used in Eq. 3.

The value of C above ranges from 0 to h. In the voltage averaging method, the value of C ranges from 0 to 1 because the value of h=1. In the example shown in FIGS. 35A–35D, the signal electrode data pattern and X driver output potential are as shown in Table F. The number of data patterns for each anti-coincidence number shown in Table F is the same for each column. As a result, if the column pattern is determined, the output potential of the X driver can be determined by directly decoding the X driver output potential from the anti-coincidence number or signal electrode data pattern. Specifically, the signal electrode voltage wave shown in FIG. 35C is obtained.

TABLE F

| Anti-coincidence | Signal Electrode Data Pattern | No. of Data Patterns | X Driver Output Voltage |
|---|---|---|---|
| C = 0 | (1,1,1) | 1 | $-V_3$ |
| C = 1 | (0,1,1) (1,0,1) (1,1,0) | 3 | $-V_2$ |
| C = 2 | (1,0,0) (0,1,0) (0,0,1) | 3 | $V_2$ |
| C = 3 | (0,0,0) | 1 | $V_3$ |

Display of the intersecting pixels of signal electrode $X_1$ and scan electrodes $Y_1$, $Y_2$, and $Y_3$ in FIG. 32 is, in sequence, 1 (on), 1, 0 (off). The corresponding potential values of the scan electrodes during the initial $\Delta t$ are, in sequence, 1 ($V_1$), 1, 0 ($-V_1$). Because the anti-coincidence number is therefore zero, the output potential during the initial $\Delta t$ is of signal electrode $X_1$ is $-V_3$ (see Table F). The output potential wave for each signal electrode is similarly applied to each of the pixels. Shown in FIG. 35D is the voltage wave applied to the pixels at the intersection of the scan electrode $Y_1$ and signal electrode $X_1$, i.e., the combination of the voltage wave applied to the scan electrode $Y_1$ and the voltage wave applied to the signal electrode $X_1$.

As described above, the method whereby plural sequential scan electrodes are simultaneously selected and driven achieves the same on/off ratio as the conventional method whereby the lines are selected one by one as shown in FIG. 33, but also offers the advantage of minimizing the drive voltage on the X driver side. For example, if the liquid crystal threshold value $V_{TH}$ is 2.1 V and the duty ratio is 1/240, the maximum drive voltage amplitude on the X driver is approximately 8 V. This means it is not necessary to use a high voltage resistance integrated circuit for the X driver. This makes it possible to apply higher resolution semiconductor manufacturing processes than is possible with the conventional method, and makes it possible to economically increase the bit number of the built-in RAM of the X driver.

The applicant for the present invention has previously described the multiple line selection drive method described above in Japanese patent application 1992-143482. In the uniform distribution, multiple line selection drive method, the matrix display device using is characterized by a drive circuit for simultaneously selecting sequential plural scan electrodes, and dividing the selection period to apply a voltage plural times within one frame. In other words, rather than selecting the display lines once per frame (period hΔt), the display is driven by dividing each frame into plural selection periods, and the voltage is thus applied plural times within a single frame. The voltage is thus applied plural times to each pixel in one frame, thereby maintaining brightness and suppressing the drop in contrast. The resulting effect is especially significant when used in high speed response liquid crystal panels with a low cumulative response effect.

As shown in FIG. 36, the nonselected period (the time from first selection of a given scan electrode until the same scan electrode is selected again) is shortened, the on state is brighter, the off state is darker, and contrast is therefore increased when compared with the conventional example shown in FIG. 34. Flicker can also be reduced. Thus, the improved multiple line selection drive method distributes output of the plural scan electrode pulse patterns rather than outputting the pulse patterns in a batch. It is to be noted that any sequence can be used for outputting the selection pulse of each selection period in this embodiment, and the sequence can be changed as needed within one frame. In addition, four column patterns are each separated into four parts, but any other plural combination, for example two patterns separated into two parts, can also be used.

Before getting too deep into a discussion of the multiple line selection drive method, description of the driver is resumed. It should be noted, however, that the LCD of the present embodiment uses a uniform distribution, multiple line selection drive method and the driver has a built-in frame memory, but is controlled by module controller 100. It should therefore be understood that the driver must meet the requirements of both.

Description of the Scan Electrode Drive Circuit (Y driver)

Figure 37:
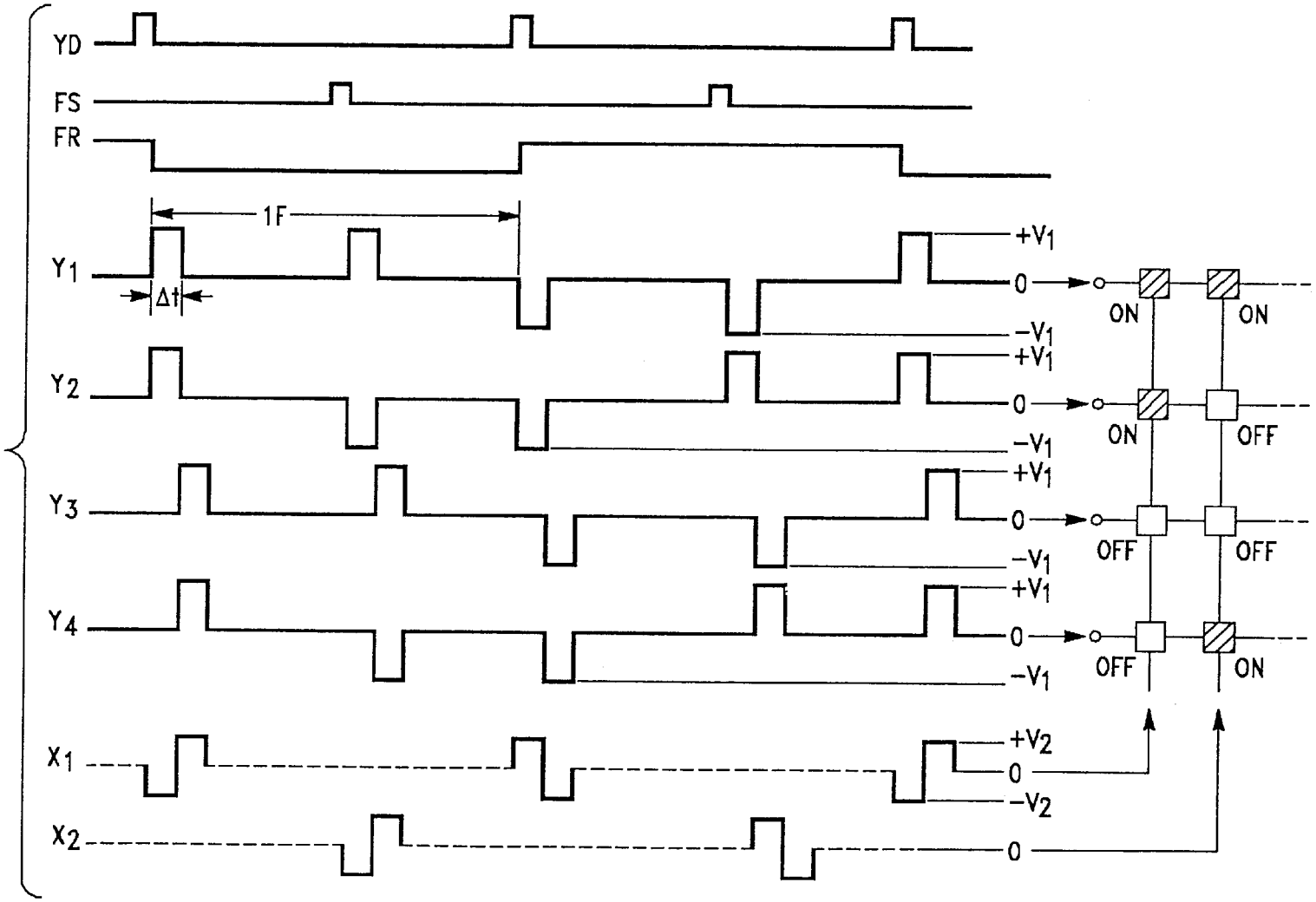
FIG. 37 is a waveform diagram of the scan electrode wave and signal electrode wave in the distributed 2-line selection drive method used in the present embodiment.

In the multiple line selection drive method of the driver described below, the number of simultaneously selected scan electrodes is defined as the smallest possible number, i.e., h=2, in order to simplify understanding of the circuit function. Therefore, as shown in FIG. 37, the column pattern of the scan electrode wave is equal to $2^1$=2 columns only. By applying two different pulse patterns to two successive scan electrodes, one frame consists of two fields (2 vertical scans). If the total number of scan electrodes is 120, there will be 60 2-scan electrode blocks to be simultaneously selected. The nonselected period for any given block from the application of two different pulse patterns to the application of the next two different pulse patterns is (60−1) Δt=59Δt. One frame is completed in 120Δt where Δt is equal to one selection period (one horizontal period).

Figure 38A:
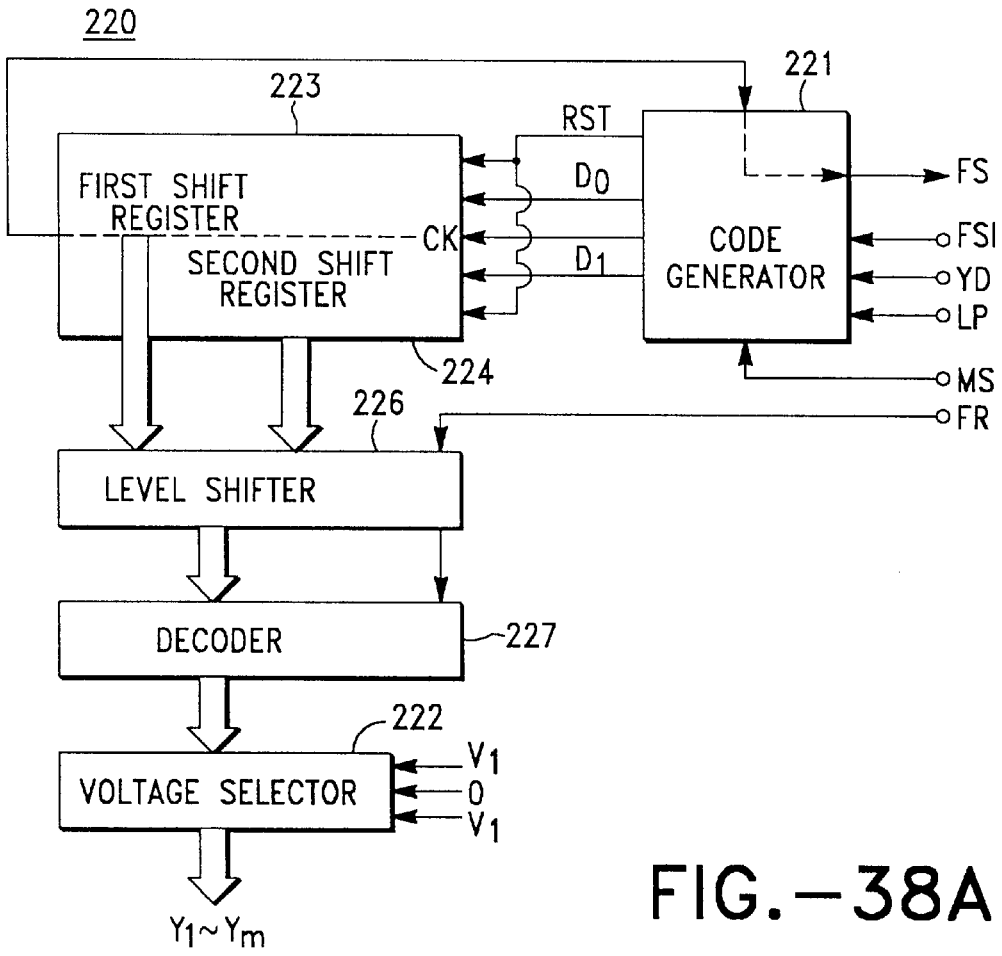
FIG. 38A is a block diagram of the scan electrode drive circuit (Y driver) in a simple matrix-type liquid crystal display apparatus according to the present embodiment.
Figure 38B:
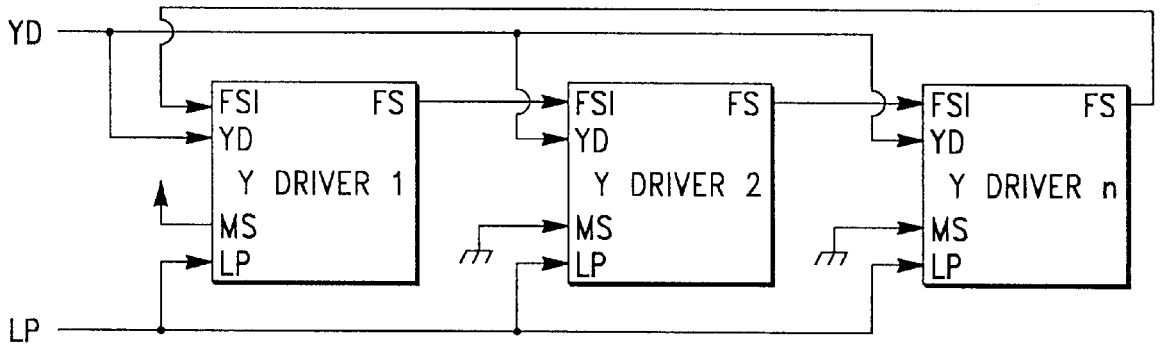
FIG. 38B is a block diagram of plural Y drivers cascade connected.

As shown in FIGS. 38A and 38B, Y driver IC 220 is a semiconductor integrated circuit comprising code generator 221 for generating the column pattern of each field based on frame start pulse YD and the latch pulse LP. The voltage applied to scan electrodes $Y_1$~$Y_n$ in this embodiment has three possible levels: $V_1$ or $-V_1$ in one selection period, and 0 V during the nonselected period. The selection control information for voltage selector 222 must have two bits for each of the scan electrodes $Y_1$~$Y_n$. Code generator 221, required for multiple line selection, therefore initializes the field counter (not shown in the figures) and first and second shift registers 223, 224 at frame start pulse YD, and outputs the 2-bit voltage selection codes $D_0$, $D_1$ corresponding to the selected column pattern for the first field to the series-parallel conversion first shift register 223 and second shift register 224. Both shift registers 223, 224 are 120-bit shift registers, corresponding to the number of scan electrodes. First shift register 223 stores the least significant bit (voltage selection code $D_0$), and second shift register 224 stores the most significant bit (voltage selection code $D_1$), based on the same shift clock CK. The shift clock CK is the ½-frequency divided latch pulse LP, and is generated by the timing signal generator (not shown in the figures) of code generator 221. During the period from the second clock count of the latch pulse LP to the end of the first field, code generator 221 generates the code for the nonselected pattern. Because parallel 120-bit shift registers 223, 224 operating at the same shift clock CK are provided instead of a single 240-bit shift register for the shift clock CK, the shift registers can operate at a lower frequency based on the latch pulse LP, and operation at an extremely low power consumption level is possible.

The voltage selection codes $D_0$, $D_1$ output by first and second shift registers 223, 224 are shifted to the adjacent bit when the shift clock CK is output, and output is held for the selection period Δt only. The shift register output is sent to level shifter 226 for conversion from a low logic amplitude level to a high logic amplitude level. The voltage selection codes $D_0$, $D_1$ output as a high logic amplitude level from level shifter 226 are supplied together with the liquid crystal current alternating signal FR, which was simultaneously level converted, to decoder 227, which functions as a wave shaper, for generation of the selection control signal. By controlling voltage selector 222 with this selection control signal, voltage $V_1$, 0, or $V_1$ is supplied to scan electrodes $Y_1$~$Y_n$.

As shown in FIG. 38B, it is assumed that the function of code generator 221 can be changed using selection terminals MS in the first stage Y driver 1 and each of the successive Y drivers 2~n so that plural Y drivers 1~n can be cascaded. In other words, in the first stage Y driver 1, the Y driver is first initialized at frame start pulse YD, and operation then shifts to the timing for generating the voltage selection codes used by the two shift registers 223, 224. Because the selection terminal MS is a low level input in the following stages, however, they do not automatically shift to the voltage selection code generating timing. Only after the first stage carrier signal FS is input to the FSI input terminal of the downstream Y drivers 2~n do the Y drivers output the voltage selection codes to the two shift registers 223, 224.

The first field ends when the carrier signal FS is output from the last Y driver n. Because the start signal for the second field is not input at this time, the carrier signal FS from the last Y driver n is fed back to the FSI terminal of the first Y driver 1 and to the FS terminal of the X driver, and the voltage selection code for the second field is generated for the two shift registers 223, 224. The same operation described above is then executed for the second field, and operation then shifts to the next first field.

This function alleviates the restrictions on the number of simultaneously selected lines for the controller and the number of Y driver terminals, and enables the use of the same-frequency frame start pulse YD and latch pulse LP as used in the conventional voltage averaging method.

Description of the Signal Electrode Drive Circuit (X driver)

Figure 39:
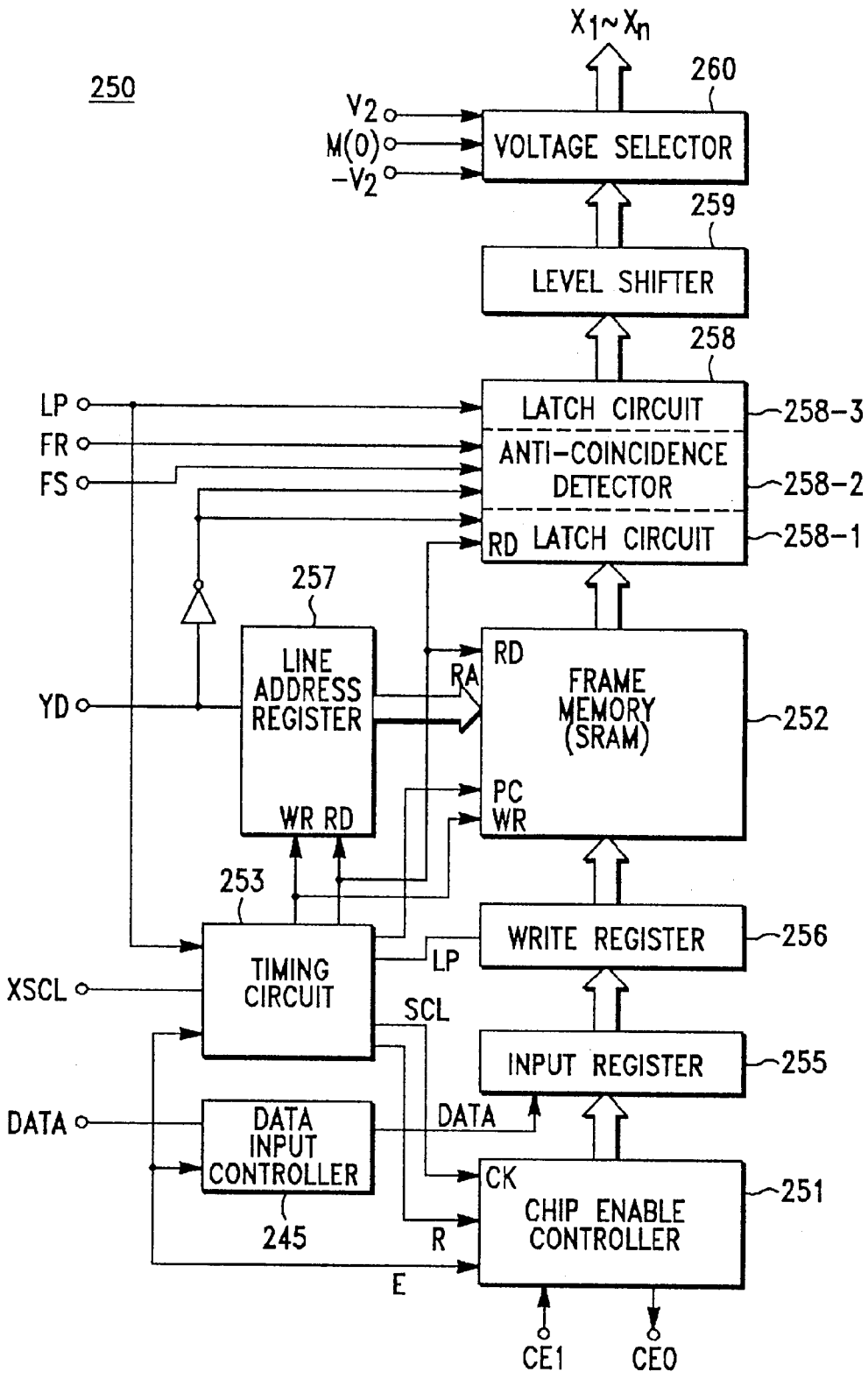
FIG. 39 is a block diagram of the signal electrode drive circuit (X driver) in a simple matrix-type liquid crystal display apparatus according to the present embodiment.

The plural X drivers 250-1~250-N are identically constructed semiconductor integrated circuits cascade connected by the chip enable output CEO and chip enable input CEI terminals as shown in FIG. 29. Unlike the conventional drives with built-in RAM, these X drivers 250-1~250-N do not share system bus 514 connecting directly to host MPU 510, but are simply connected to module controller 500 via data bus 517. As shown in FIG. 39, each of the X drivers 250-1~250-N comprises chip enable controller 251, timing circuit 253, data input controller 254, input register 255, write register 256, line address register 257, signal pulse assignment circuit 258, level shifter 259, and voltage selector 260.

Chip enable controller 251 is an active LOW automatic power saving circuit. Timing circuit 253 generates the required timing signals based on the signals supplied from primarily module controller 500. Data input controller 254 reads the display data DATA sent from module controller 500 at the enable signal E. Input register 255 sequentially reads the display data DATA (1 bit, 4 bit, or 8 bit) at each shift clock XSCL drop, and stores one scan line equivalent of display data DATA. Write register 256 batch latches one scan line equivalent of display data DATA from input register 255 at the latch pulse LP drop, and writes the data to the memory matrix of frame memory (SRAM) 252 within the write time, which is equal to or longer than one shift clock XSCL. Line address register 257 is initialized by the scan start signal YD, and sequentially selects the line (word bus) from frame memory 252 each time the write control signal WR or read control signal RD is applied. Signal pulse assignment circuit 258 assigns the drive voltage information for the signal electrodes corresponding to the combination determined by the display data from frame memory 252 and the scan electrode column pattern. Level shifter 259 converts the low logic amplitude level signal from signal pulse assignment circuit 258 to a high logic amplitude level signal. Voltage selector 260 selects voltage $V_2$, M (e.g., 0), or $-V_2$ based on the high logic amplitude level voltage selection code signal output from level shifter 259, and applies the selected voltage to the signal electrodes $X_1$ $X_n$.

Known technologies are used in chip enable controller 251, which controls the power save function separately for each driver chip, and the related circuit components. Chip enable controller 251 generates the internal enable signal for the enabled drivers only, thus causing the shift clock XSCL and display data DATA to be read into the enabled drivers, and controls operation of timing circuit 253 and data input controller 254. This control sequence is repeated at each latch pulse LP cycle. In other words, when the latch pulse LP is input, chip enable controller 251 switches all cascaded driver chips from the power save state to the standby state, and the chip enable output CEO becomes HIGH. Which drivers are enabled or set to the power save state is determined by the state of chip enable input CEI. In the embodiment of FIG. 1, chip enable input CEI of X driver 250-1 is grounded (active). The internal enable signal E therefore becomes active, and the shift clock XSCL and display data DATA are read into the driver. Chip enable controller 251 switches the chip enable output CEO from a HIGH to a LOW level when the number of shift clocks required to read the display data equal to the bit capacity of input register 255 has been input. The chip enable input CEI for the next-stage X driver 250-2 cascade connected to first X driver 250-1 therefore becomes LOW, causing the internal enable signal E of the next-stage driver to become active. This same operation is repeated for each of the cascaded X drivers. As a result, chip enable input CEI for the third to nth X drivers 250-3~250-n is sequentially set to a LOW level, and the display data is read into the corresponding input register 255.

As a result, there is only one X driver reading the display data at any one time and the power consumption required for display data reading can be minimized even when n X drivers are cascaded.

Figure 40:
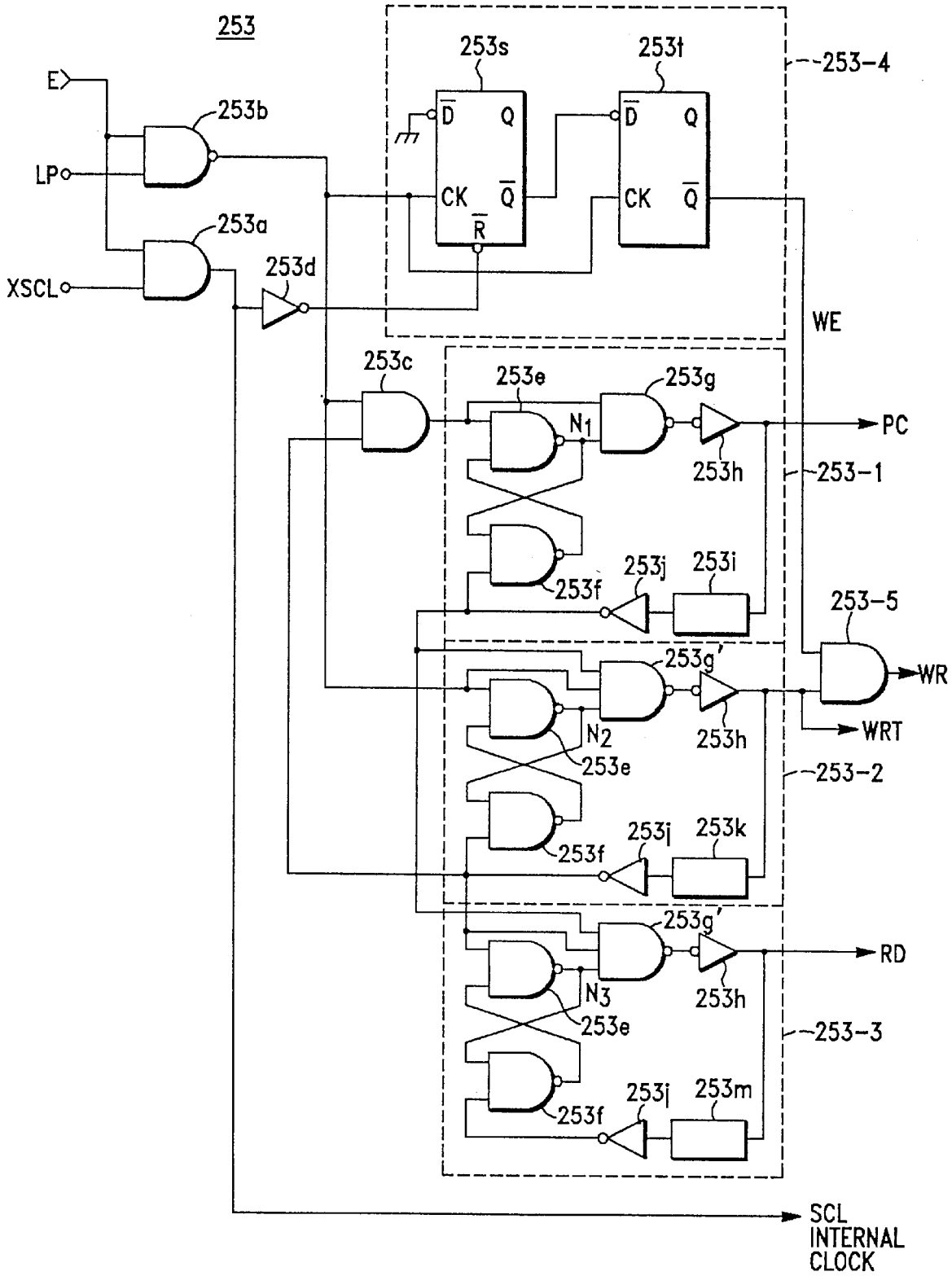
FIG. 40 is a detailed block diagram of the timing circuit in the signal electrode driver (X driver).

Time circuit 253 is described below with reference to FIG. 40 while omitting part of the detailed description. As shown in FIG. 40, timing circuit 253 comprises AND gate 253*a*, NAND gate 253*b*, AND gate 253*c*, inverter 253*d*, a first one-shot multi-vibrator 253-1, second one-shot multi-vibrator 253-2, third one-shot multivibrator 253-3, shift clock detector 253-4, and write prohibit AND gate 253-5.

AND gate 253*a* inputs the shift clock XSCL based on enable signal E response into timing circuit 253. AND gate 253*c* generates two precharged ready pulses within one latch pulse LP cycle based on the delayed inversion pulse of the latch pulse LP and write control signal WR input to timing circuit 253 through NAND gate 253*b* in response to the enable signal E.

First one-shot multi-vibrator 253-1 generates the precharged control signal PC of a predetermined pulse width at the rise of the AND gate 253*c* output pulse, thus functioning as the precharged control signal PC generator.

Second one-shot multi-vibrator 253-2 is cascade connected to first one-shot multi-vibrator 253-1, and generates the write control signal WR of a predetermined pulse width at the rise of the delayed inversion pulse of the precharge control signal PC and the inversion pulse of the latch pulse LP. Second one-shot multi-vibrator 253-2 thus functions as the write control signal WR generator.

Third one-shot multi-vibrator 253-3 is cascade connected to second one-shot multi-vibrator 253-2, and generates the read control signal RD of a predetermined pulse width at the rise of the delayed inversion pulse of the precharge control signal PC and the delayed inversion pulse of the write control signal WR. Third one-shot multi-vibrator 253-3 thus functions as the read control signal RD generator.

Shift clock detector 253-4 is reset by the inverse phase shift clock XSCL, which is inverted by inverter 253*d*, to detect shift clock XSCL input.

Write prohibit AND gate 253-5 passes or interrupts the write control signal WR input from second one-shot multi-vibrator 253-2 as controlled by the shift clock detection signal WE from the shift clock detector 253-4.

First one-shot multi-vibrator 253-1 comprises a flip-flop formed by NAND gates 253*e*, 253*f*, AND gate 253*c*, NAND gate 253*g*, inverter 253*h*, delay circuit 253*i*, NAND gate 253*f*, and inverter 253*j*.

The flip-flop formed by NAND gates 253*e*, 253*f* set node $N_1$ HIGH at the drop in the output of AND gate 253*c*.

NAND gate 253*g* and inverter 253*h* generate a HIGH precharge control signal PC when node $N_1$ is HIGH. Delay circuit 253i delays the precharge control signal PC assuming an equivalent signal delay time in frame memory 252. Inverter 253*j* inverts the precharge control signal PC, and applies the inverted signal to the RESET input of NAND gate 253*f*.

When the input to the SET input terminal of NAND gate 253*e* drops, node $N_1$ is set to a HIGH level, and when the AND gate 253*c* output next becomes HIGH, the precharge control signal PC rises. As a result, the NAND gate 253*f* RESET input drops after the delay time determined by delay circuit 253*i*, and node $N_1$ becomes LOW, thus causing the precharge control signal PC to drop. The precharge control signal PC pulse is generated twice during one latch pulse LP cycle because the AND gate 253*c* output rises at the latch pulse LP rise and at the rise of the delay signal for the write control signal WR.

Second and third one-shot multi-vibrators 253-2 and 253-3 are nearly identical in structure to first one-shot multi-vibrator 253-1, and like parts are therefore identified with like reference numerals in FIG. 40. Second one-shot multivibrator 253-2 differs from first one-shot multi-vibrator 253-1 in that NAND gate 253*g*' takes three inputs, the delayed inversion signal of precharge control signal PC, the inverted latch pulse LP signal, and node $N_2$ of NAND gate 253*e*, and delay circuit 253*k* delays write control signal WR assuming an equivalent signal delay time in frame memory 252. Node $N_2$ of NAND gate 253*e* is set HIGH at the drop in the latch pulse LP inversion signal, but the output of NAND gate 253*g*' drops at the first drop in precharge control signal PC (the first rise in the delayed inversion signal of precharge control signal PC). Write control signal WR thus rises, the RESET input to NAND gate 253*f* drops after waiting the delay time determined by delay circuit 253*k*, and node $N_2$ becomes LOW, thus causing write control signal WR to drop. The delayed inversion signal of the second precharge control signal PC then rises, but node $N_2$ remains HIGH because the latch pulse LP is LOW. The output of NAND gate 253*g*' therefore remains HIGH, and only one write control signal WR pulse is output, based on the drop in the first precharge control signal PC, during one latch pulse LP cycle.

Third one-shot multi-vibrator 253-3 differs from first one-shot multi-vibrator 253-1 in that NAND gate 253*g*' takes three inputs, the delayed inversion signal of precharge control signal PC, the delayed inversion signal of the write control signal WR, and node $N_3$ of NAND gate 253*e*, and delay circuit 253*k* delays the write control signal WR assuming an equivalent signal delay time in frame memory 252. Node $N_3$ of NAND gate 253*e* is set HIGH at the drop in the delayed inversion signal of the write control signal WR (the rise in the write control signal WR) occurring after the first drop in the precharge control signal PC (the first rise in the delayed inversion signal of the precharge control signal PC). As a result, the output of NAND gate 253*g*' drops at the first drop in the second precharge control signal PC (the first rise in the delayed precharge control signal PC inversion signal), and the read control signal RD rises. After the delay time determined by delay circuit 253*m*, the NAND gate 253*f* RESET input rises and node $N_3$ becomes LOW, thus causing the read control signal RD to drop. Only one read control signal RD pulse of the predetermined pulse width is therefore output, based on the drop in the second precharge control signal PC, during one latch pulse LP cycle.

Shift clock detector 253-4 comprises a D flip-flop 253*s* and D flip-flop 253*t*. D flip-flop 253*s* has three inputs, the inverse phase clock of the shift clock XSCL as the RESET input $\overline{R}$, a ground potential (i.e., LOW) as the data input, and a clock input. This LOW level is input at the rise of the latch pulse LP inversion clock, and stored as the data inversion input $\overline{D}$. D flip-flop 253*t* stores the inversion output $\overline{Q}$ of D flip-flop 253*s* as the data inversion input $\overline{D}$ at the rise of the latch pulse LP inversion clock.

When shift clock XSCL is input, D flip-flop 253*s* is reset at the first shift clock XSCL pulse, and the D flip-flop 253*s* output ($\overline{Q}$) is HIGH. Because the ground potential is stored as the data inversion input $\overline{D}$ to D flip-flop 253*s* at the latch pulse LP drop, the $\overline{Q}$ output becomes LOW and D flip-flop 253*t* stores the HIGH data inversion input $\overline{D}$ before $\overline{Q}$ changes, and the $\overline{Q}$ output, i.e., the shift clock detection signal WE, becomes HIGH. When the next shift clock XSCL is input, D flip-flop 253*s* is reset and the $\overline{Q}$ output of D flip-flop 253*s* is again HIGH. The shift clock detection signal WE output from D flip-flop 253*t* therefore remains HIGH for as long as the shift clock XSCL is input, continuity remains through write prohibit AND gate 253-5, and the write control signal WR from second one-shot multivibrator 253-2 continues to be input to the frame memory.

When input of the second shift clock XSCL stops, the $\overline{Q}$ output of D flip-flop 253*s* remains LOW according to the last shift clock XSCL pulse, and the latch pulse LP is input, the shift clock detection signal WE from D flip-flop 253*t* becomes LOW, write prohibit AND gate 253-5 closes, and the write control signal WR is interrupted.

Figure 41:
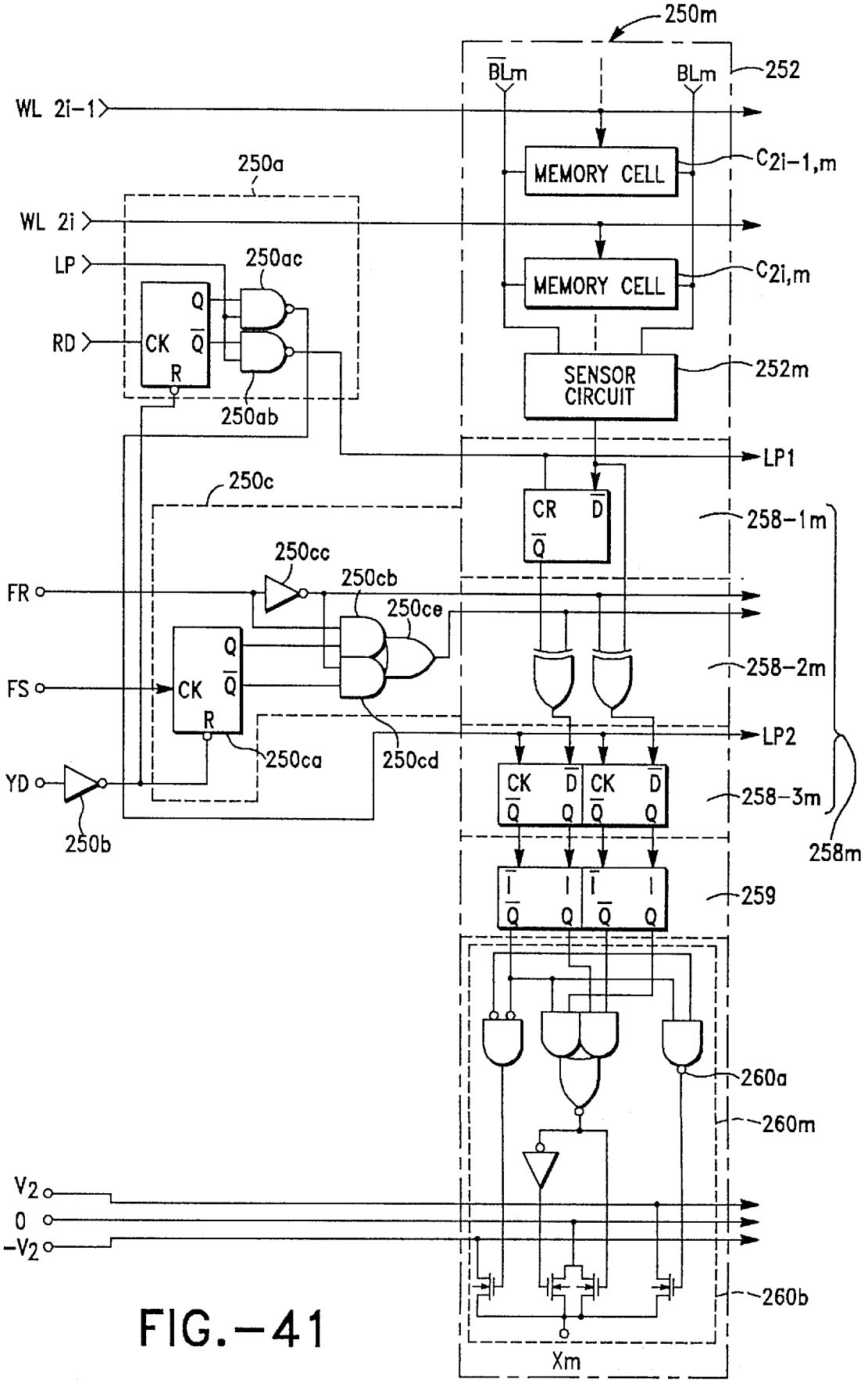
FIG. 41 is a block diagram of the peripheral circuits, signal pulse assignment circuit, level shifter, and voltage selector in the signal electrode driver (X driver), which are described by focusing on the m-bit circuit 250*m* for one signal electrode (one output $X_m$).

Referring to FIG. 41, the circuit configuration of one X driver 250, including the peripheral circuits, frame memory 252 and signal pulse assignment circuit 258, level shifter 259, and voltage selector 260, is described by focusing on the m-bit circuit 250*m* for one signal electrode (one output $X_m$). Memory cells $C_{2i-1,m}$, $C_{2i,m}$ are at the intersection of odd word bus $W_{2-1}$ and even word bus $W_i$ and bit buses $BL_m$ and $\overline{BL_m}$ in the frame memory 252 memory matrix, and store the display data (on/off data) for the corresponding pixels $P_{2i-1,m}$, and $P_{2i,m}$. When the latch pulse LP is generated, precharge control signal PC and write control signal WR or read control signal RD are generated from timing circuit 253. By applying the signals to frame memory 252, odd word bus $W_{2i-1}$ is selected by the line address decoder in frame memory 252 through sequential specification by line address register 257, and data is written to or read from memory cell $C_{2i-1,m}$. When the next latch pulse LP is generated, the even word bus $W_i$ is selected, and data is written to or read from memory cell $C_{2i,m}$. Note that the read operation is activated by applying the read control signal RD to sense circuit 252*m*, and the display data is thus output from the memory cell.

Due to the use of a two-line selection drive method as described above in the X driver 250 according to the present invention, it is necessary to determine the signal electrode potential from the display data and scan electrode column pattern for two lines in one horizontal period. An even/odd line discrimination circuit 250*a* (line number discrimination circuit for simultaneously selected lines) is provided in the peripheral circuitry.

This even/odd line discrimination circuit 250*a* comprises a D flip-flop 250*aa*, odd line detection NAND gate 250*ab*, and even line detection NAND gate 250*ac*. The D flip-flop 250*aa* is reset by the inverse phase pulse of frame start pulse YD input through inverter 250*b*, and inverts the stored contents each time the read control signal RD is input.

There are two inputs to odd line detection NAND gate 250*ab* and even line detection NAND gate 250*ac*, D flip-flop 250*aa* output $\overline{Q}$ and latch pulse LP, and D flip-flop 250*aa* output Q and latch pulse LP, respectively. When the odd line number latch pulse LP rises, output LP1 of odd line detection NAND gate 250*ab* drops; when the latch pulse LP drops, output LP1 rises. When the even line latch pulse LP rises, output LP2 of even line detection NAND gate 250*ac* drops; when the odd line number latch pulse LP drops, output LP2 rises. Outputs LP1 and LP2 are thus alternately output. Even/odd line discrimination circuit 250*a* generates latch pulses LP1 and LP2 for even and odd lines from the latch pulse LP generated by module controller 500.

Because the uniform distribution, 2-line selection drive method is used in the above embodiment, there are only $2^1=2$ voltage pulse patterns for the scan electrodes. Two fields are required to apply these patterns because two different column patterns are applied to two successive scan electrodes. However, because the current alternating signal FR inverts every frame, all column patterns can be applied in four fields. A field state circuit 250*c* specifying the potential pattern of the scan electrodes is therefore provided in the peripheral circuitry. This potential pattern information can be obtained from the scan electrode driver code generator 221 or module controller 100 rather than being generated in the X driver.

Field state circuit 250*c* comprises D flip-flop 250*ca*, AND gate 250*cb*, inverter 250*cc*, AND gate 250*cd*, and OR gate 250*ce*. D flip-flop 250*ca* is reset by the inverse phase pulse of frame start pulse YD, and inverts the stored data at each field start pulse FS input. AND gate 250*cb* takes two inputs, the Q output of D flip-flop 250*ca* and current alternating signal FR. AND gate 250*cd* also takes two inputs, the $\overline{Q}$ output of D flip-flop 250*ca*, and the current alternating signal FR after inversion by inverter 250*cc*. The outputs from AND gates 250*cb*, 250*cd* are input to OR gate 250*ce*.

The display data (on/off information) from memory cell $C_{2i-1,m}$ is input to one bit latch circuit 258-1*m* of signal pulse assignment circuit 258 at latch pulse LP1 generated during odd line reading, and is supplied to the least significant bit exclusive OR gate $EX_1$ of anti-coincidence detector 258-2*m*. The display data (on/off information) from memory cell $C_{2j,m}$ is then supplied to the most significant bit exclusive OR gate $EX_2$ of anti-coincidence detector 258-2*m* at the following even line latch pulse LP2.

Because the latch pulses LP1 and LP2 are alternately output, the latch period of the latch circuits 258-1, 258-3 have an alternately overlapping period, and the display data (on-on, on-off, off-on, off-off) from both memory cells is simultaneously supplied to the anti-coincidence detector 258-2*m*. Because the information equivalent to the column pattern for two scan electrodes is also supplied to anti-coincidence detector 258-2*m*, anti-coincidence detector 258-2*m* detects the column anti-coincidence of the 2-bit display data and 2-bit scan electrode data. Because two bits are output when two lines are simultaneously selected, the output from anti-coincidence detector 258-2*m* can be directly processed as the coded anti-coincidence value.

In this embodiment there are three possible anti-coincidence values: 0, 1, or 2. The 2-bit data obtained by anti-coincidence detector 258-2*m* is input to latch circuit 258-3, and the anti-coincidence signal is converted to a high logic amplitude signal by level shifter 259*m*. Decoder 260*a* of voltage selector 260*m* decodes the anti-coincidence signal, and opens or closes one of the transistors in selector switch 260*b* to select signal electrode potential $-V_2$, 0, or $V_2$. In this embodiment, $-V_2$ is selected when the anti-coincidence value is 0, 0 when the anti-coincidence value is 1, and $V_2$ when the anti-coincidence value is 2. Uniform distribution, 2-line selection and drive is thus possible with an X driver configured as described above.

It is to be noted that the circuit can also be configured to directly decode the drive data from the frame memory output and field state circuit 250*c* output without using anti-coincidence evaluation.

While the structure and operation of the various components of the X driver in this embodiment may be understood from the above description, the frame memory write and read operations are further described below with reference to the timing chart in FIG. 42.

Figure 42:
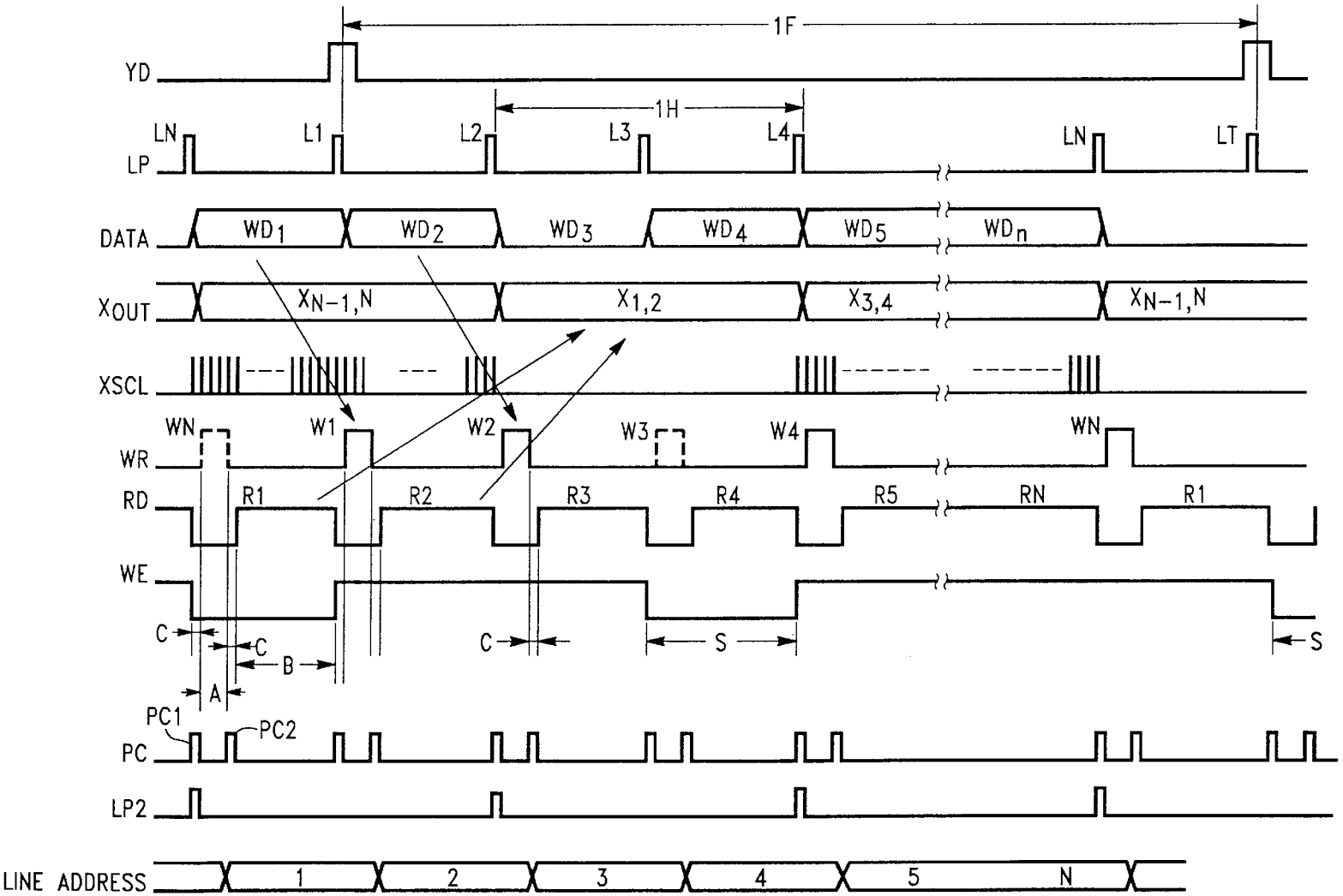
FIG. 42 is a timing chart used to describe the write operation and read operation in the signal electrode driver.

Frame start pulse YD and latch pulse LP as shown in FIG. 42 are generated by timing signal generator 120 of module controller 500. Frame start pulse YD is generated once each frame period (1F), and the latch pulse LP is generated twice each horizontal period (1H). N latch pulses LP are generated during one frame period. In one latch pulse LP period, one scan line equivalent of display data DATA ($WD_i$) is sent from module controller 500 to X driver IC 250 based on the shift clock XSCL. The read/write operation when the display data DATA stored in VRAM 12 is changed for all scan lines other than the third scan line (display data WD3) is shown in FIG. 14. The display data WD3 for the third scan line is therefore not transferred again, and the display operation for the third scan line is completed by reading the old data from frame memory 252.

Read control signal RD, shift clock detection signal WE, and write control signal WR shown in FIG. 42 are generated by timing circuit 253 of X driver IC 250. When transfer of the new data WD2 to X driver IC 250 is completed by module controller 500, shift clock XSCL transfer is also interrupted. The next step is transfer of new data WD4 and shift clock XSCL generation. When shift clock XSCL is interrupted, module controller 500 enters the standby period S as described above. This is detected by shift clock detector 253-4 of timing circuit 253, and the shift clock detection signal WE is not output. As a result, it is not just the write control signal (W3) that is not generated. When the first latch pulse (LN) is emitted, the display data (WD1) for the first line is input to X driver IC 250 within the period before the next latch pulse (L1) is generated (within latch pulse one cycle), input to write register 256 at the latch pulse (L1), and written to the corresponding address in frame memory 252. The old data for the first line is also read from frame memory 252 within the period between the first latch pulse (LN) and the next latch pulse (L1). When the latch pulse LP is generated, the first precharge control signal PCd (period C) is asserted and then the write control signal WR (period A) is emitted. The read control signal RD (period B) is asserted after the second precharge control signal PC2 (period C) is emitted. If the shift clock XSCL is not active, however, the write mode is disabled, and read control signal R1 therefore causes the old data for the first line to be read.

The line address of the first line is specified by line address register 257 during this read operation. The old data for the first line is read from frame memory 252 based on the odd number latch pulse LP1 resulting from the next latch pulse (L1), and the old data is thus stored in latch circuit 258-1*m* and sent to the least significant bit exclusive OR gate $EX_1$. After latching the old data for the first line, the new data WD1 for the first line is written to the frame memory based on the next latch pulse (L1). When writing the display data for a 640-dot line to frame memory 252, one complete line is batch written from write register 256, which is used as a buffer, over a period of several microseconds rather than writing the data from input register 255 at a shift clock XSCL of several hundred nanoseconds. While a faster write time is required as the display capacity increases, it is preferable for the write operation to access data from write register 256 at the latch pulse. During the period of latch pulse L2, the new data WD1 for the first line is written, and then the old data for the second line is read based on the read control signal R2 and transferred to the most significant bit exclusive OR gate $EX_2$. At the even line latch pulse LP2, the 2-bit anti-coincidence data obtained by anti-coincidence detector 258-2 is latched by latch circuit 258-3, the appropriate signal voltage is selected by voltage selector 260 as described above based on the anti-coincidence value, and the signal electrode potential for the first and second scan lines is applied to the liquid crystal matrix.

As thus described, frame memory 252 according to the present invention provides a write mode and a read mode for a single line address within the period of one latch pulse, and writes the new data at the next latch pulse after reading the old data. As a result, the period from display data writing to reading is one frame period (1F). This is needed for the use of a multiple line selection drive method. This is because anti-coincidence detector 258-2 will cause a signal electrode drive wave resulting in an unintelligible display state based on the old data line and new data line if there is a partial change in the frame memory data during the period in which the display data, which determines the signal electrode drive wave, is read. One frame period (1F) is required from display data writing to reading because there are cases in which all lines will be simultaneously selected. To therefore avoid an unintelligible display state as may occur when scrolling the display, it is sufficient to read the data after one frame period (1F) irrespective of the number of lines selected. At the same time, however, one frame period (1F) is not needed when the number of selected lines is small.

It is also possible to execute the write operation after the read mode to the same line address during one latch pulse LP period. If the write operation follows the read mode, however, timing to assure sufficient write time and for auto-power save operation will be more difficult because writing to the frame memory is executed from write register 256 at the latch pulse LP timing rather than at the shift clock XSCL timing in order to assure sufficient write time in this embodiment. This read-write mode sequence is particularly difficult when using the multiple line selection drive method because the latch pulse and shift clock must be several times faster than in conventional methods. In a large capacity display, this sequence becomes even more difficult. It is therefore preferable to execute the read mode one or plural times after a write operation to the same line address within the period of one latch pulse, and to write the new data one frame period after reading the old data.

The frequency dividing ratio of timing signal generator 120 in module controller 500 is set to generate two latch pulses LP during one horizontal period in the above embodiment because it is necessary to read two lines of display data from the frame memory within one horizontal period due to the use of the uniform distribution 2-line, selection drive method. This is also because the most common cell arrangement in the memory matrix of the frame memory is assumed, specifically, the number of signal electrodes in the display matrix is equal to the number of column addresses in the frame memory, and the number of scan electrodes is equal to the number of line addresses. However, if a RAM device is used wherein the number of column addresses in the frame memory is twice the number of signal electrodes in the display matrix, and the number of line addresses is half the number of scan electrodes (the number of clock signals) as shown in FIG. 33, it is possible to use a latch pulse LP generated once during one horizontal period as in conventional devices. In other words, if the read mode is activated by the latch pulse LP, display data for both the first and second lines is output simultaneously through sense circuit 252*m* from the memory cells $C_{2i,2m}$, $C_{2i,2m+1}$ associated with the odd word bus $WL_{2i}$ of the frame memory, for example, and only one latch pulse LP is required to read two lines of display data. In this type of circuit configuration, latch circuit 258-1m (shown in FIG. 41) used to hold one line of display data until the second line of display data is output can be eliminated. This simplifies the driver cell circuit construction without complicating the timing adjustment of the high speed first latch pulse LP1 and second latch pulse LP2, and thus contributes to the practical viability of the multiple line selection drive method.

Figure 43:
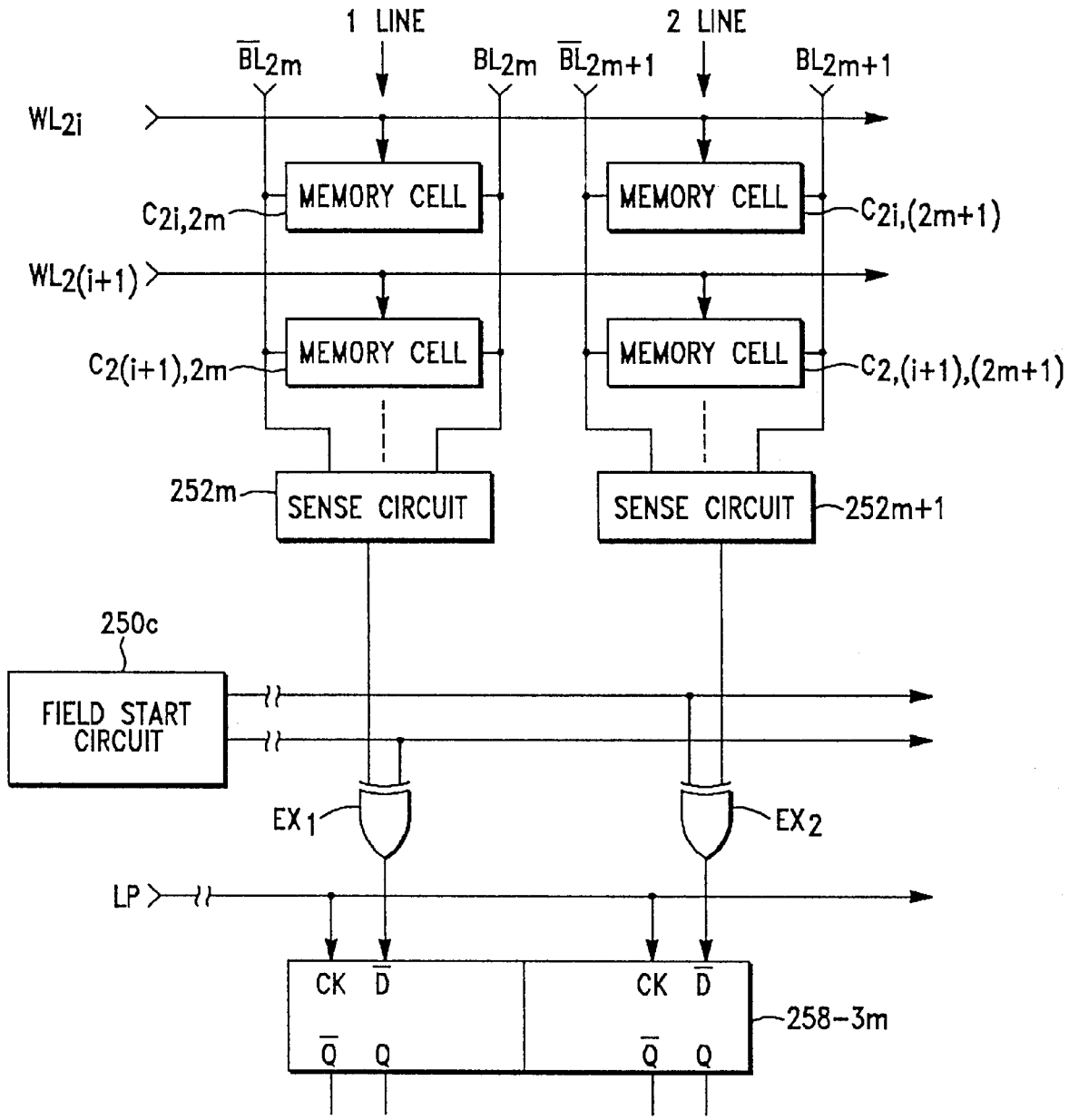
FIG. 43 is a block diagram of an alternative frame memory for the signal electrode driver.
Figure 44:
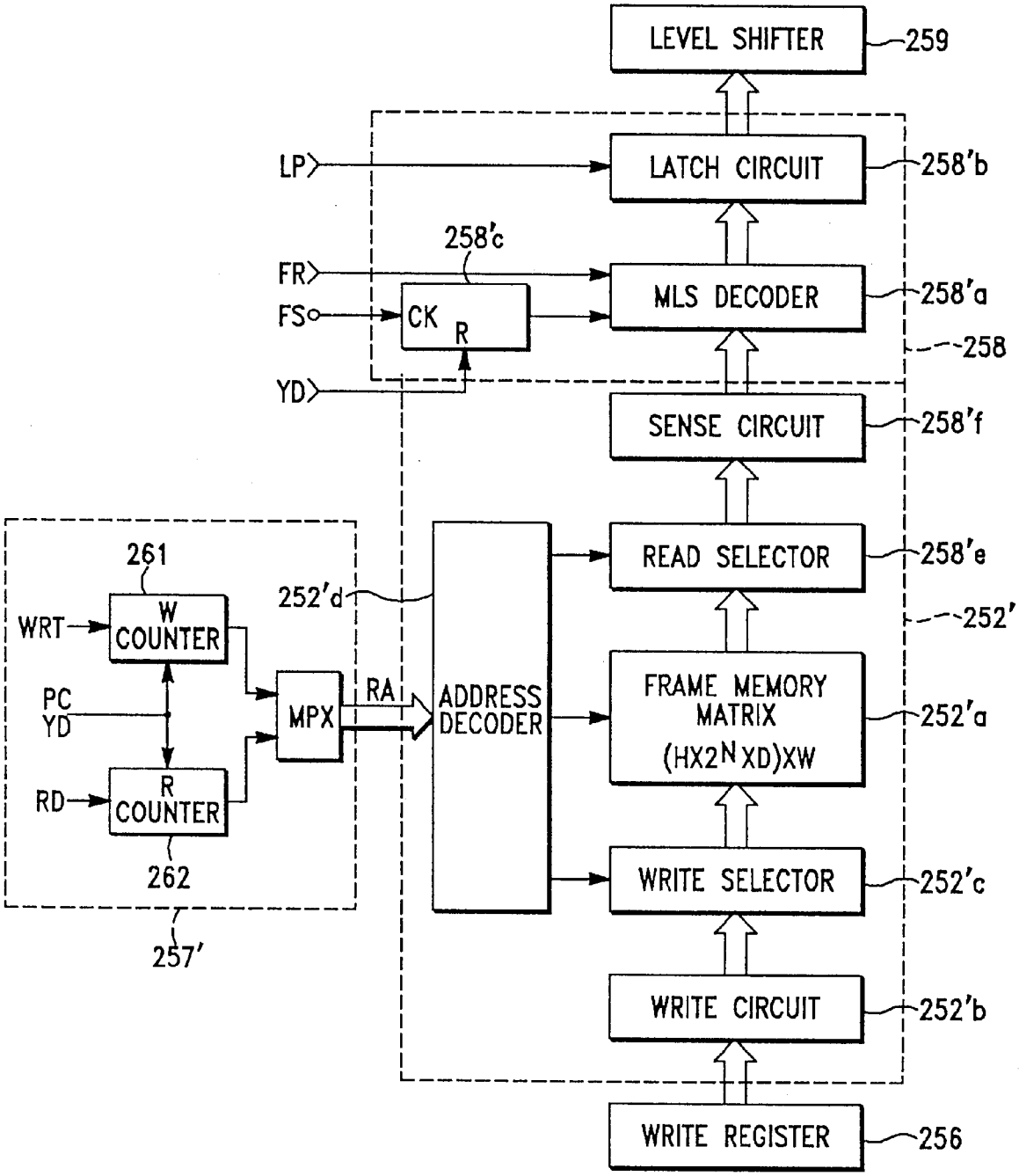
FIG. 44 is a block diagram of the signal electrode driver using the alternative frame memory shown in FIG. 43.

With the circuits shown in FIGS. 43–44, however, the speed at which the frame memory word bus address advances at the latch pulse LP input is faster in the read operation than the write operation. To compensate, line address register 257' has an independent write address W generator counter 261 and read address generator R counter 262, selects the appropriate output using multiplexer 263, and applies the output RA of multiplexer 263 to address decoder 252'*d*. Write address W generator counter 261 is initialized at frame start pulse YD, and generates the write address using the precharge control signal PC and write control signal WRT shown in FIG. 40. Read address generator R counter 262 is initialized at frame start pulse YD, and generates the read address using the precharge control signal PC and read control signal RD shown in FIG. 40. It is therefore possible to transfer the display data from the controller to the X driver within the period of the same latch pulse LP as in a conventional method controller irrespective of the number of simultaneously selected lines when using a $2^n$ multiple line selection drive method.

Generalizing this 2-line simultaneous read method, the overall structure of the X driver used to simultaneously read plural lines of display data from the frame memory in this multiple line selection drive method is described briefly below with reference to FIG. 44. It is assumed that the row-column configuration of memory matrix 252'*a* of frame memory 252' is $$(h \cdot 2^n \cdot D) \cdot W$$

where h: number of scan electrodes simultaneously selected and driven in the multiple line selection drive method, n: natural number, D: number of driver outputs per one X driver (the number of driveable signal electrodes), W: number of word buses.

The value $(h \cdot 2^n \cdot D)$. W is therefore equal to the maximum number of display dots that can be driven by one X driver. For reference, the frame memory in FIG. 39 has a capacity of (driver outputs)·(display lines).

Referring to FIG. 44, the display data stored in write register 256 is selected by address decoder 252'*d* through write circuit 252'*b* and write selector 252'*c* based on write control signal WR, and is written to the memory cells connected to the word bus. Address decoder 252'*d* decodes the line address output from line address register 257 in FIG. 39.

During the display data read operation, the $(h \cdot 2^n \cdot D)$ bit display data is read from frame memory matrix 252'*a* according to the read control signal RD into the read selector 252'*e*. Read selector 252'*e* selects $(h \cdot 2^n \cdot D)$ bit display data according to the output from address decoder 252'*d*. When n=0, read selector 252'*e* is therefore not needed. The h·D bit display data is all of the display data that can be simultaneously driven by the X driver during one scan period. The read selector 252'*e* output is converted to a digital signal by sense circuit 252'*f*, and sent to multiple line selection/drive decoder (MLS decoder) 258'*a* of signal pulse assignment circuit 258'. MLS decoder 258'*a* is reset by the display data, liquid crystal current alternating signal FR, and frame start pulse YD, counts the carrier signal FS from the Y driver, takes the output from state counter 258'*c*, which identifies the scan state in one frame, and decodes the signal selecting the driver output potential. The MLS decoder 258'*a* output is synchronized by latch circuit 258'*b*, which operates at the latch pulse LP clock, and is applied to level shifter 259.

While this circuit uses the multiple line selection drive method, reading the plural lines of display data is completed in one scan, thereby reducing power consumption and simplifying circuit timing.

It is to be noted that while the present invention has been described above with specific reference to a uniform distribution 2-line, selection drive method, it can also be applied to methods simultaneously selecting and driving three or more plural lines. It will be obvious that the invention can also be applied to the voltage averaging drive method used in part in conventional matrix display devices. The invention can also be applied to MIM drive methods, and is not limited to simple matrix methods.

In the above embodiment, the frame memory has memory cells to maintain a 1:1 ratio between display pixels and memory cells, but the invention can also be applied to other frame memory configurations. One such configuration has a frame memory for holding part or plural screens of display data associated with the pixels before and after the currently driven pixels, and intermittently transfers the display data from the module controller to the X driver. Another configuration uses compressed display data for the display elements.

The present invention is not limited to liquid crystal display devices, and can be used in a wide range of matrix-type display apparatus, including fluorescent display, plasma display, and electroluminescent display devices, and in applied liquid crystal displays using the light bulb properties of liquid crystals.

As described above, the present invention is characterized by intermittently operating the oscillation source of the high frequency clock of the matrix display controller when the display data is transferred in a method combining a conventional matrix display controller and a conventional signal electrode driver built in to the memory. By means of this matrix display controller, the total power consumption of the matrix display apparatus can be reduced by intermittent operation of the high frequency clock because the high frequency clock operates and the display data is transferred to the second storage means only when there is a change in the data stored in a first storage means. In addition, address assignment can simplified, and therefore screen rewrite speed can be increased, because the processing load of the host MPU on the first storage means side can be reduced (because the operation transferring data to the second storage means is executed not by the MPU but by an intervening matrix display controller) and the display data for each scan line can be batch stored to the second storage means (by further cascade connecting the signal electrode drive means).

In addition, the number of connections between the matrix display controller and signal electrode drivers can be reduced even in large capacity display devices by cascade connecting the signal electrode drivers, thereby achieving displays with an improved display area ratio.

The signal electrode driver can also easily access the second storage means using a timing signal obtained by dividing one scan period without using a high speed clock. Because the access timing for the second storage means is therefore not as restricted as in conventional methods, write performance can be improved and the size of the transistors forming the second storage means can be reduced. This also contributes to reducing the driver chip size.

When the present invention is applied to the multiple line selection drive method, a high contrast, high speed response, matrix-type liquid crystal display apparatus characterized by low flicker and consuming less power than conventional display devices can be achieved because the display apparatus can be operated at a low frequency even though the data processing required for one display line is greater than that of the conventional drive method.

It should accordingly be understood that the preferred embodiments and specific examples of modifications thereto which have been described are for illustrative purposes only and are not intended to be construed as limitations on the scope of the present invention. Thus, while there have been shown and described and pointed out fundamental novel features of the invention as applied to preferred embodiments thereof, it will be further understood that various omissions and substitutions and changes in the form and details of the devices illustrated and described, and in their operation, may be made by those skilled in the art without departing from the spirit of the invention. It is the intention, therefore, to be limited only as indicated by the scope of the claims appended hereto.

What is claimed is:

1. A matrix display apparatus for displaying an image in accordance with display data, said matrix display apparatus comprising:

a matrix display device comprising a plurality of scanning electrodes and a plurality of signal electrodes arranged in a matrix;

first driver means for grouping said plurality of scanning electrodes into a plurality of groups, wherein each of said plurality of groups comprises at least h scanning electrodes, wherein h is an integer of at least two, for sequentially selecting each of said plurality of groups and applying a selection voltage substantially simultaneously to said at least h scanning electrodes in said selected one of said plurality of groups during each of N selection periods per frame, wherein N is an integer of at least two, for sequentially applying a non-selection voltage, immediately after applying the selection voltage, substantially simultaneously to said at least h scanning electrodes to each one of said plurality of groups during each of N non-selection periods per frame; and second driver means for applying a signal voltage to said plurality of signal electrodes, said second driver means comprising:

memory means for storing the display data for at least one group of said h scanning electrodes, and selection means for selecting the signal voltage applied to each of said plurality of signal electrodes from the plurality of the signal voltages in accordance with the stored display data for at least one group of h scanning electrodes and the level of the selection voltage.

2. The matrix display apparatus of claim 1, wherein said first driver means applies the selection voltage to at least one of the scanning electrodes different from that to other of the scanning electrodes in said group.

3. The matrix display apparatus of claim 1, wherein said first driver means applies the selection voltage to each one of said plurality of scanning electrodes a plurality of times in one frame period.

4. The matrix display apparatus of claim 1, wherein said selection means selects the signal voltage from a plurality of the signal voltages based on anti-coincidence between a pattern of the display data and the selection pattern data.

5. The matrix display apparatus of claim 1, wherein said second driver means comprises a plurality of driver integrated circuits and wherein each of said plurality of driver integrated circuits comprises a divided memory for storing a divided portion of the display data for at least one group of h scanning electrodes, respectively.

6. The matrix display apparatus of claim 5, wherein said driver integrated circuit each comprises:

exclusive-OR gate means for inputting said display data for one group of h scanning electrodes stored in said divided memory and the selection pattern data; and decoder means for inputting an output of said exclusive-OR gate means and for selecting the signal voltage from a plurality of the signal voltages in accordance with the output of said exclusive-OR gate means.

7. The matrix display apparatus of claim 5, wherein each of said driver integrated circuits comprises:

decoder means for inputting said display data for one group of h scanning electrodes stored in said divided memory and said selection pattern data and for selecting the signal voltage from a plurality of the signal voltages in accordance with the input display data and the selection pattern data.

8. The matrix display apparatus of claim 1, wherein the selection pattern data represents a selection voltage level of each of the h scanning electrodes.

9. The matrix display apparatus of claim 2, wherein the selection voltage applied by said first driver means comprises one of +V1 and −V1.

10. A drive circuit for a display device having a plurality of row electrodes and column electrodes, the plurality of row electrodes being arranged in groups, said drive circuit comprising:

a row electrode data generating circuit for generating row selection pattern data;

a frame memory for providing display data;

an arithmetic operation circuit for calculating column data in accordance with the row selection pattern data generated by said row electrode data generating circuit and the display data provided by said frame memory, said arithmetic operation circuit comprising:

memory for storing the display data for at least one group of the plurality of row electrodes, and selector for selecting the column data applied to each of the plurality of column electrodes from a plurality of signal voltages in accordance with the display data for at least one group of row electrodes and the row selection pattern data;

a column electrode driver responsive to said arithmetic operation circuit for generating column data for the plurality of column electrodes; and a row electrode driver responsive to the row selection pattern data generated by said row electrode data generating circuit for grouping said plurality of row electrodes into a plurality of groups, wherein each of said plurality of groups comprises at least h row electrodes, wherein h is an integer of at least two, for sequentially selecting each of said plurality of groups and applying a selection signal substantially simultaneously to said at least h row electrodes in said selected one of said plurality of groups during each of N selection periods per frame, wherein N is an integer of at least two, and for sequentially applying a non-selection signal, immediately after applying the selection signal, substantially simultaneously to said at least h row electrodes to each one of said plurality of groups during each of N non-selection periods per frame.

11. A display apparatus comprising:

a display having a plurality of row electrodes and column electrodes, the row electrodes being arranged in groups; and a drive circuit comprising:

a row electrode data generating circuit for generating row selection pattern data, a frame memory which for providing display data, an arithmetic operation circuit for calculating column data in accordance with the row selection pattern data generated by said row electrode data generating circuit and the display data provided by said frame memory, said arithmetic operation circuit comprising:

for storing the display data for at least one group of the plurality of row electrodes, and selector for selecting the column data applied to each of the plurality of column electrodes from a plurality of signal voltages in accordance with the display data for at least one group of row electrodes and the row selection pattern data, a column electrode driver responsive to said arithmetic operation circuit for generating column data for the plurality of column electrodes; and a row electrode driver responsive to the row selection pattern data generated by said row electrode generating circuit for grouping said plurality of row electrodes into a plurality of groups, wherein each of said plurality of groups comprises at least h row electrodes, wherein h is an integer of at least two, for sequentially selecting each of said plurality of groups and applying a selection signal substantially simultaneously to said at least h row electrodes in said selected one of said plurality of groups during each of N selection periods per frame, wherein N is an integer of at least two, for sequentially applying a non-selection signal, immediately after applying the selection signal, substantially simultaneously to said at least h row electrodes to each one of said plurality of groups during each of N non-selection periods per frame.

12. A driving apparatus for a liquid crystal matrix panel having a liquid crystal matrix having a plurality of row electrodes and plurality of column electrodes, said driving circuit comprising:

frame memory means for providing display data;

row electrode generating means for generating row selection pattern data;

arithmetic means responsive to the row selection pattern data generated by said row electrode generating means and the display data provided by said frame memory means for generating column data, said arithmetic means comprising:

memory means for storing the display data for at least one group of at least i row electrodes, and selection means for generating the converted data to select the column data applied to each of the plurality of column electrodes from a plurality of signal voltages, in accordance with the display data for at least one group of row electrodes and the row selection pattern data;

row driving means responsive to said row electrode generating means for grouping said plurality of row electrodes into a plurality of groups, wherein each of said plurality of groups comprises at least h row electrodes, wherein h is an integer of at least two, for sequentially selecting each of said plurality of groups and applying a selection signal substantially simultaneously to said at least h row electrodes in said selected one of said plurality of groups during each of N selection periods per frame, wherein N is an integer of at least two, for sequentially applying a non-selection signal, immediately after applying the selection signal, substantially simultaneously to said at least h row electrodes to each one of said plurality of groups during each of N non-selection periods per frame; and column driving means responsive to the column data calculated by said arithmetic means for generating column data for said plurality of column electrodes.

13. The driving circuit of claim 12, wherein the column data comprises l voltage levels, l being a predetermined positive integer.

14. A liquid crystal display apparatus comprising:

a pair of opposing substrates a plurality of row electrodes disposed on one of said substrates and a plurality of column electrodes arranged on the other substrate, wherein said plurality of row electrodes are divided into groups of row electrodes;

a liquid crystal material disposed between said pair of substrates; and a drive circuit comprising:

a row electrode data generating circuit for generating row selection pattern data, a frame memory for providing display data, an arithmetic operation circuit for calculating column data in accordance with the row selection pattern data generated by said row electrode data generating circuit and the display data provided by said frame memory, said arithmetic operation circuit comprising:

memory for storing the display data for at least one group of the plurality of row electrodes, selector for selecting the column data applied to each of the plurality of column electrodes from a plurality of signal voltages in accordance with the display data for at least one group of row electrodes and the selection pattern data, a column electrode driver responsive to the column data calculated by said arithmetic operation circuit for generating column data for the plurality of column electrodes, and a row electrode driver responsive to the row selection pattern data generated by said row electrode data generating circuit for grouping said plurality of row electrodes into a plurality of groups, wherein each of said plurality of groups comprises at least h row electrodes, wherein h is an integer of at least two, for sequentially selecting each of said plurality of groups and applying a selection signal substantially simultaneously to said at least h row electrodes in said selected one of said plurality of groups during each of N selection periods per frame, wherein N is an integer of at least two, for sequentially applying a non-selection signal, immediately after applying the selection signal, substantially simultaneously to said at least h row electrodes to each one of said plurality of groups during each of N non-selection periods per frame.

15. A matrix display apparatus for displaying an image in accordance with display data, said matrix display apparatus comprising:

a matrix display device comprising a plurality of scanning electrodes and a plurality of signal electrodes arranged in a matrix;

scanning electrode driver for grouping said plurality of scanning electrodes into a plurality of groups, wherein each of said plurality of groups comprises at least h scanning electrodes, wherein h is an integer of at least two, for sequentially selecting each of said plurality of groups and applying a selection voltage substantially simultaneously to said at least h scanning electrodes in said selected one of said plurality of groups during each of N selection periods per frame, wherein N is an integer of at least two, for sequentially applying a non-selection voltage, immediately after applying the selection voltage, substantially simultaneously to said at least h scanning electrodes to each one of said plurality of groups during each of N non-selection periods per frame; and signal electrode driver for applying a signal voltage to said plurality of signal electrodes, said second driver means comprising:

a memory for storing the display data for at least one group of said h scanning electrodes, and a selector for selecting the signal voltage applied to each of said plurality of signal electrodes from the plurality of the signal voltages in accordance with the stored display data for at least one group of h scanning electrodes and the level of the selection voltage.

16. The matrix display apparatus of claim 15, wherein said scanning electrode driver applies the selection voltage to at least one of the scanning electrodes different from that to other of the scanning electrodes in said group.

17. The matrix display apparatus of claim 15, wherein said scanning electrode driver applies the selection voltage to each one of said plurality of scanning electrodes a plurality of times in one frame period.

18. The matrix display apparatus of claim 15, wherein said selector selects the signal voltage from a plurality of the signal voltages based on anti-coincidence between a pattern of the display data and the selection pattern data.

19. The matrix display apparatus of claim 15, wherein said signal electrode driver comprises a plurality of driver integrated circuits and wherein each of said plurality of driver integrated circuits comprises a divided memory for storing a divided portion of the display data for at least one group of h scanning electrodes, respectively.

20. The matrix display apparatus of claim 19, wherein said driver integrated circuit each comprises:

an exclusive-OR gate for inputting said display data for one group of h scanning electrodes stored in said divided memory and the selection pattern data; and a decoder for inputting an output of said exclusive-OR gate and for selecting the signal voltage from a plurality of the signal voltages in accordance with the output of said exclusive-OR gate.

21. The matrix display apparatus of claim 19, wherein each of said driver integrated circuits comprises:

a decoder for inputting said display data for one group of h scanning electrodes stored in said divided memory and said selection pattern data and for selecting the signal voltage from a plurality of the signal voltages in accordance with the input display data and the selection pattern data.

22. The matrix display apparatus of claim 15, wherein the selection pattern data represents a voltage level of each of the h scanning electrodes.

23. The matrix display apparatus of claim 16, wherein the selection voltage applied by said scanning electrode driver comprises one of +V1 and −V1.

24. A display driver for driving a matrix display, comprising a plurality of scanning electrodes and a plurality of signal electrodes arranged in a matrix, in accordance with display data, a plurality of groups of scanning electrodes, wherein each of the plurality of groups comprises at least h scanning electrodes, wherein h is an integer of at least two, wherein each of said plurality of groups is sequentially selected by applying a selection signal substantially simultaneously to the at least h scanning electrodes in the selected one of the plurality of groups during each of N selection periods per frame, wherein N is an integer of at least two, wherein a non-selection signal is sequentially applied immediately after applying the selection signal, substantially simultaneously to the at least h scanning electrodes to each one of the plurality of groups during each of N non-selection periods per frame, said display driver comprising:

a memory for storing a portion of the display data for at least one group of h scanning electrodes, wherein h being an integer greater than 1;

a selector for selecting a signal voltage applied to each of the signal electrodes from a plurality of the signal voltages in accordance with said display data for at least one group of h scanning electrodes stored by said memory and the selection pattern data.

25. The display driver of claim 24, wherein said selector comprises:

an exclusive-OR gate for inputting the display data for one group of h scanning electrodes stored in said memory and said selection pattern data; and a decoder for inputting an output of said exclusive-OR gate and for selecting the signal voltage from a plurality of the signal voltages in accordance with the output of said exclusive-OR gate means.

26. The display driver of claim 24, wherein said selector comprises:

a decoder for inputting the display data for one group of said h scanning electrodes stored in said memory and the selection pattern data and for selecting the signal voltage from a plurality of the signal voltages in accordance with said input display data and selection pattern data.

* * * * *

UNITED STATES PATENT AND TRADEMARK OFFICE

CERTIFICATE OF CORRECTION

| | | |
|---|---|---|
| PATENT NO. | : | 5,900,856 |
| DATED | : | May 04, 1999 |
| INVENTOR(S) | : | Yoichi Imamura |

It is certified that an error appears in the above identified patent and that said Letters Patent is hereby corrected as shown below:

Column 50, line 26, insert --memory-- before "for storing".

Signed and Sealed this

Seventh Day of March, 2000

*Attest:*

*Attesting Officer*

Q. TODD DICKINSON

*Commissioner of Patents and Trademarks*